US011692324B2

(12) United States Patent
Molloy

(10) Patent No.: US 11,692,324 B2
(45) Date of Patent: Jul. 4, 2023

(54) WALL ELEMENT SYSTEM AND METHOD AND APPARATUS FOR CONSTRUCTING SHORING WALLS

(71) Applicant: Southern Seawall Solutions Pty Limited, Taren Point (AU)

(72) Inventor: Anthony Molloy, Tahmoor (AU)

(73) Assignee: Southern Seawall Solutions Pty Limited, Taren Point (AU)

( * ) Notice: Subject to any disclaimer, the term of this patent is extended or adjusted under 35 U.S.C. 154(b) by 0 days.

(21) Appl. No.: 17/406,568

(22) Filed: Aug. 19, 2021

(65) Prior Publication Data

US 2021/0381190 A1 Dec. 9, 2021

Related U.S. Application Data

(63) Continuation of application No. 16/383,199, filed on Apr. 12, 2019, now abandoned.

(30) Foreign Application Priority Data

Apr. 23, 2018 (AU) ..... 2018202809

(51) Int. Cl.
*E02D 29/02* (2006.01)
*E02F 5/02* (2006.01)

(52) U.S. Cl.
CPC ..... *E02D 29/0266* (2013.01); *E02F 5/02* (2013.01); *E02D 2300/002* (2013.01); *E02D 2300/0006* (2013.01); *E02D 2300/0026* (2013.01); *E02D 2600/20* (2013.01)

(58) Field of Classification Search
CPC ..... E02D 29/0266; E02D 5/02; E02D 29/02; E02D 2600/20; E02F 5/02
See application file for complete search history.

(56) References Cited

U.S. PATENT DOCUMENTS

| | | | |
|---|---|---|---|
| 10,119,234 | B1 | 11/2018 | Yeany |
| 2005/0053429 | A1 | 3/2005 | Davidsaver et al. |
| 2016/0305083 | A1 | 10/2016 | Hargrave et al. |

FOREIGN PATENT DOCUMENTS

| | | | |
|---|---|---|---|
| AU | 2016100200 | A4 | 3/2016 |
| AU | 2016203790 | A1 | 1/2017 |
| EP | 1980709 | A1 | 10/2008 |
| GB | 2132252 | A | 7/1984 |
| JP | H0868287 | A | 3/1996 |
| JP | 2006283516 | A | 10/2006 |
| JP | 2008174981 | A | 7/2008 |
| WO | 2008147787 | A2 | 12/2008 |
| WO | 2017139828 | A1 | 8/2017 |

*Primary Examiner* — Sean D Andrish
(74) *Attorney, Agent, or Firm* — Cahn & Samuels, LLP

(57) ABSTRACT

A caisson or casing 107 for installing a sheet 102/103 into a ground or underwater location, the caisson 107 having a shaped wall 107.1, which is open for a predetermined length and is adapted to receive and connect to an excavation means 3 within the confines of the caisson or casing 107. In at least one embodiment, the system includes a drilling assembly 3 for insertion of a caisson or casing 1, the drilling assembly 3 having one or more expanding drill bits 4 which are adapted to be driven by a drilling or rotation motive device 5, the expanding drill bits 4 being adapted to be arranged with respect to the caisson or casing 1 in use, so as form a hole or bore which substantially conforms to, or substantially overlaps with, the shape of the caisson or casing 1.

17 Claims, 57 Drawing Sheets

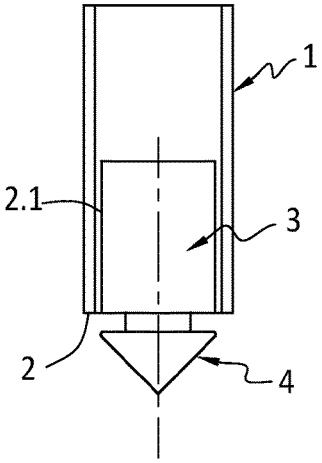
FIGURE 1.1
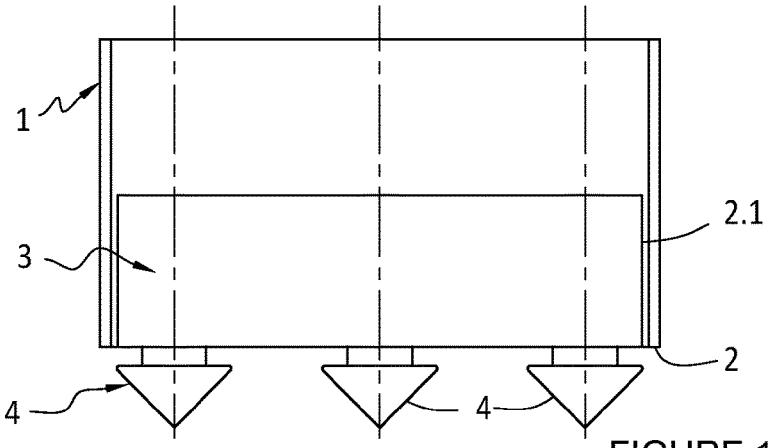
FIGURE 1.2
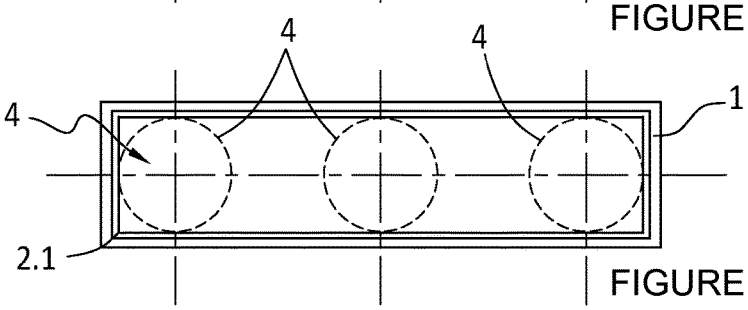
FIGURE 1.3
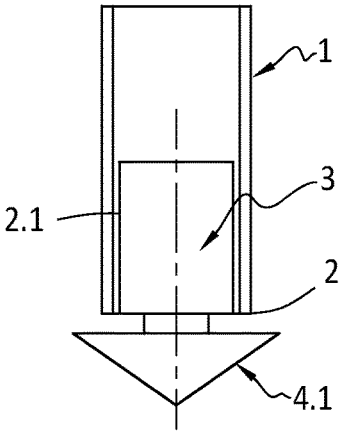
FIGURE 2.1
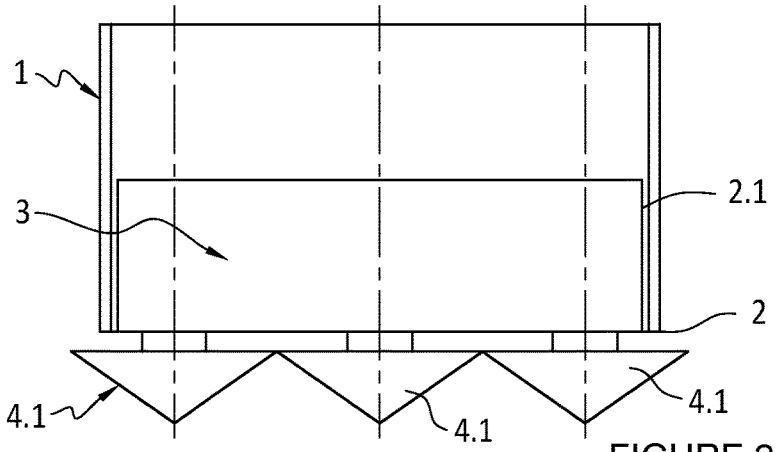
FIGURE 2.2
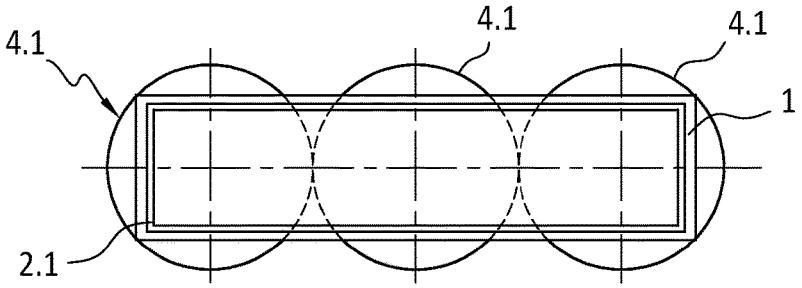
FIGURE 2.3

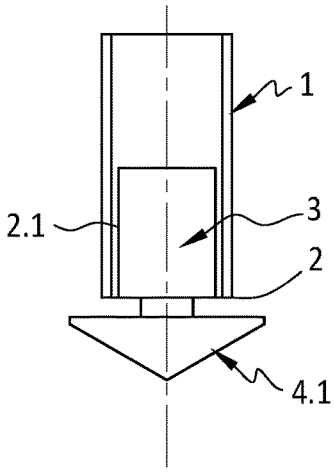
FIGURE 3.1
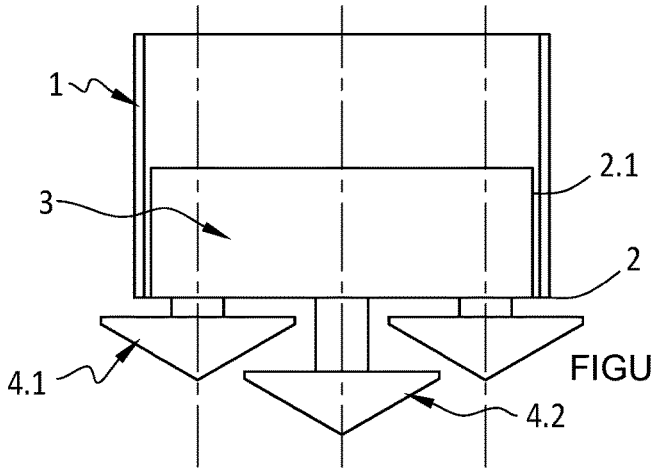
FIGURE 3.2
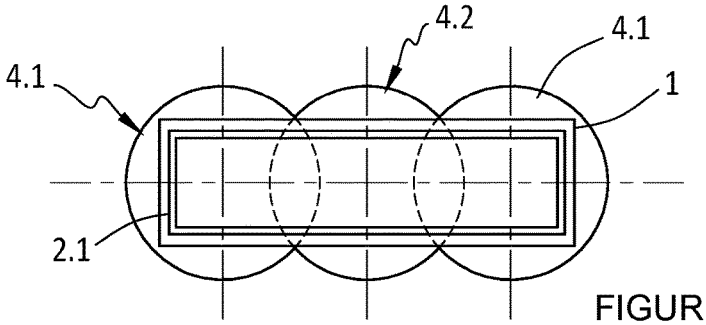
FIGURE 3.3
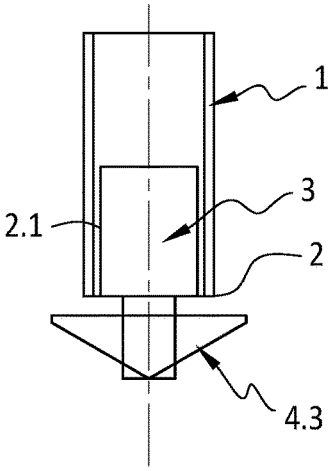
FIGURE 4.1
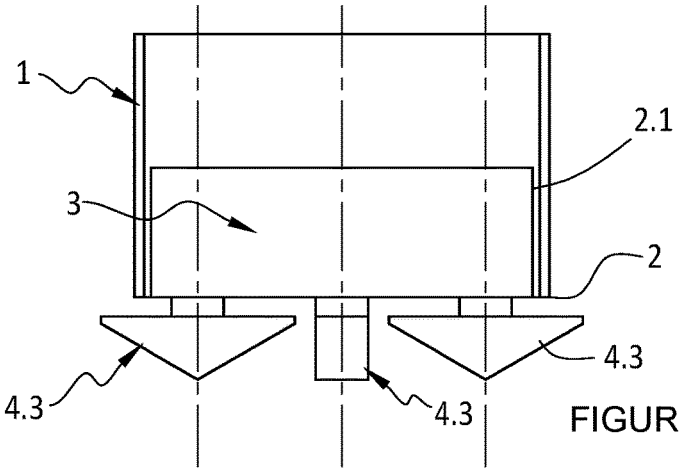
FIGURE 4.2
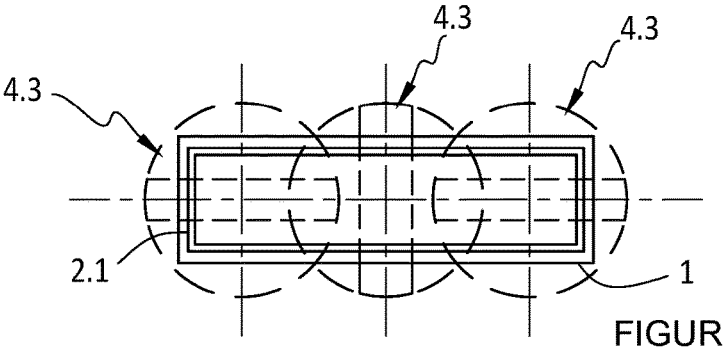
FIGURE 4.3

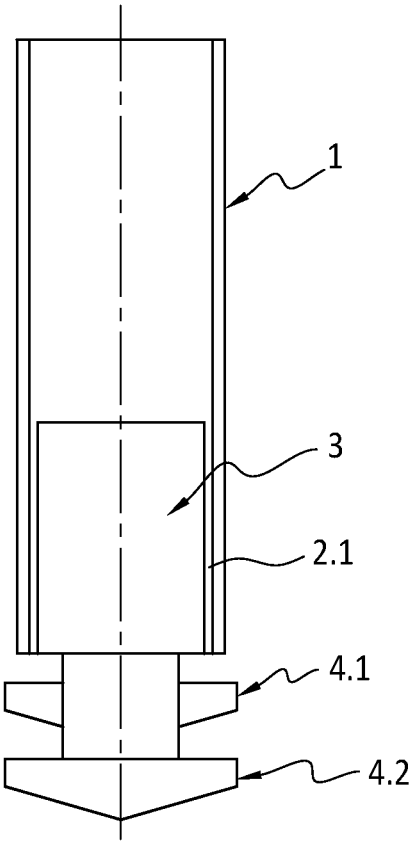
FIGURE 8.1
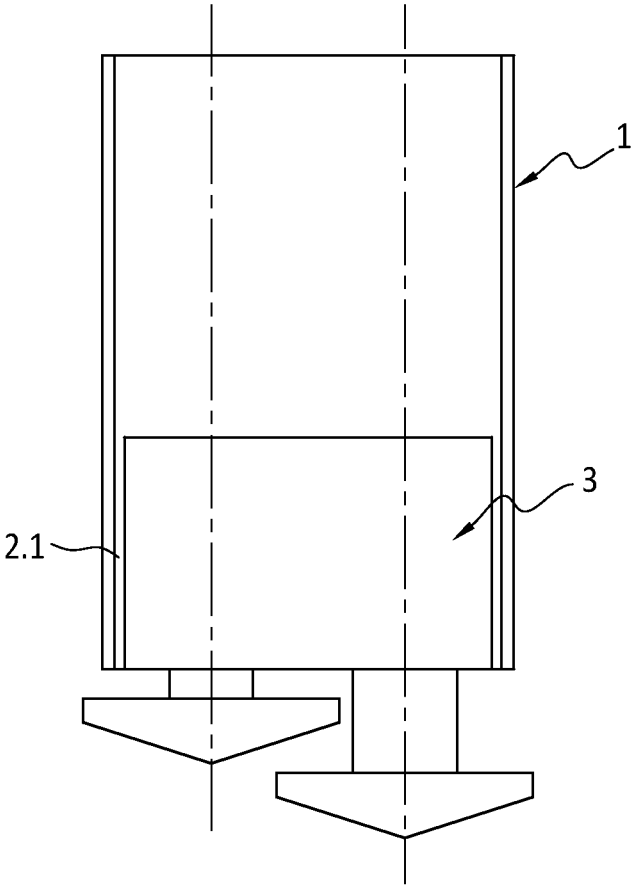
FIGURE 8.3
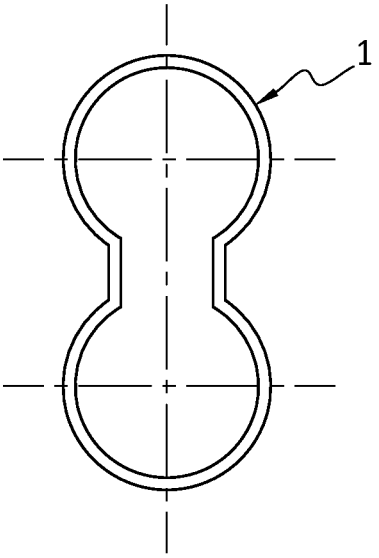
FIGURE 8.2
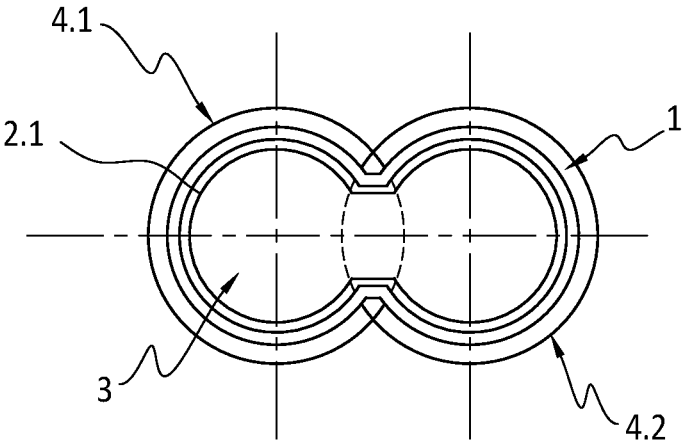
FIGURE 8.4

| Size-API-2-3/8" | Expanding Drag Bit |
|---|---|

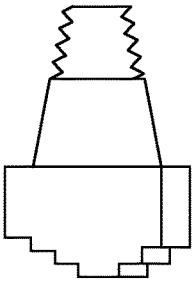

FIGURE 10.1

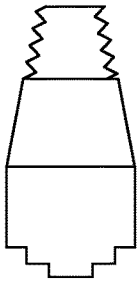

FIGURE 10.4

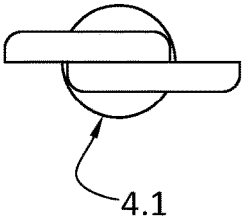

FIGURE 10.2

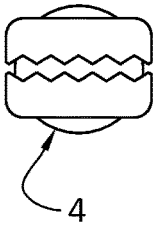

FIGURE 10.5

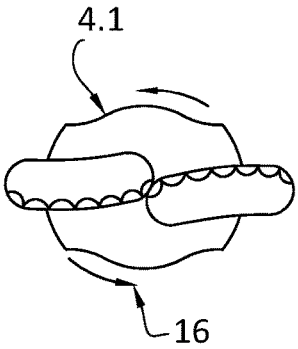

FIGURE 10.3

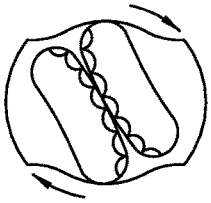

FIGURE 10.6

| Size-API-3-1/2" | Expanding Drag Bit |
|---|---|

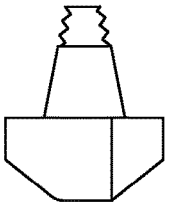

FIGURE 10.7

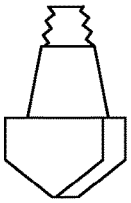

FIGURE 10.10

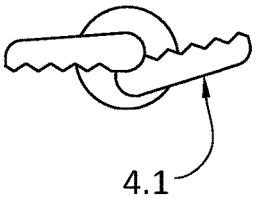

FIGURE 10.8

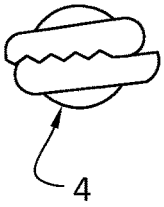

FIGURE 10.11

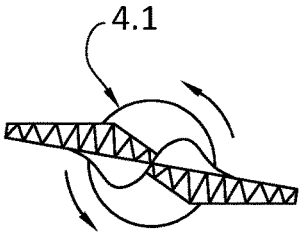

FIGURE 10.9

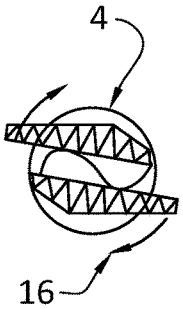

FIGURE 10.12

| ROD O.D. | Max. Expansion | Length | Weight kg | ROD O.D. | Max. Expansion | Length | Weight kg |
|---|---|---|---|---|---|---|---|
| 85mm | 155mm | 220 | 5.5kg | 140mm | 235mm | 375 | 11kg |
| 100mm | 165mm | 220 | 6.0kg | 165mm | 260mm | 375 | 13kg |
| 115mm | 185mm | 220 | 7.0kg | 180mm | 275mm | 375 | 14kg |
| 125mm | 195mm | 220 | 7.0kg | 190mm | 295mm | 375 | 16kg |
| 140mm | 200mm | 220 | 7.0kg | 210mm | 320mm | 375 | 17kg |
| 165mm | 230mm | 220 | 7.0kg | | | | |
| | API-023150-01 | ISO-9001 CERTIFIED | | Email : chlee 783@ms48.hinet.net | | | |
| DESIGNED BY | | LEE CHIN YI | | http : www.chuan-home.com.tw | | | |
| CHUAN HOME MACHINERY CO., LTD TEL: 886-3-328-7883 FAX : 328-8732 | | | | | | | |

FIGURE 10.13

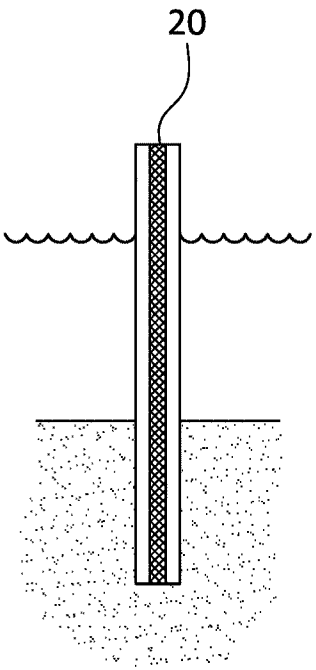
FIGURE 13.3
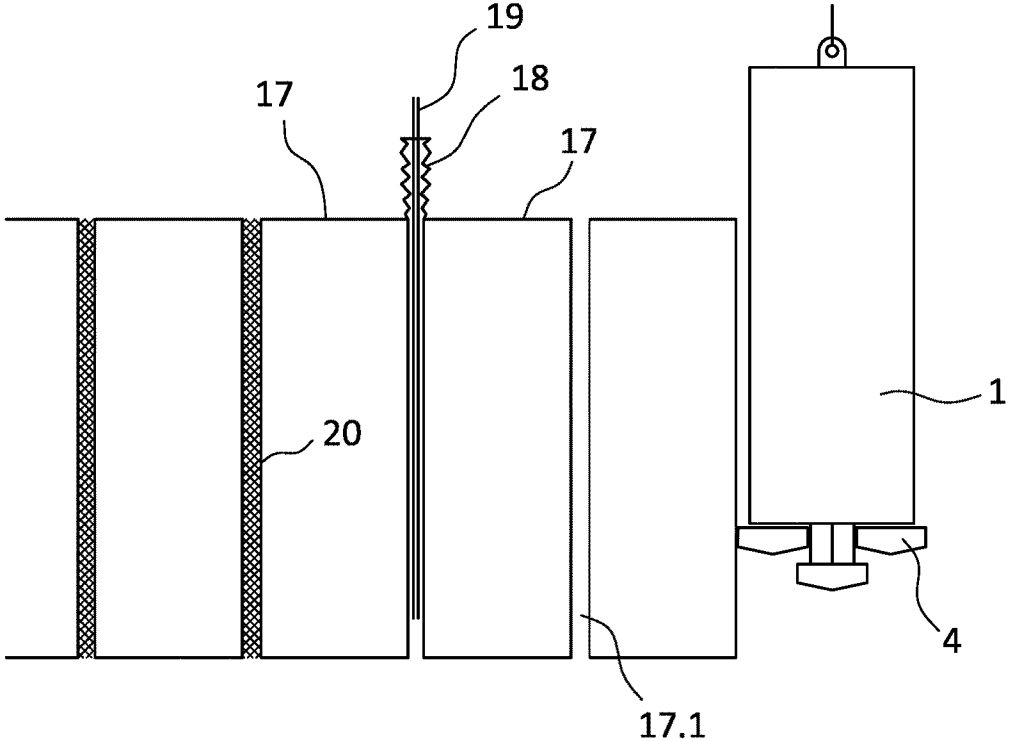
FIGURE 13.1
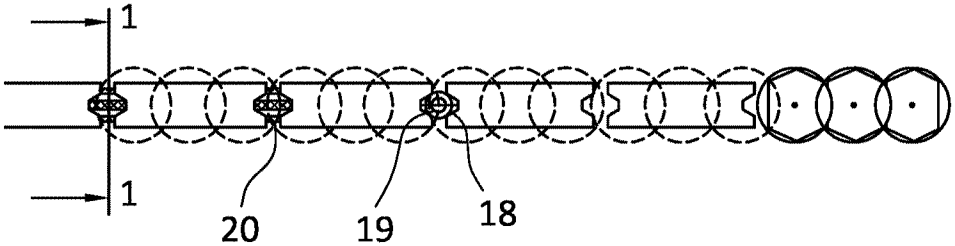
FIGURE 13.2

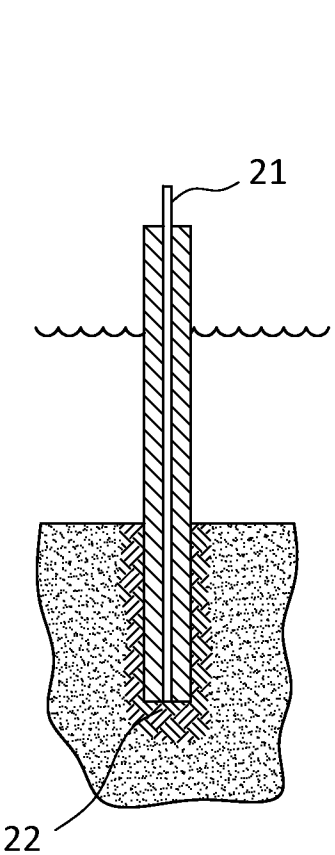
FIGURE 14.3
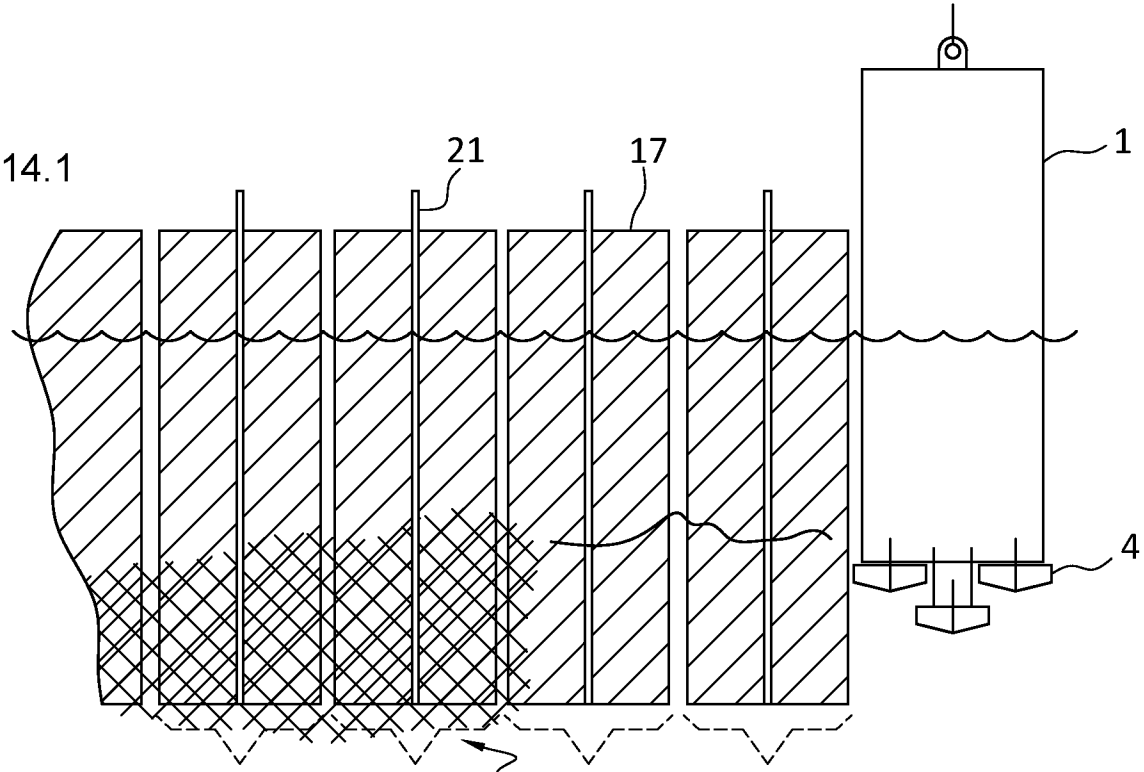
FIGURE 14.1
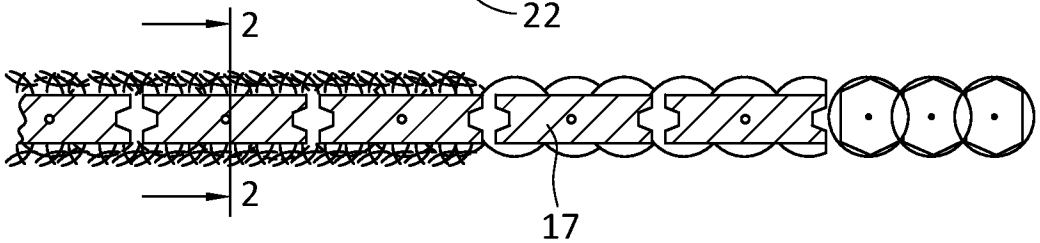
FIGURE 14.2

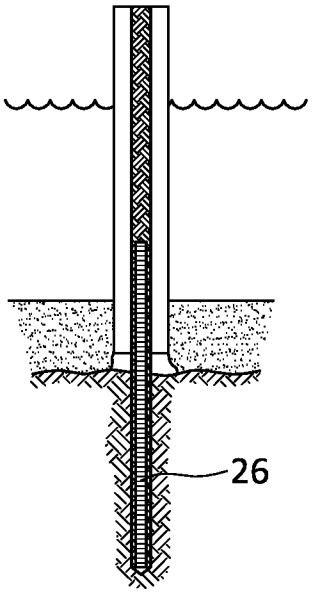
FIGURE 15.3
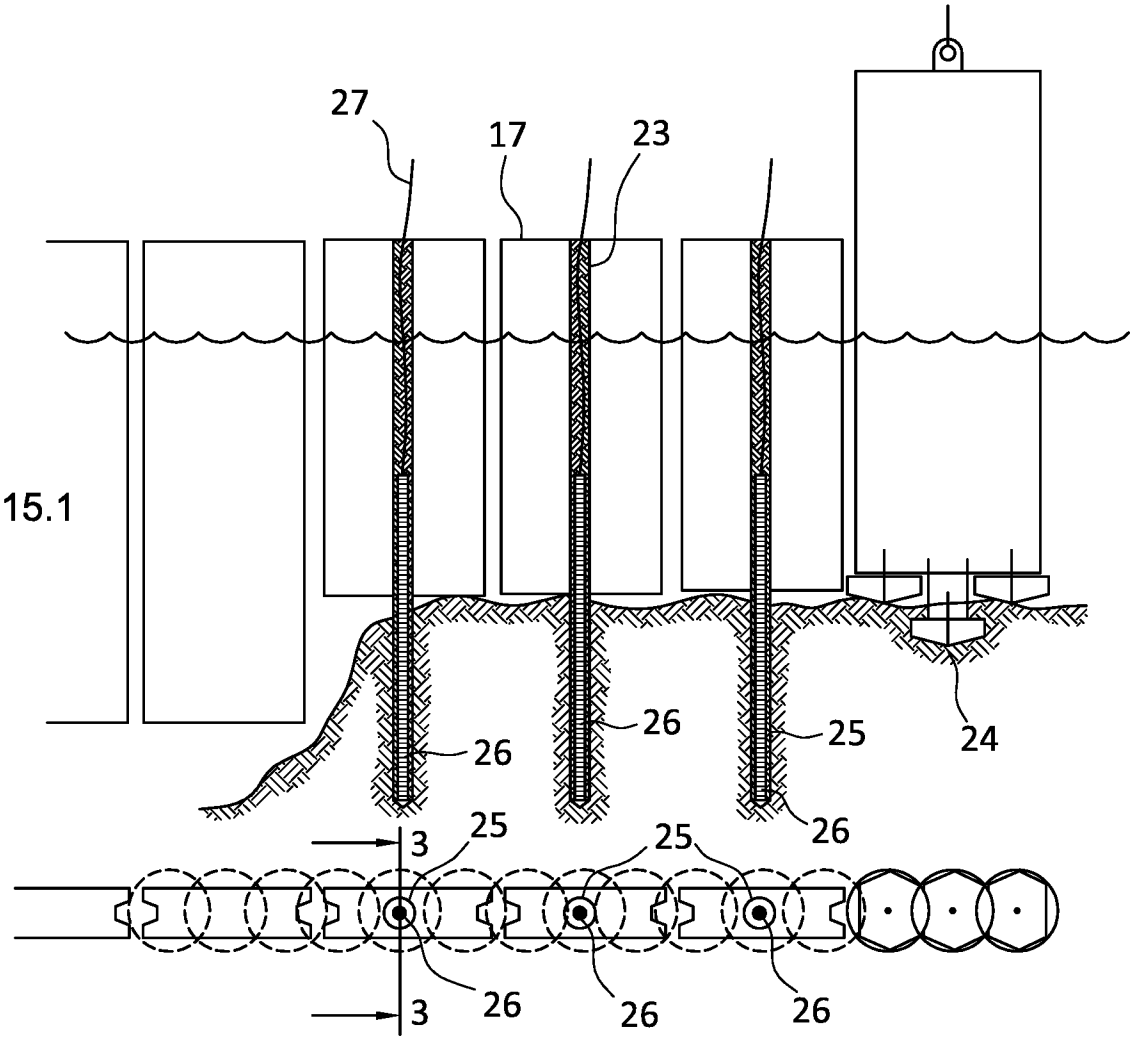
FIGURE 15.1
FIGURE 15.2

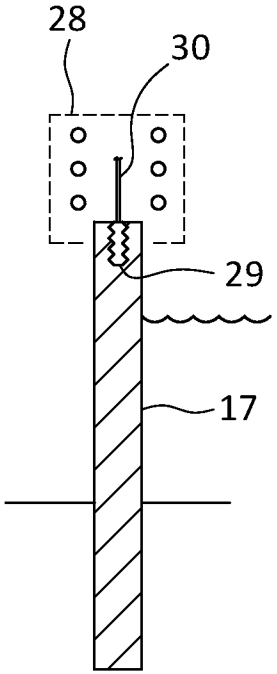
FIGURE 16.3
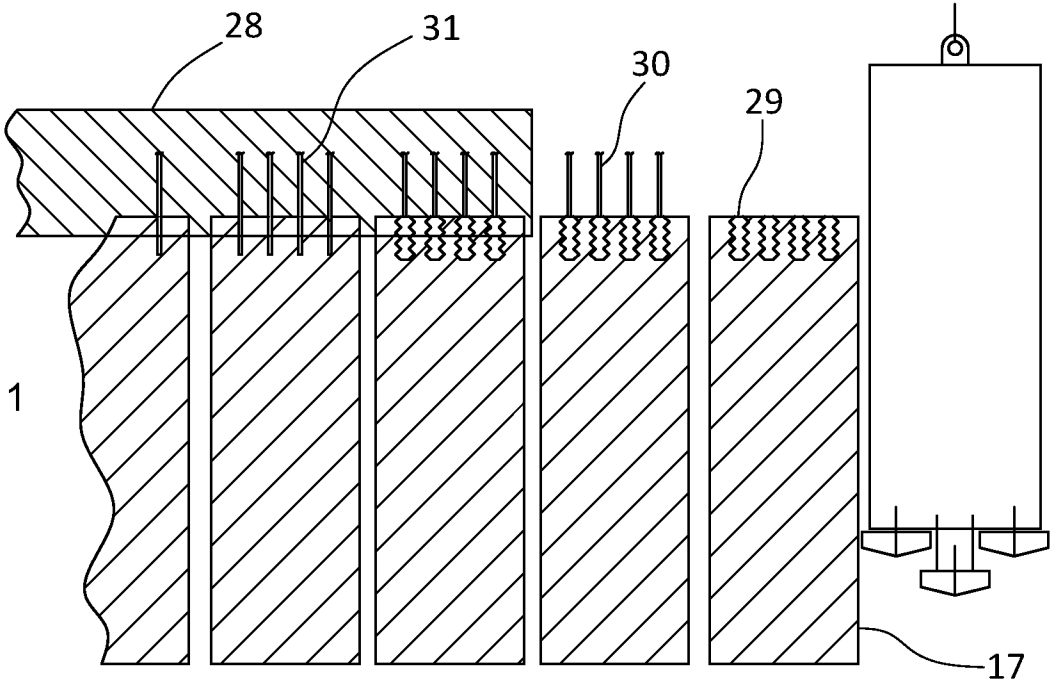
FIGURE 16.1
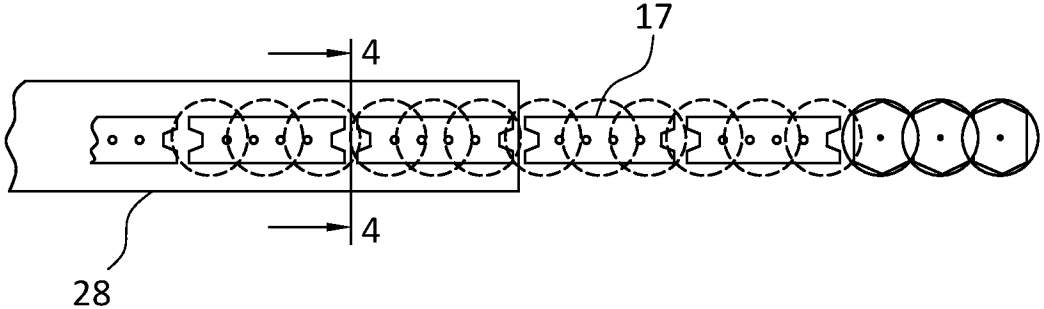
FIGURE 16.2

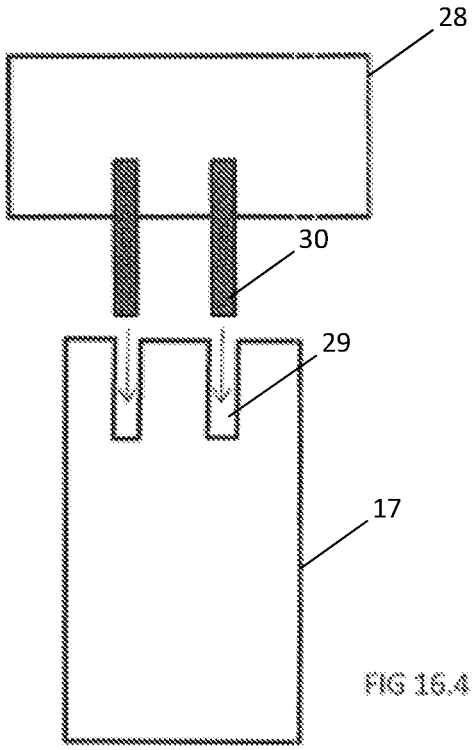
FIG 16.4
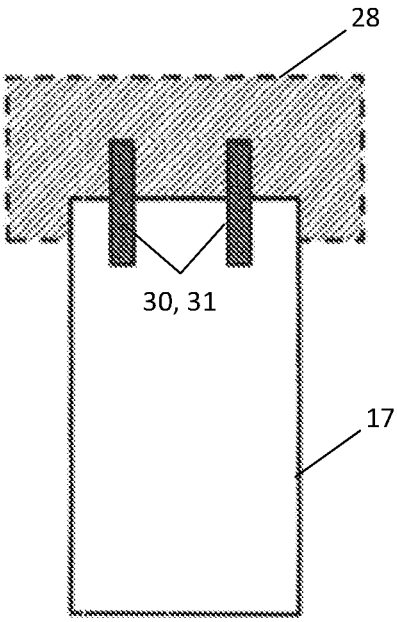
FIG 16.5
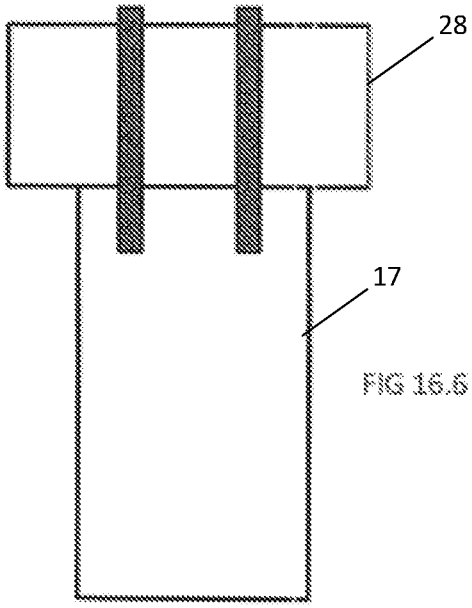
FIG 16.6

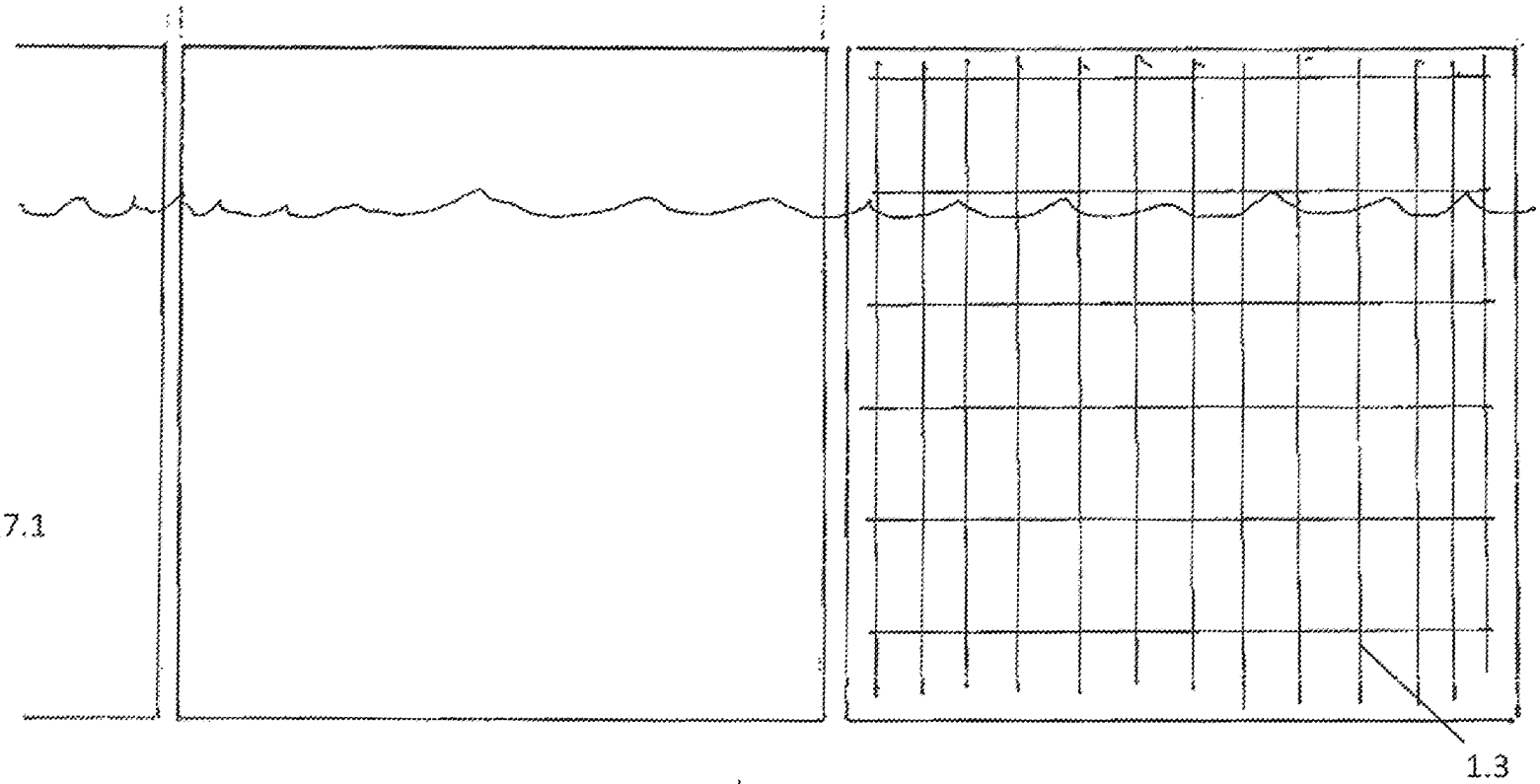
FIG 17.1
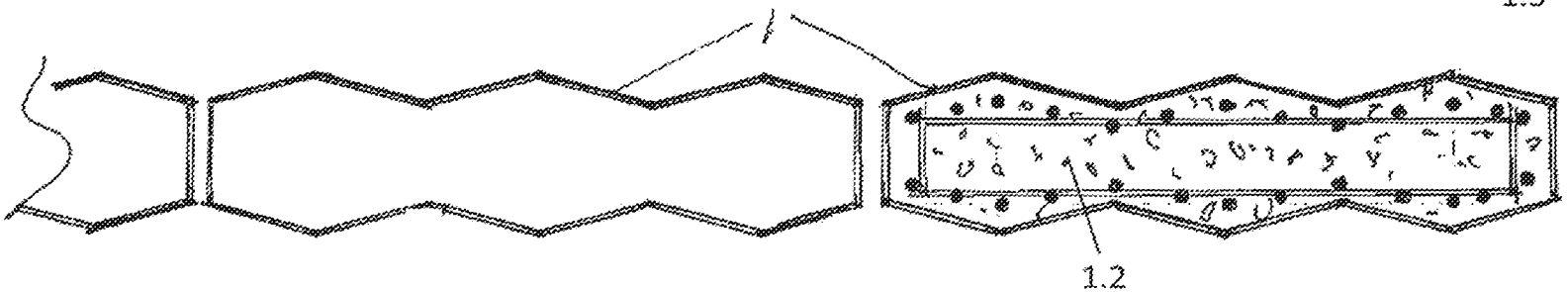
FIG 17.2

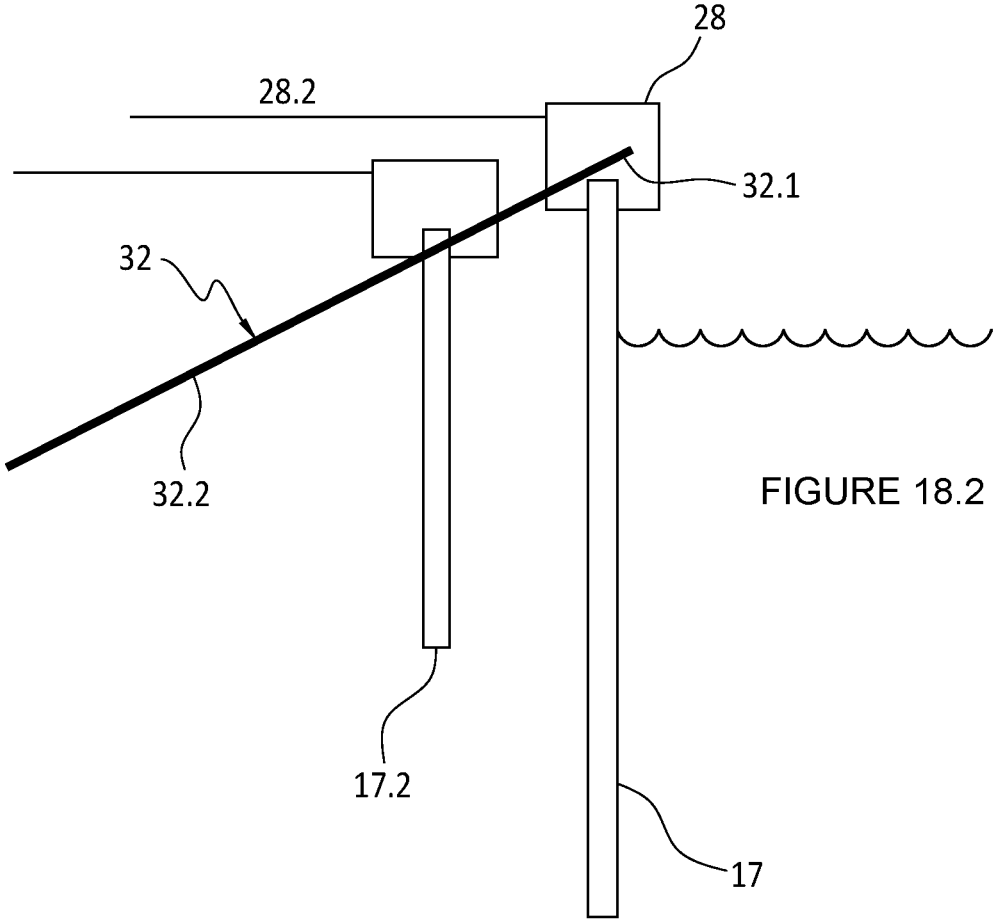
FIGURE 18.2
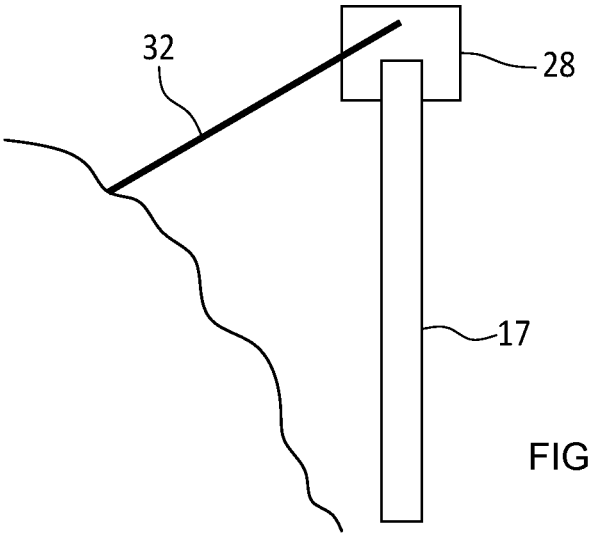
FIGURE 18.1

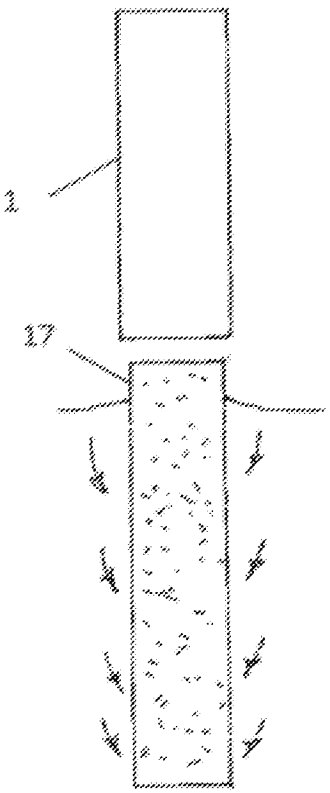
FIG 19.4
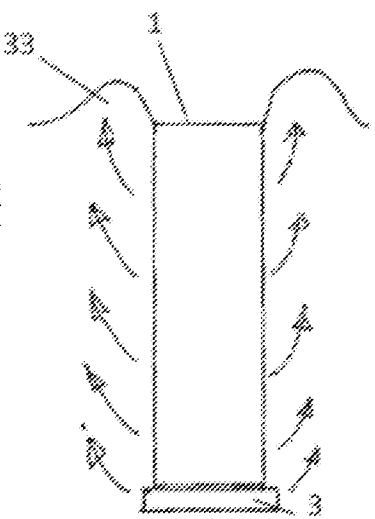
FIG 19.3
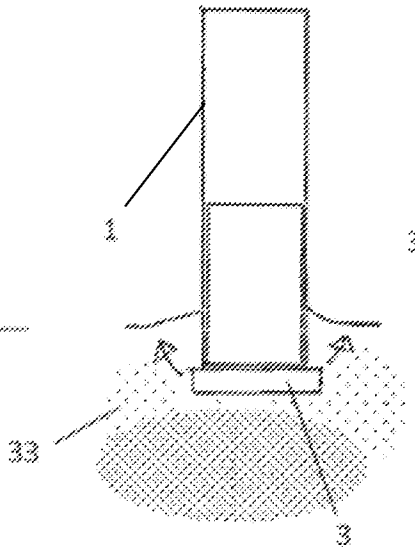
FIG 19.2
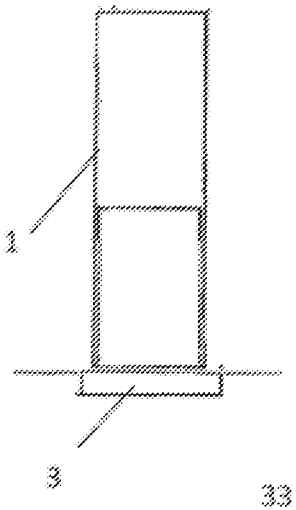
FIG 19.1

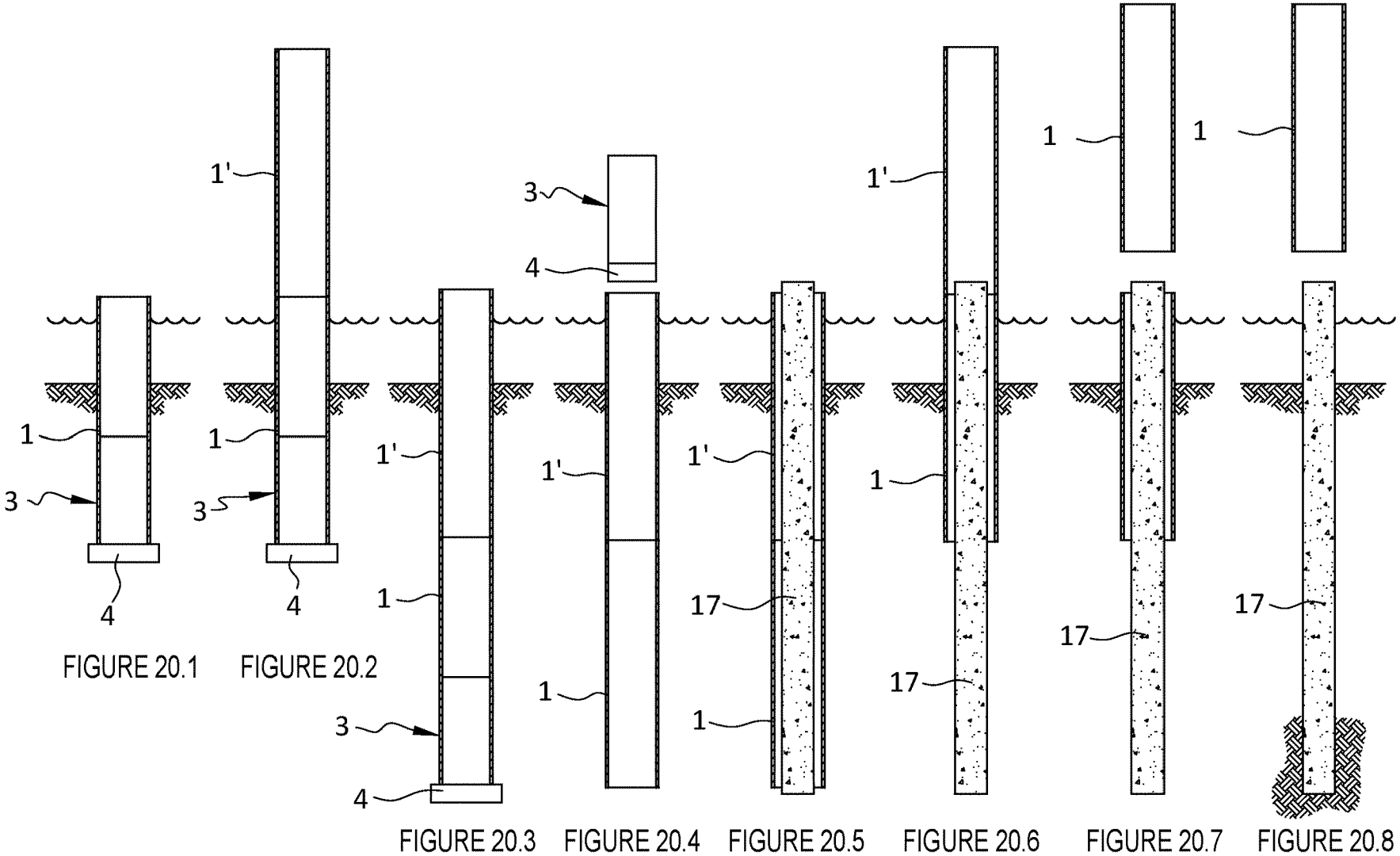
FIGURE 20.1 FIGURE 20.2 FIGURE 20.3 FIGURE 20.4 FIGURE 20.5 FIGURE 20.6 FIGURE 20.7 FIGURE 20.8

101
105
106
125.11
125.10
125
X
A
125.4
107.2
Y
107
107.3
107.1
107.4
107.5
107.6
X
108
107.7
107.8
107.9
107.10
125.2
B
104
3
109
Y
126
300
125.13
106
300
126
107

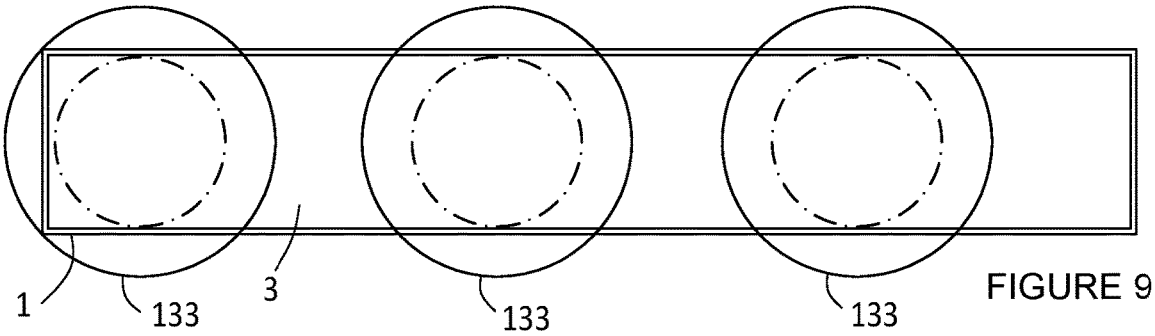
FIGURE 91
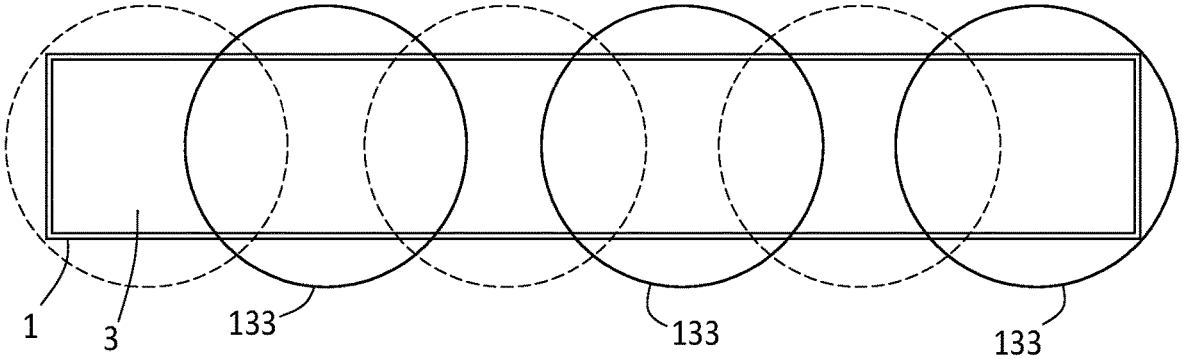
FIGURE 92
FIGURE 50A
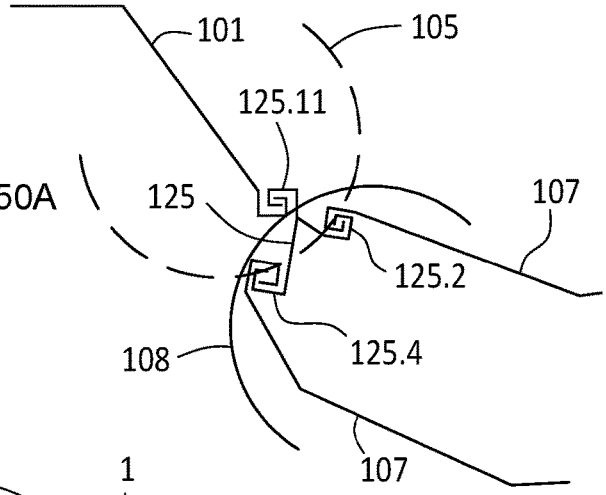
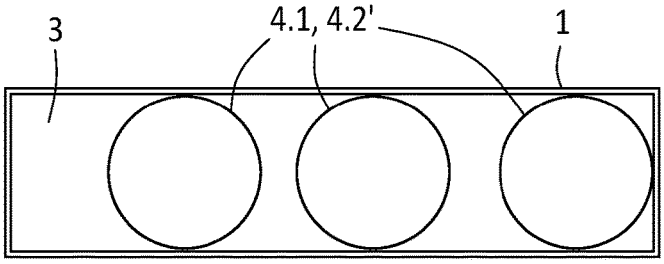
FIGURE 89
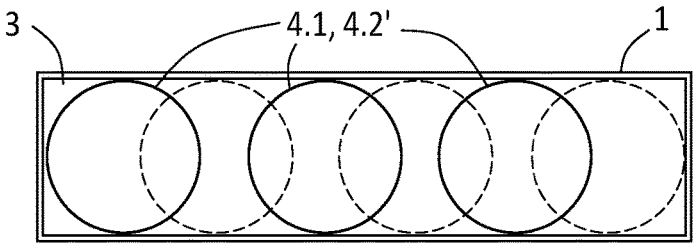
FIGURE 90

101
102
120
121
119

102
120
121
119

3.1
3.2
102.9
102
3
107.1
120
121
119
109

3.2
102.9
102
3
107.1
120
121
119

3.2
102.9
102
3.1
3
120
121
119
107.1
109

102
120
121
119

118
121
120
102
122
119

FIGURE 58
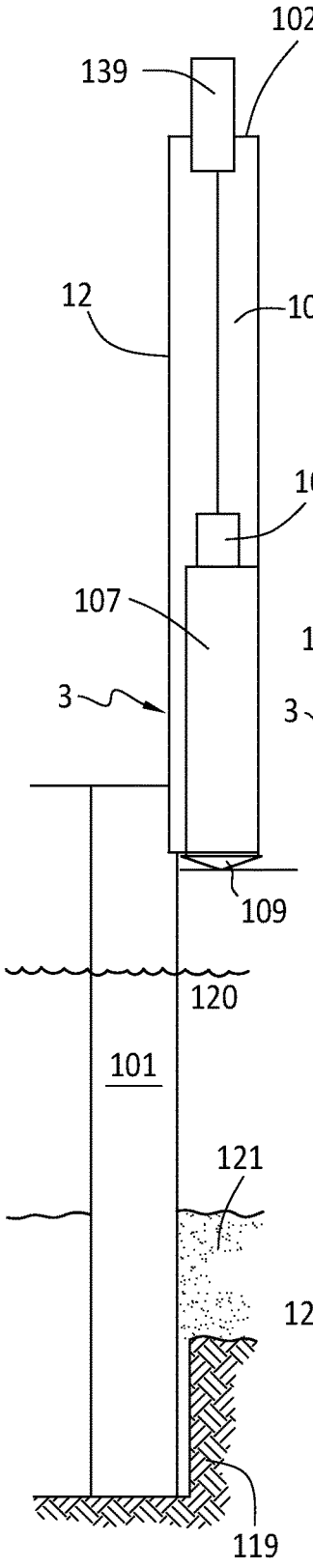
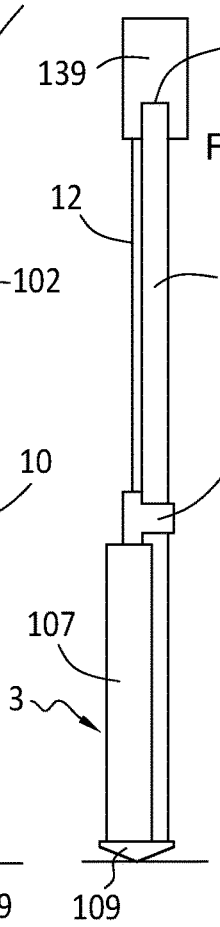
FIGURE 59
FIGURE 60
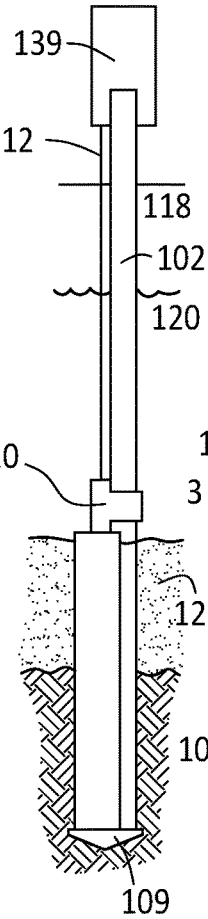
FIGURE 61
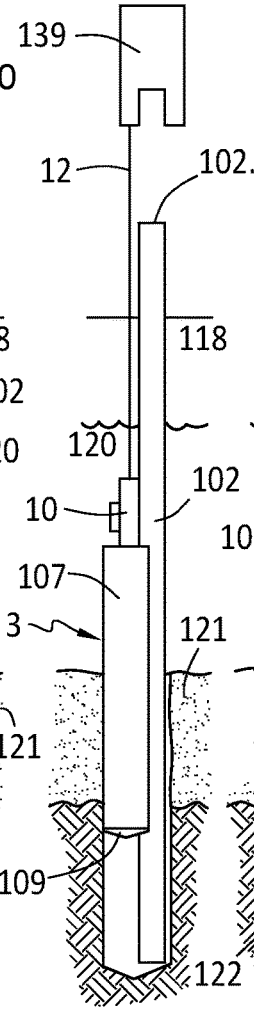
FIGURE 62
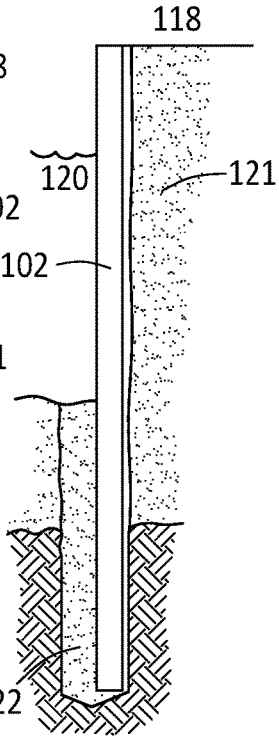

10
3
107
109
120
121
119
122
118
102

1
133
3
133

105
101
108
102

1
3
4.2, 4.2'

1
3
4.2
4.2
4.2
4.2

1
4.2
4.2

1
4.2
4.2

1
3
4.2'
4.2'
4.2'
4.2'

1
4.2'
4.2'
4.2'
4.2'

1
17
17
108

WALL ELEMENT SYSTEM AND METHOD AND APPARATUS FOR CONSTRUCTING SHORING WALLS

I. FIELD OF THE INVENTION

The present invention relates to placement of pile or wall elements to construct shoring walls in difficult ground or ground conditions on land or under water.

II. BACKGROUND OF THE INVENTION

Shoring walls can be constructed using interconnected pile elements of various types. The pile elements can be manufactured from various materials such as steel, stainless steel, aluminium, glass fibre reinforced plastic, other composite materials or precast concrete. Sheet pile comes in a variety of sections with a variety of clutches and is manufactured from various materials, such as steel, stainless steel; aluminium; glass reinforced plastic or polymer, glass fibre reinforced plastic, fibre reinforced plastic or polymer.

Various methods are currently used to construct pile walls, and these methods include pushing, vibrating and hammering pile elements whether sheet or panel or modular wall element into the ground. In hard ground, a mandrel or pre drilling may be required. When using glass fibre reinforced plastic (GFRP) or composite sheet or aluminium sheets this problem is exacerbated. When installing painted metal sheet into hard ground or abrasive ground, by any of the conventional means, such conventional means will damage the integrity of the painted coating.

All of the methods mentioned in the preceding paragraph have their limitations and costs. Noise and vibration can often the major limiting factors.

Any reference herein to known prior art does not, unless the contrary indication appears, constitute an admission that such prior art is commonly known by those skilled in the art to which the invention relates, at the priority date of this application.

For the purpose of this specification and claims:

a: a pile element, when constructed from material other than concrete will be referred to as "the sheet" or "a sheet" each element constructed from concrete will be referred to as 'the panel" or a panel. Additionally a pile element or panel can be an open section retaining wall element, having 3 or 4 sides, and be of plastic or metal, modular or bespoke, which can also serve the function of a formwork system, for example such as that sold under the brand TRULINE SEAWALL.

b: the means of attachment of one sheet or panel to another sheet or panel will be referred to as "the clutch" or "a clutch";

c: an enclosing structure used to place the sheet or panel or wall element will be referred to as "the caisson or casing" or "a caisson or casing";

d: an excavation means or assembly is any means to excavate an area and includes: rotary means such as drilling and/or reaming systems which may be expanding and/or contracting in nature or non-expanding; rotating mechanical lever based systems which may be expanding; swinging arm reaming type systems; or non-rotary means such as jet grouter piling systems which operate on a grout or drilling fluid being pumped under high pressure to fluidize a rock bed. These excavation means can be positioned inside or outside of the caisson or casing or modular wall elements and will sometime be referred to as "the tool" or "a tool"; and e: if drilling and/or reaming means are contained in the tool they will be referred to as "drill bits" or if expandable drill bits are used as "expandable bits" or "reaming elements" or "expandable reaming elements".

By the expression "substantially conforms to" is meant a situation where the drilling and/or reaming whether expandable or not, simply rotate wholly within the footprint of the caisson or casing.

III. SUMMARY OF THE INVENTION

The present invention provides an insertable element, being one of an open section retaining wall element or a formwork element or a caisson or casing for installing a pile element, such as a sheet or panel or a pile wall element or an open section retaining wall element or a formwork element, into a ground or underwater location, the caisson having a shaped wall which is open for a predetermined length, which is adapted to receive and connect to an excavation means within the confines of the caisson or casing.

The shaped wall can have its free sides each having a clutch, and a connection section which closes the insertable element and/or the shaped wall.

The connection section can have a wall portion with a mating clutch to join with the clutches at the wall sides of the shaped wall or the insertable element.

The connection section can be formed from one or more wall portions having clutches on it or them or can also include at least one element clutch or join formation which is adapted to engage another insertable element or sheet or panel or open section retaining wall element or formwork element previously inserted in the ground or underwater location.

The connection section can be a sheet pile, panel, open section retaining wall element or formwork element or is formed and/or shaped as a sheet pile, panel, open section retaining wall element or formwork element so as to function as a sheet pile, panel, open section retaining wall element or formwork element, which is adapted, in use, to be separable from the shaped wall.

The connection section can have at least one clutch, which is adapted to connect to at least one clutch of the shaped wall.

The connection section can have at least one element join formation or clutch which is adapted to engage a previously inserted insertable element, or open section retaining wall element or formwork or panel or sheet or clutch thereof.

The at least one element mating join formation or clutch on the connection section, by being adapted to engage an insertable element or open section retaining wall element or formwork element or panel or sheet or clutch on a one of these previously inserted in the ground or underwater location, can be adapted to act as a guide to guide the insertable element, and an excavation means combined therewith, as excavation occurs.

The at least one element mating join formation or clutch can be adapted to be located outside an excavation footprint of an excavation means combined with the insertable element.

A releasable locking mechanism can interconnect the connection section and the shaped wall or the insertable element.

The locking mechanism can include one of the following: a pin passing through mating clutches on the shaped wall or insertable element and the connections section which can be removed when needed; one of the connection section or the shaped wall or the insertable element includes a flange portion provided to receive a removable pin; a bolt or a wedge or any other mechanical attachment or binding mechanism can be used to lock them together.

The insertable element when combined with an excavation means can be adapted to allow the excavation means to provide an excavation footprint which can overlap an excavation footprint related to the insertable element or a sheet or panel or a pile wall element or an open section retaining wall element or a formwork element previously inserted in the ground or underwater location.

After the insertable element has been positioned in the ground or underwater location, the connection section can be separable from the shaped wall or insertable element.

The shaped wall or insertable element can be adapted so that a sheet or panel or a pile wall element or an open section retaining wall element or a formwork element can be made to engage the clutch or join formation of a previous sheet or panel or a pile wall element or an open section retaining wall element or a formwork element, and pushed or hammered or vibrated into position.

The shaped wall or insertable element can be removeable from the ground or the underwater location, after the sheet pile or panel or open section retaining wall element or formwork element is positioned, the insertable element being a caisson or casing.

The present invention also provides the insertable element as described above in combination with an excavation means.

The excavation means can be a drilling and/or assembly having one or more drilling bits and/or reaming elements which are adapted to be driven by a drilling or rotation motive device, the drilling bits and/or reaming elements can be adapted to be arranged with respect to the insertable element in use, so as form a hole or bore or excavation which substantially conforms to or substantially overlaps with, the shape of the insertable element.

The one or more drilling bits and/or reaming elements can be adapted to be positioned ahead of a leading edge of the insertable element, or are positioned so as to excavate from within the confines of the insertable element.

The drilling bits and/or reaming elements can be one of the following: expanding drilling bits; non-expanding drill bits; expanding reaming elements; non-expanding reaming elements.

The excavation means and/or caisson or casing can allow the excavation means to be withdrawn from the caisson or casing.

The excavation means can have one or more of the following features: when in an expanded condition, engages ground beyond part or all of a leading edge of the insertable element; when in the unexpanded or retracted condition remains inside the insertable element opening or opening footprint; when the excavation means is not an expanding excavation means, it remains inside the insertable element opening or opening footprint.

The drilling bits and/or reaming elements can be rotated by at least one motor located within the insertable element.

The drilling bits and/or reaming elements can be rotated by at least one motor located outside the insertable element.

The drilling bits and/or reaming elements can be rotated by other mechanical means whether individually or in unison.

The excavation means can be mounted for being pulled towards or pushed away from the insertable element.

The excavation means can be provided with a means of flushing by air, liquid, slurry, mud or a combination of any two or more of these or all of these.

Part of the excavation means can be adapted to be positioned ahead of a leading edge of the insertable element.

The excavation means can be adapted to be attached to the insertable element.

The excavation means can be releasably attachable to the insertable element.

The insertable element can be constructed from two or more sections.

The excavation means can substantially close off an opening formed by an inner periphery of the insertable element.

The excavation means can be one or more excavation means are used for the opening.

The excavation means can excavates hard ground or drills and/or reams hard ground, allowing the insertable element to be positioned to a predetermined or required depth.

There can be a spacing or gap between an interior surface of the insertable element and a body of the excavation means.

The spacing or gap can be of the order of 2 to 10 millimeters, or more preferably of the order of 2 mm to 5 mm.

The connection section can be unconnected to excavation means to be associated with the insertable element.

The excavation means to be associated with the insertable element, is connected to or is a releasable part of the shaped wall or insertable element.

The present invention also provides a method of inserting an insertable element being one of an open section retaining wall element or a formwork element or a caisson or casing for installing a pile element, such as a sheet or panel or a pile wall element or an open section retaining wall element or a formwork, or a sheet pile or panel or open section retaining wall element or a formwork system or element of such a formwork system installed via a caisson or casing, the method including: providing an insertable element or a pile element, such as a sheet or panel or a pile wall element or an open section retaining wall element or a formwork, providing an excavation means which is expandable to excavate outside or within the confines of the insertable element and withdrawable from the confines of the insertable element; utilizing an earlier installed insertable element or pile element as an excavation or drilling and/or reaming guide or if the insertable element is open, overlapping the excavation area of the new insertable element or pile element with that of an earlier installed insertable element or pile element.

The method can include use of a connection section to engage the insertable element or the pile element.

The connection section can enable the insertable element or the pile element to be guided by the earlier installed insertable element or the pile element.

The connection section can also act as a sheet pile or panel or open section retaining wall element or formwork element and remains in the ground or underwater location.

The present invention also provides an excavation means for use with an insertable element being one of an open section retaining wall element or a formwork element or a caisson or casing for installing a pile element, such as a sheet or panel or a pile wall element or an open section retaining wall element or a formwork, or a sheet pile or panel or open section retaining wall element or a formwork system or element of such a formwork system installed via a caisson or casing so as to excavate in front of the leading edge of insertable element or the pile element, the excavation means having a body to mount at least one excavation tool so that the at least one excavation tool is spaced from a wall of the insertable element or the pile element, or if multiple tools are present they are spaced from each other so that the outside diameter of the at least one excavation of the tools are spaced from each other.

The excavation means can include a detachable connection to an insertable element or the pile element with which it will be used.

The excavation means can be one of a jet grouter; a drilling tool; a reaming tool; a drilling and/or reaming tool; or drilling and/or reaming tool assembly.

The excavation means can include expandable drilling and/or reaming bits or portions.

The present invention also provides a method of excavation for an insertable element being one of an open section retaining wall element or a formwork element or a caisson or casing for installing a pile element, such as a sheet or panel or a pile wall element or an open section retaining wall element or a formwork, or a sheet pile or panel or open section retaining wall element or a formwork system or element of such a formwork system installed via a caisson or casing, the method including the steps of: providing a an insertable element or pile element; attaching to the insertable element or a pile element an excavation means as described above; advancing the excavation means to excavate ground beneath the excavation means until the insertable element or pile element engages hard ground or is otherwise at a sufficient depth; detaching the excavation means from insertable element or pile element excavating ahead of insertable element or pile element to a predetermined depth; withdrawing the excavation means from insertable element or pile element; repeating as many times as needed to situate the insertable element or pile element until a desired length of shoring wall is achieved.

The present invention also provides an excavation means and an insertable element being one of an open section retaining wall element or a formwork element or a caisson or casing for installing a pile element, such as a sheet or panel or a pile wall element or an open section retaining wall element or a formwork, for insertion into ground, the excavation means being able to excavate inside the opening or opening footprint of the insertable element, the excavation means having a body to mount at least one excavation tool so that overlapping excavations will result.

The excavation means can include a detachable connection to the insertable element.

There can be at least one excavation tool, which in the case of one tool is spaced from an end wall of the insertable element, and in the case of more than one tool are spaced from each other so that the outside diameter of excavation of the tools are spaced from each other so that when the body is rotated through 180 degrees, the excavation that occurs produces an overlapped excavation footprint, so as to provide a mirror reverse excavation footprint.

The excavation means can be one of: a jet grouter; one or more drilling tools; a drilling tool assembly; a drilling and/or reaming tool; or a reaming tool.

The excavation means can includes: only expandable drilling and/or reaming bits; or only non-expanding drill bits; or a combination of expanding and non-expanding where the expanding drill or reaming bits when expanded have the same or a greater outside diameter as the non-expanding drill bits.

The present invention also provides a method of excavating ground, either above or under water, for insertion of an insertable element being one of an open section retaining wall element or a formwork element or a caisson or casing for installing a pile element, such as a sheet or panel or a pile wall element or an open section retaining wall element or a formwork, the method including the steps of: providing an insertable element and an excavation means or assembly as described above; activating the excavation means to excavate ground beneath the excavation means so as to produce an excavation or a series of overlapped excavations outside of or within the opening or opening footprint of the insertable element.

The present invention further provides a drilling and/or reaming assembly for insertion of an insertable element being one of an open section retaining wall element or a formwork element or a caisson or casing for installing a pile element, such as a sheet or panel or a pile wall element or an open section retaining wall element or a formwork, or a sheet pile or panel or open section retaining wall element or a formwork system or element of such a formwork system installed via a caisson or casing, the drilling and/or reaming assembly having one or more drilling and/or reaming bits which are adapted to be driven by a drilling or rotation motive device, the drill and/or reaming bits being adapted to be arranged with respect to the insertable element, so as form a hole or bore into which can be inserted the insertable element.

The drilling and/or reaming bits can be adapted to be positioned ahead of a leading edge of the insertable element.

The drilling and/or reaming bits can be expanding drilling and/or reaming bits.

The expanding drill and/or reaming bits when in a retracted condition, can allow the drilling and/or reaming assembly to be inserted into and/or withdrawn from the insertable element.

The expanding drilling and/or reaming bits, when in an expanded condition, can have ground engaging bits or portions extending beyond part of a leading edge of the insertable element.

The drilling and/or reaming bits can be rotated by a motor located within the insertable element.

The drilling and/or reaming bits can be rotated by motor means located outside the insertable element.

The drilling and/or reaming bits can be rotated by other mechanical means whether individually or in unison.

The drilling and/or reaming assembly can be mounted for being pulled towards or pushed away from the insertable element.

The drilling and/or reaming assembly can be provided with a means of flushing which has one or more of the following features: flushing by air, liquid, slurry, mud or a combination of two or more of these or all of these; is delivered at a pressure of the order of 50 psi to 500 psi; exits the drilling and/or reaming assembly in a horizontal direction from the drilling and/or reaming assembly when it is vertical; exits the drilling and/or reaming assembly at approximately 90 degrees to the longitudinal axis of the drilling and/or reaming assembly.

The one or more drilling and/or reaming bits can be adapted to be positioned ahead of a leading edge of the insertable element.

The drilling and/or reaming assembly can be adapted to be attached to the insertable element.

The drilling and/or reaming assembly can be releasably attachable to the insertable element.

The insertable element does not rotate as it advances downwardly.

The insertable element can have at least one first clutch on one side so as to engage a mating shaped clutch on a previously installed insertable element.

The insertable element can have one of the following: two clutches on one side; or two clutches on one side and two clutches on an opposite side.

The insertable element can be constructed from two or more sections.

The insertable element can be such that the at least one element mating join formation or clutch on the connection section is at least two such element mating join formations or clutches.

The connection section can have at least two element mating join formation or clutches.

The drilling assembly can substantially close off an opening formed by an inner periphery of the insertable element.

Multiple drilling and/or reaming bits or heads can be used for each opening.

The drilling and/or reaming assembly can disturb, plasticize, fluidize, or worry a bed drilled and/or reamed by the drilling and/or reaming assembly, allowing the insertable element to be positioned to a predetermined or required depth.

There can be a spacing or gap between an interior surface of the insertable element and a body of the drilling and/or reaming assembly.

The spacing or gap is of the order of 2 to 10 millimeters but is most preferred to be of the order of 2 mm to 5 mm.

The excavation means can include at least one reaming portion which is formed from a section or length of cable or spring steel or an articulated ground engaging member.

The excavation means can include a flushing passage which discharges in a direction at approximately 90 degrees to the longitudinal axis of the excavation means or the axis of rotation of the excavation means.

The excavation means can include a flushing fluid system or drilling fluid system which operates to pump drilling fluid from the excavation means or a portion there of, at a pressure of the order of 50 psi to 500 psi.

The excavation means can include a shaped body or shaped guides which locate the excavation means to excavate relative to or along a pre-determined axis, which axis is located at an off-centre location relative to the footprint of the caisson or casing or open section retaining wall element or element of a formwork system.

The off-centre location can provide the extremities of a locus or rotation envelope or excavation which clear the clutches of a previously installed caisson or casing or open section retaining wall element or element of a formwork system, and which locus or rotation envelope or excavation extends past the forward or opposite side clutches of the caisson or casing or open section retaining wall element or element of a formwork system being installed.

The excavation means can include a segmented construction allowing the assembly to be increased or decreased in length to suit different lengths of the caisson or casing or open section retaining wall element or element of a formwork system being installed.

The excavation means can be one of: a jet grouting tool; a drilling tool; a reaming tool; a drilling and reaming tool.

The present invention also provides a method of inserting a caisson or casing or open section retaining wall element or element of a formwork system into a friable terrain, the method including the steps of: arranging a drilling and/or reaming assembly as described above, with respect to a caisson or casing or open section retaining wall element or element of a formwork system; positioning the drilling assembly and the caisson or casing or open section retaining wall element or element of a formwork system over a location for insertion of the caisson or casing or open section retaining wall element or element of a formwork system; operating the drilling assembly from another location, until the caisson or casing or open section retaining wall element or element of a formwork system has been situated as desired.

The method can also include the steps of: retracting the expanding bits and/or reamers, and withdrawing the drilling and/or assembly from the caisson or casing or open section retaining wall element or element of a formwork system.

The method can also include the step of inserting or forming a structural element into the caisson or casing or open section retaining wall element or element of a formwork system.

The method can include the step of withdrawing the caisson or casing or open section retaining wall element or element of a formwork system.

The structural element can include a through aperture via which grout is received to grout the structural element.

The method can further include the step of separately drilling or reaming a hole into a hard ground at a position which corresponds with the through aperture.

The through aperture can be adapted to receive a reinforcing dowel.

The method can include the step of repeating the method to insert further structural elements.

The method can further include grouting spaces between adjacent structural elements.

The lateral vertical sides of the structural elements can be shaped so that the grout between adjacent structural elements forms a grout key.

A stocking made from canvas, plastic, any appropriate nylon, or geo-fabric can be placed over a grout line used to grout spaces between adjacent structural elements.

The method can further include the step of securing a capping beam to the structural element or casting in situ a capping beam.

The capping beam and structural element can be bolted or screwed together.

The capping beam can include one or more inserted or pre-cast reinforcement bars, each to be inserted into a corresponding aperture in the structural element; or the structural element includes one or more inserted or pre-cast reinforcement bars, whereby each reinforcement bar is received by a corresponding aperture in the capping beam; or the structural element includes one or more inserted or pre-cast reinforcement elements, and the capping beam is cast onto the structural element and around the reinforcement elements.

The method can include securing an anchoring tie in the capping beam.

The method can include the step of attaching a subsequent caisson or casing or open section retaining wall element or element of a formwork system to the caisson or casing or open section retaining wall element or element of a formwork system.

The present invention also provides a retaining wall element for use in controlling land erosion in contact with water which comprises: self-supporting polymeric or metal construction, each having a vertical longitudinal interior channel disposed therein enclosed by at least three sides; each of the elements having a pair of opposed faces to which are connected one or more fastening means; each of the elements connected by mating engagement of the at least one fastening means on one first element with at least one fastening means on the at least one second element, the fastening means being an engageable clutch or J-shaped hook; characterized in that at least one of the elements includes in or on at least one of a front wall and/or rear wall, an elongated fastening means allowing the at least one element to connect to the ends of a wall or walls of a casing or caisson and/or an excavation means, which will be used to excavate and/or keep clear a volume in which the element or elements will be installed in an underwater location.

The fastening means on the front and/or the rear wall can be an externally arranged engageable clutch or J-shaped hook. Alternatively, the fastening means on the front and/or the rear wall is an internally arranged engageable clutch or groove able to receive a J-shaped hook.

The wall element can further comprise at least one end cap having a fastening means to attach to the element.

The wall element can be constructed by its wall formation shape and/or thickness to function as a structural wall when it is in an open and/or hollow condition.

The wall element can be initially open and/or hollow and when joined and assembled with like or similar elements, is then used as an in-situ formwork and subsequently filled with concrete, cement or grout, or filled with gravel to form a finished structural wall construction.

The present invention additionally utilises the technology described in Australian patent applications 2016100200, 2016203790 and international application PCT/AU2016/051201, and the text and drawings of these applications are incorporated herein.

IV. BRIEF DESCRIPTION OF THE DRAWINGS

A detailed description of a preferred embodiment will follow, by way of example only, with reference to the accompanying drawings, in which:

FIG. 1.1 is a side elevational view of a caisson/casing and drilling assembly with the drill bits in a retracted condition;

FIG. 1.2 is a front elevational view of the apparatus of FIG. 1.1;

FIG. 1.3 is a plan view of the apparatus of FIG. 1.1;

FIG. 2.1 is a side elevational view of a caisson/casing and drilling assembly with the drill bits in an extended or expanded condition, showing how a substantial portion of the periphery of the caisson/casing is overlapped by the drill bits;

FIG. 2.2 is a front elevational view of the apparatus of FIG. 2.1;

FIG. 2.3 is a plan view of the apparatus of FIG. 2.1;

FIG. 3.1 is a side elevational view of a caisson/casing and drilling assembly with the drill bits in an extended or expanded condition with the middle bit lower than the outer bits and the whole of the periphery is overlapped by the footprint of the drill bits in extended or expanded condition;

FIG. 3.2 is a front elevational view of the apparatus of FIG. 3.1;

FIG. 3.3 is a plan view of the apparatus of FIG. 3.1;

FIG. 4.1 is a side elevational view of a caisson/casing and drilling assembly with the drill bits in an extended or expanded condition, similar to FIGS. 3.1 to 3.3, with the middle bit being at same height as the outer bits, but 90 degrees out of phase, and the whole of the periphery is overlapped by the footprint of the drill bits in extended or expanded condition;

FIG. 4.2 is a front elevational view of the apparatus of FIG. 4.1;

FIG. 4.3 is a plan view of the apparatus of FIG. 4.1;

Figure 9:
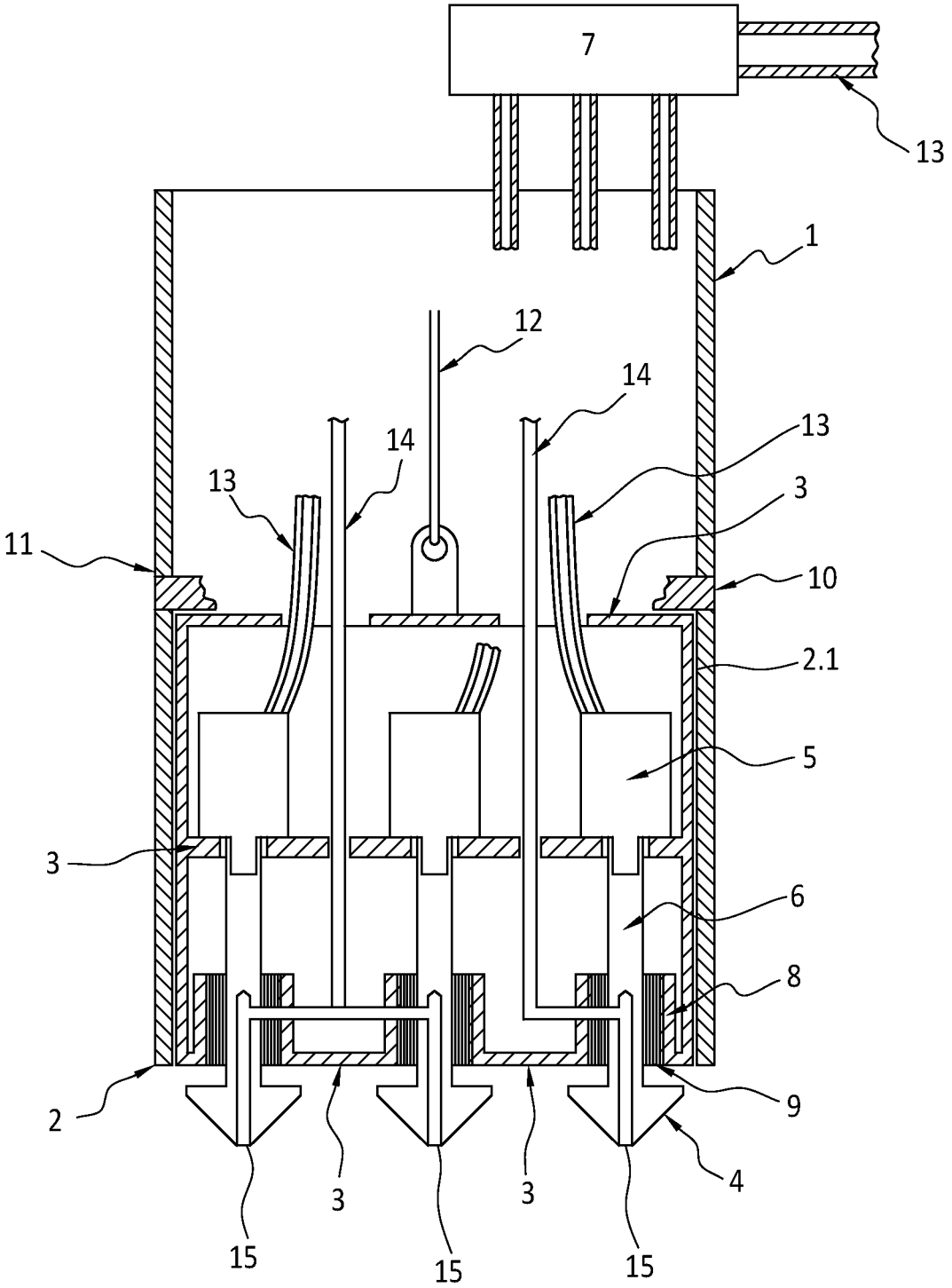
Figure 11:
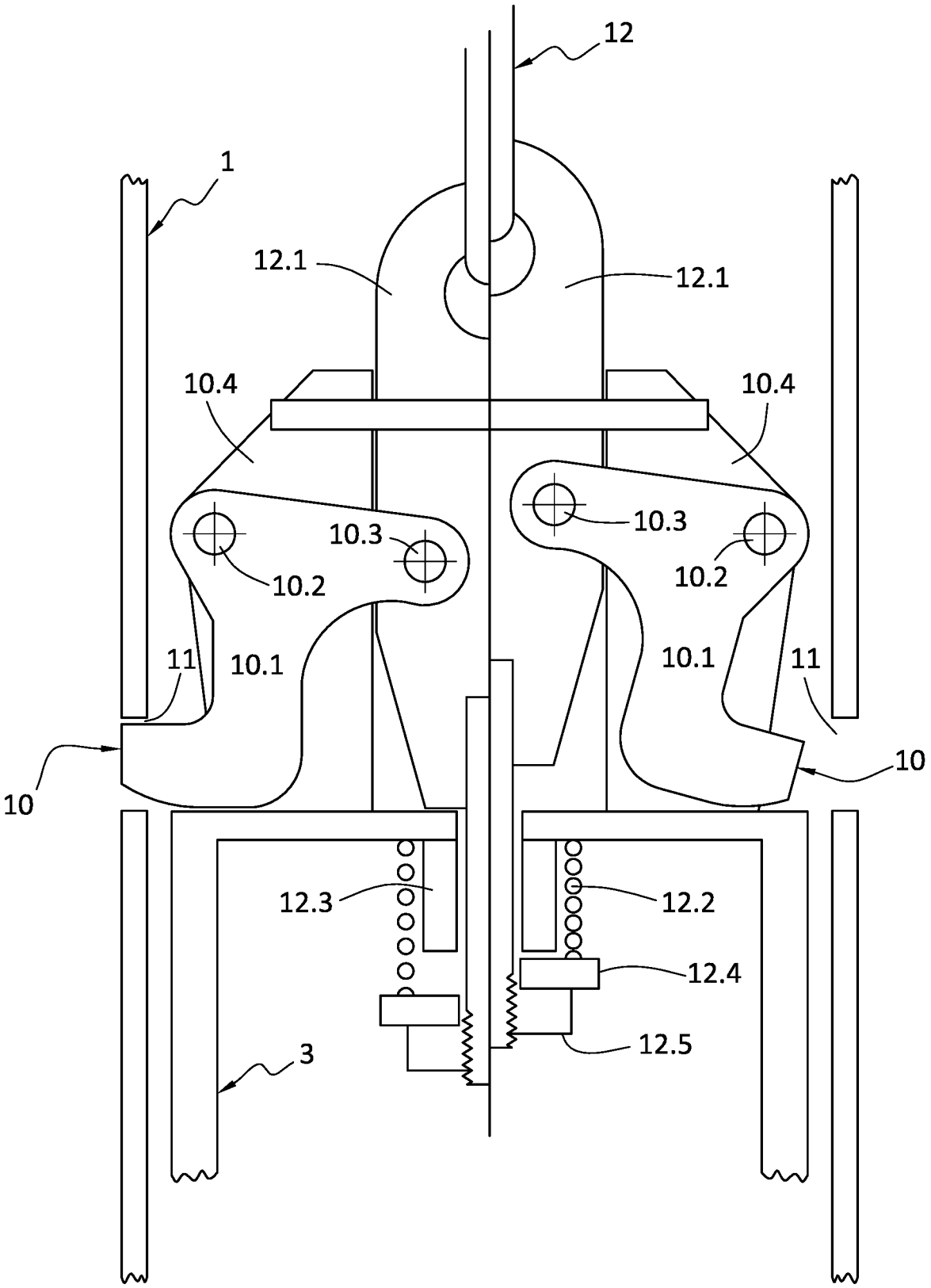
Figure 12:
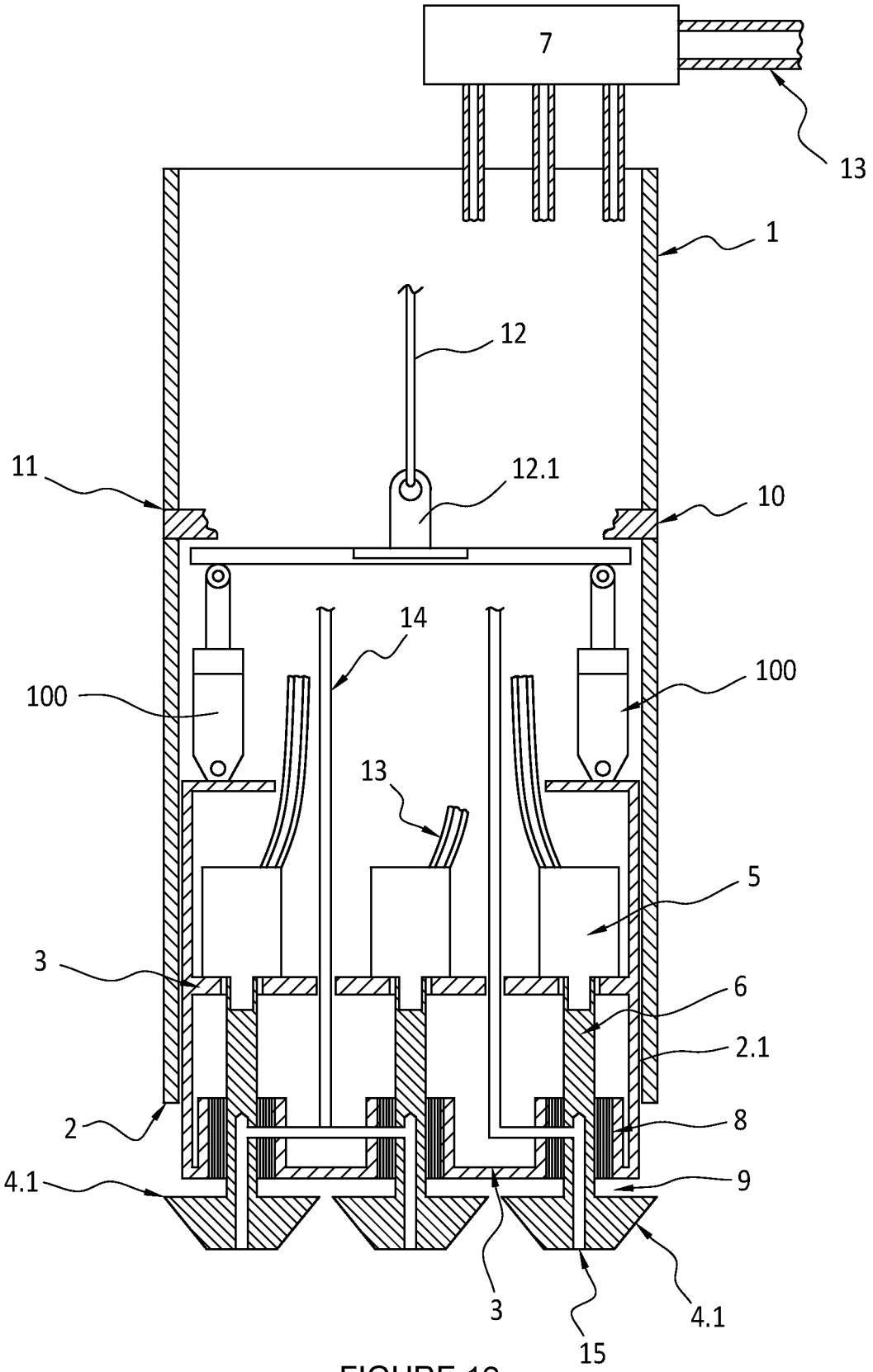
Figure 21:
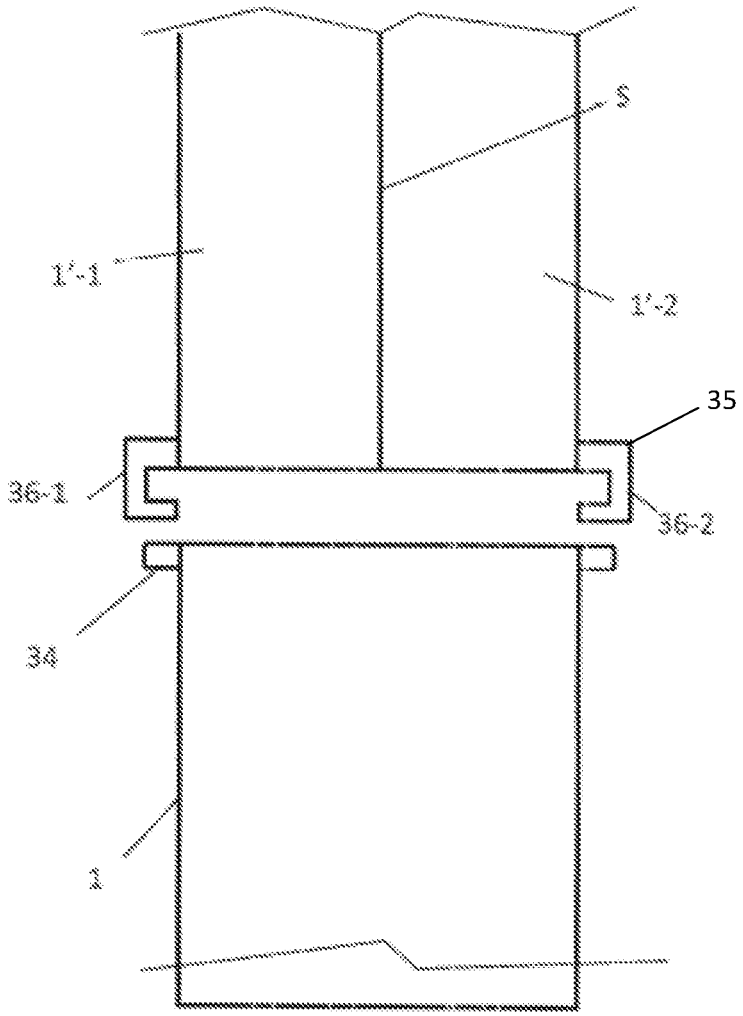
Figure 22:
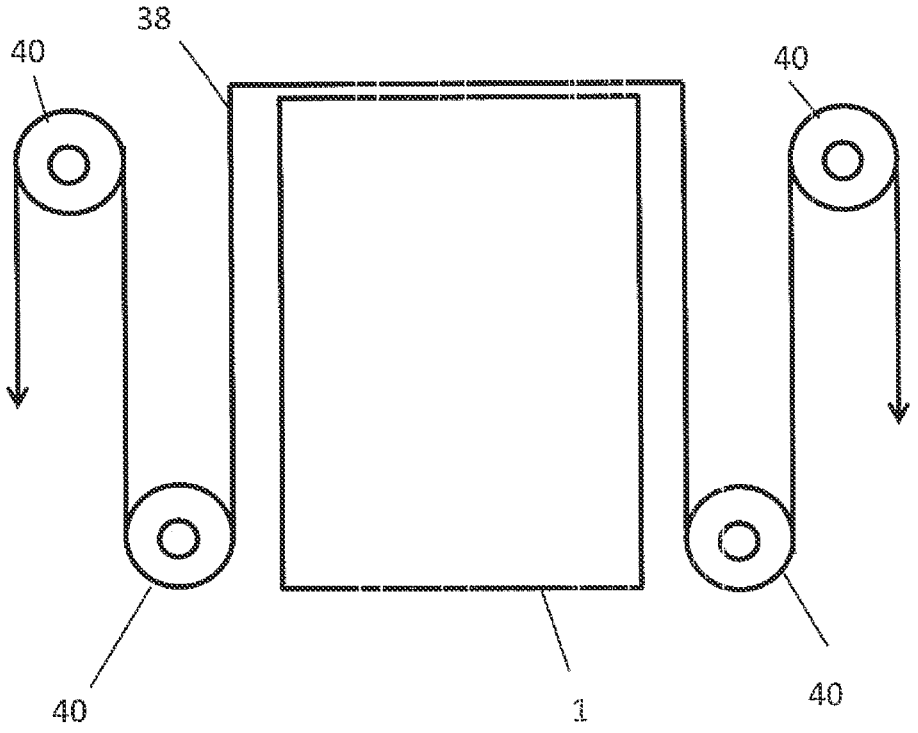

FIG. 8.1 illustrates a side elevational view of a caisson/casing and drilling assembly with two drill bits, both in an extended or expanded condition;

FIG. 8.2 illustrates a plan view of the caisson/casing shown in FIG. 9.1, where the caisson/casing is generally shaped like the number "8";

FIG. 8.3 illustrates a front or rear elevational view of the caisson/casing and drilling assembly shown in FIG. 8.1;

FIG. 8.4 illustrates a plan view of an embodiment similar to that of FIG. 2.3, 5, 6, or 7 where the caisson/casing has the shape shown in FIG. 8.2;

FIG. 9 illustrates a vertical cross section through the embodiment of FIGS. 1.1 to 2.3 showing the assembly of a caisson/casing and a drilling assembly with expanding drill bits which are driven by hydraulic motors;

FIGS. 10.1-10.12 are examples of two drill bits and their specifications are provided in FIG. 10.13 which drill bits can be utilized with the embodiments of the invention;

FIG. 11 illustrates a dual section view of the drilling assembly and its disengagement and retraction mechanism;

FIG. 12 illustrates a schematic view similar to FIG. 9, except that intervening the between the lifting assembly and latches is a hydraulic ram system to push the drilling assembly downward relative to the caisson or casing;

FIG. 13.1 is a front or rear view of a plurality of structural panels, drilling assembly, and grout between the panels;

FIG. 13.2 is plan view of the panels of the apparatus of FIG. 13.1;

FIG. 13.3 is a cross section through line 1-1 of FIG. 13.2;

FIG. 14.1 is a schematic front view of a plurality of structural panels showing toe grouting of some of the panels;

FIG. 14.2 is a schematic plan view of FIG. 14.1;

FIG. 14.3 is a cross section through line 2-2 of FIG. 14.1;

FIG. 15.1 is a schematic cross-sectional view of a plurality of structural panels being attached to rock or hard ground;

FIG. 15.2 is a plan view of FIG. 15.1;

FIG. 15.3 is a cross section through line 3-3 of FIG. 15.2;

FIG. 16.1 is a schematic cross-sectional view of a plurality of structural panels and a capping beam attached to some of the panels;

FIG. 16.2 is a schematic plan view of FIG. 16.1;

FIG. 16.3 is a cross section taken through line 4-4 of FIG. 16.2;

FIG. 16.4 depicts an alternative embodiment for attaching dowels and a pre-cast capping beam to a panel;

FIG. 16.5 depicts an alternative embodiment for a capping beam to a panel;

FIG. 16.6 depicts another alternative embodiment for attaching the capping beam to a panel;

FIG. 17.1 is a front view of two caissons in situ, one of which showing reinforcement bars;

FIG. 17.2 is a plan view of FIG. 17.1, schematically showing concrete poured into the caisson as formwork;

FIGS. 18.1 and 18.2 are schematics depicting a capping beam with land anchors or ties attached;

FIG. 19.1 is a schematic depicting the initial positions of a drilling assembly and a caisson on a friable bed, preferably under water;

FIG. 19.2 is a schematic depicting the movement of plasticised or disturbed bed matter;

FIG. 19.3 is a schematic depicting the upward movement and accumulation of plasticised bed matter as the caisson sinks;

FIG. 19.4 is a schematic depicting the downward movement of plasticised bed matter once the caisson is removed;

FIGS. 20.1 to 20.8 are cross sections showing the method where by a caisson inserted into a hole formed by the drill assembly, and a second caisson is attached and inserted into the hole;

FIG. 21 is a schematic view of a caisson which can be vertically attached to another caisson;

FIG. 22 is a schematic view of a caisson which can be lowered by the application of pulling forces.

Figure 23:
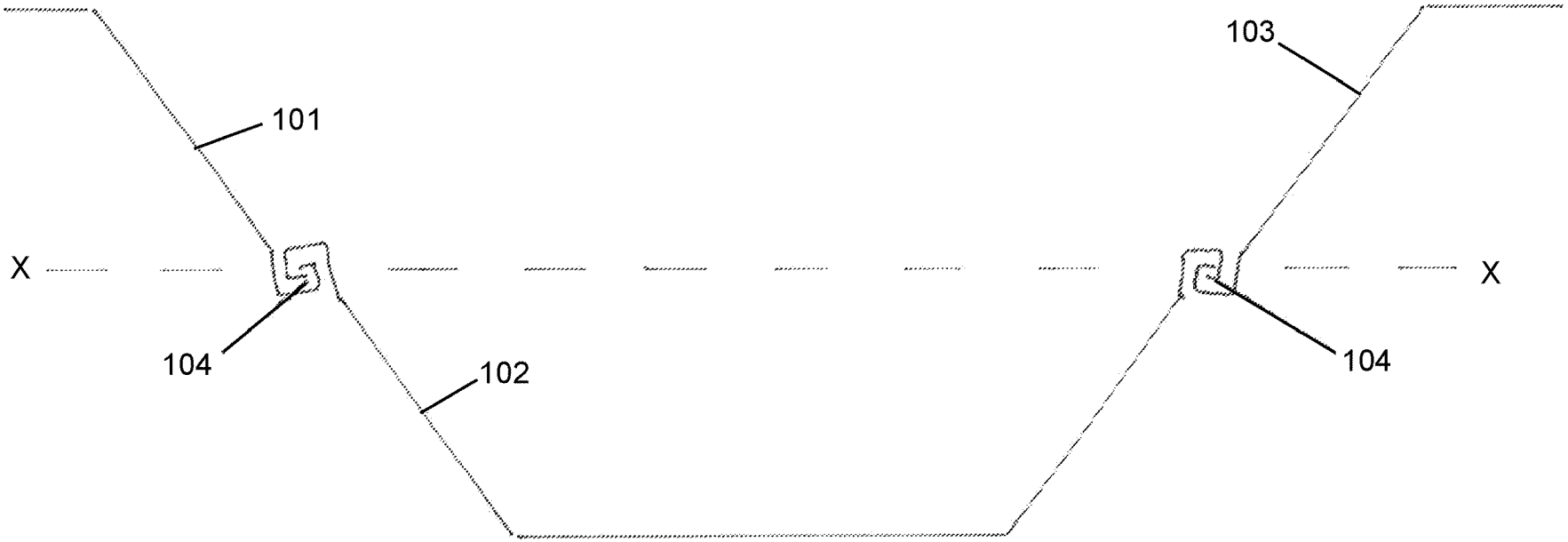
Figures 24, 24A:
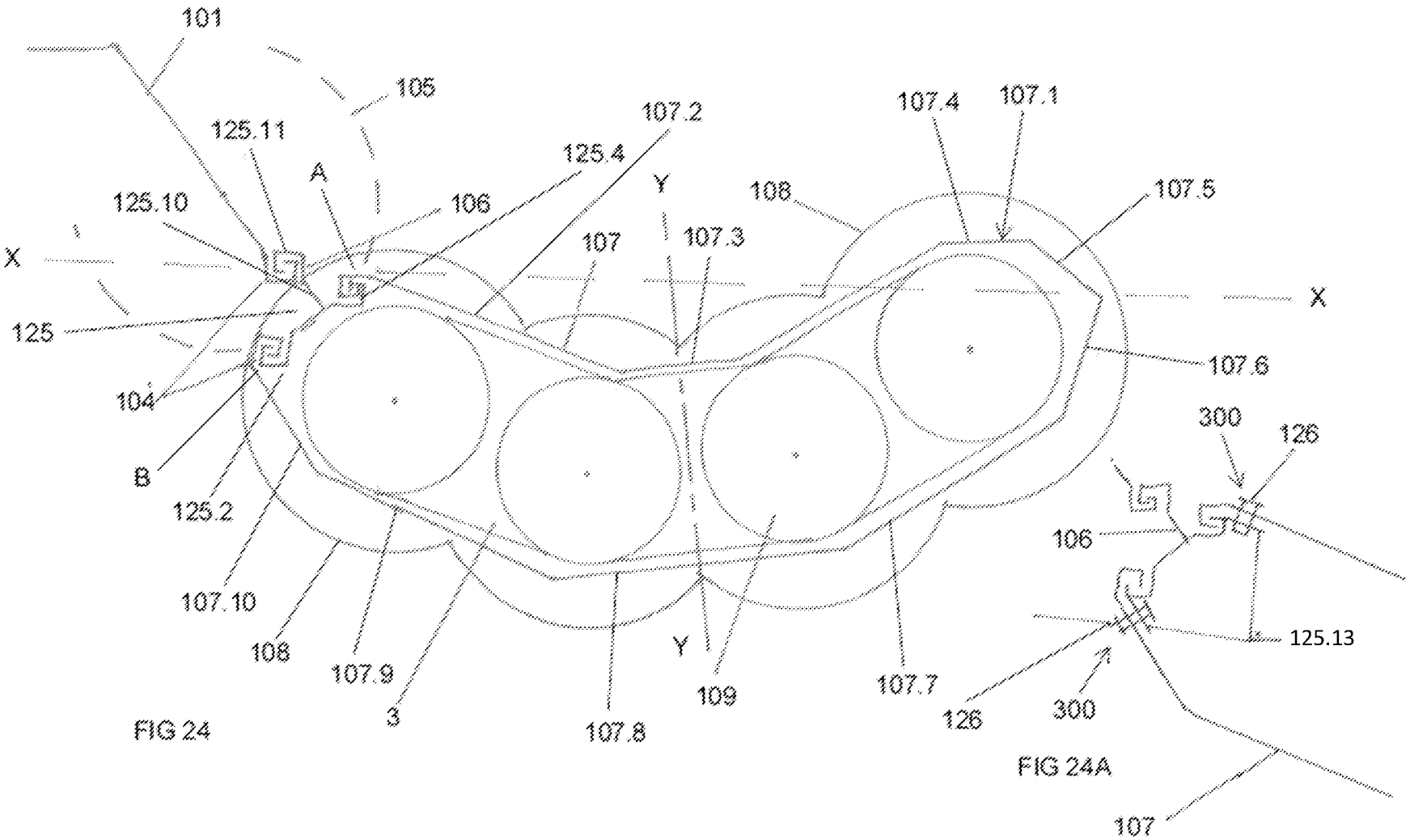
Figure 25:
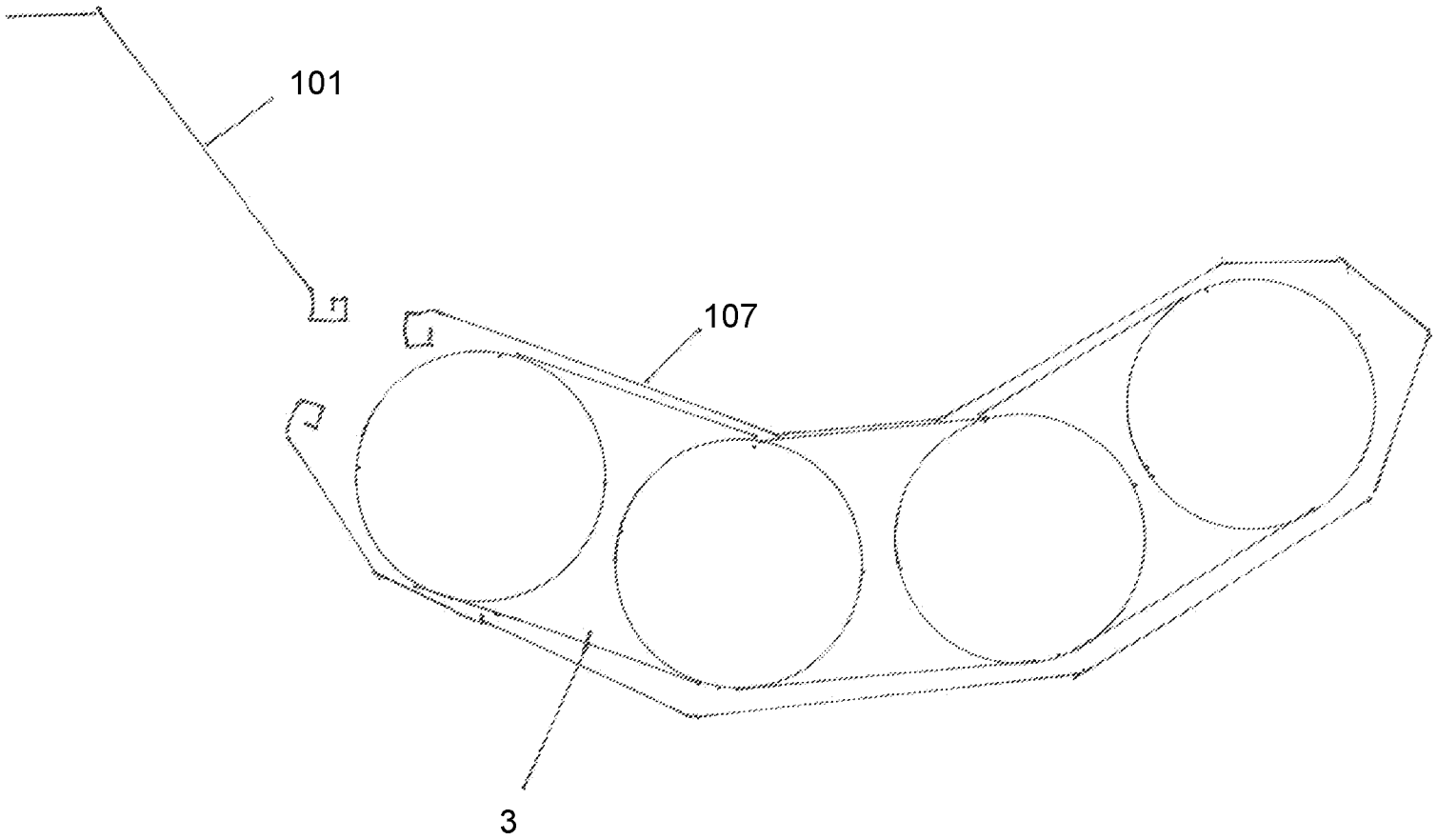
Figure 26:
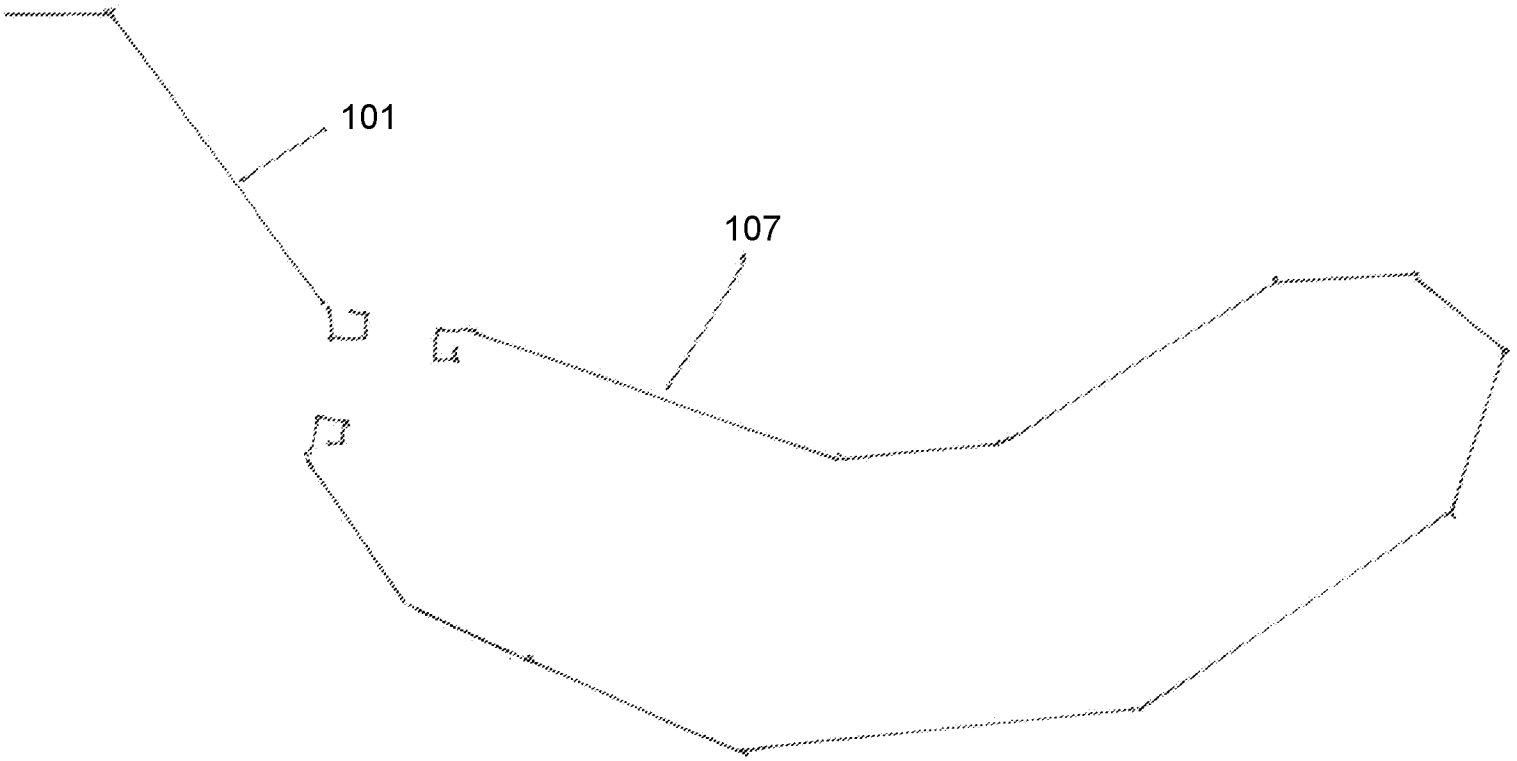
Figure 27:
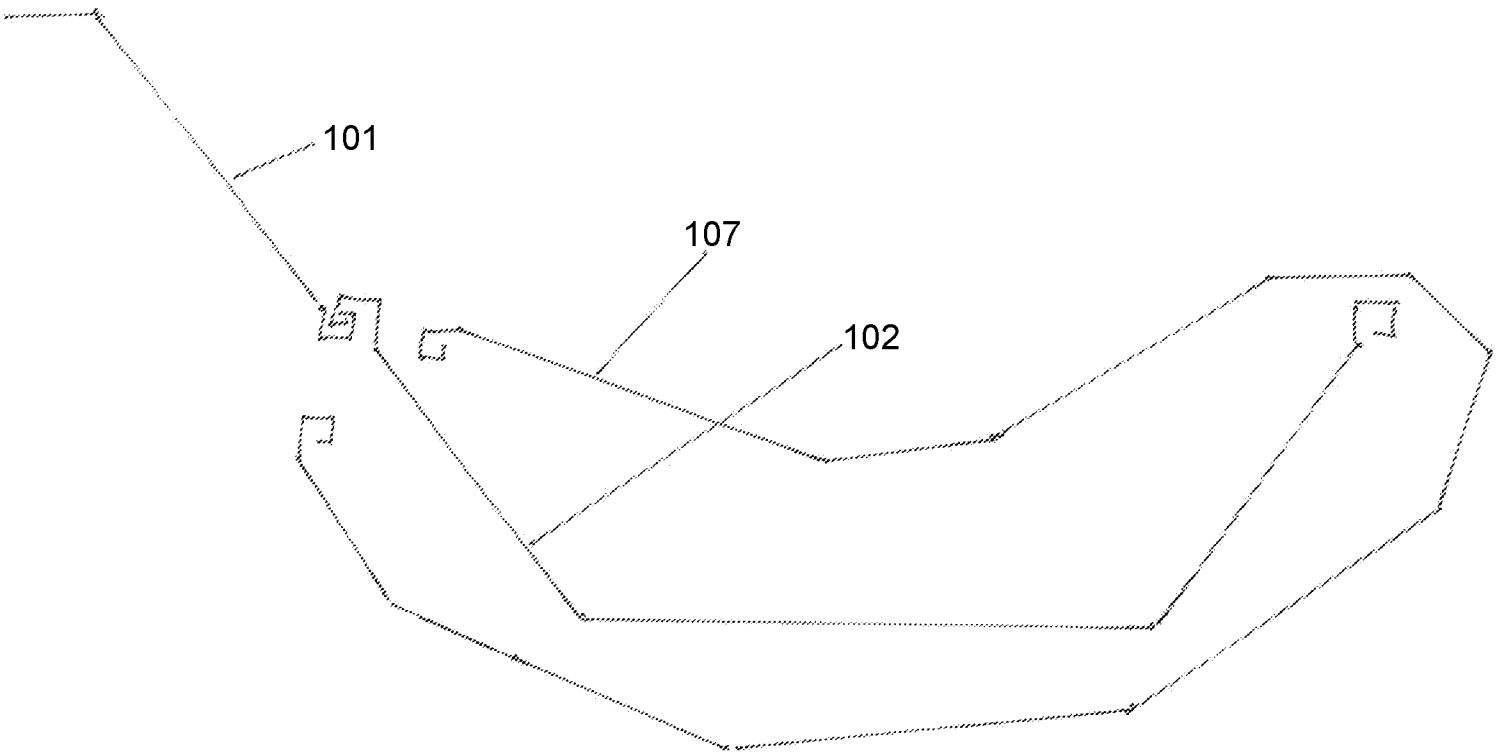
Figure 28:
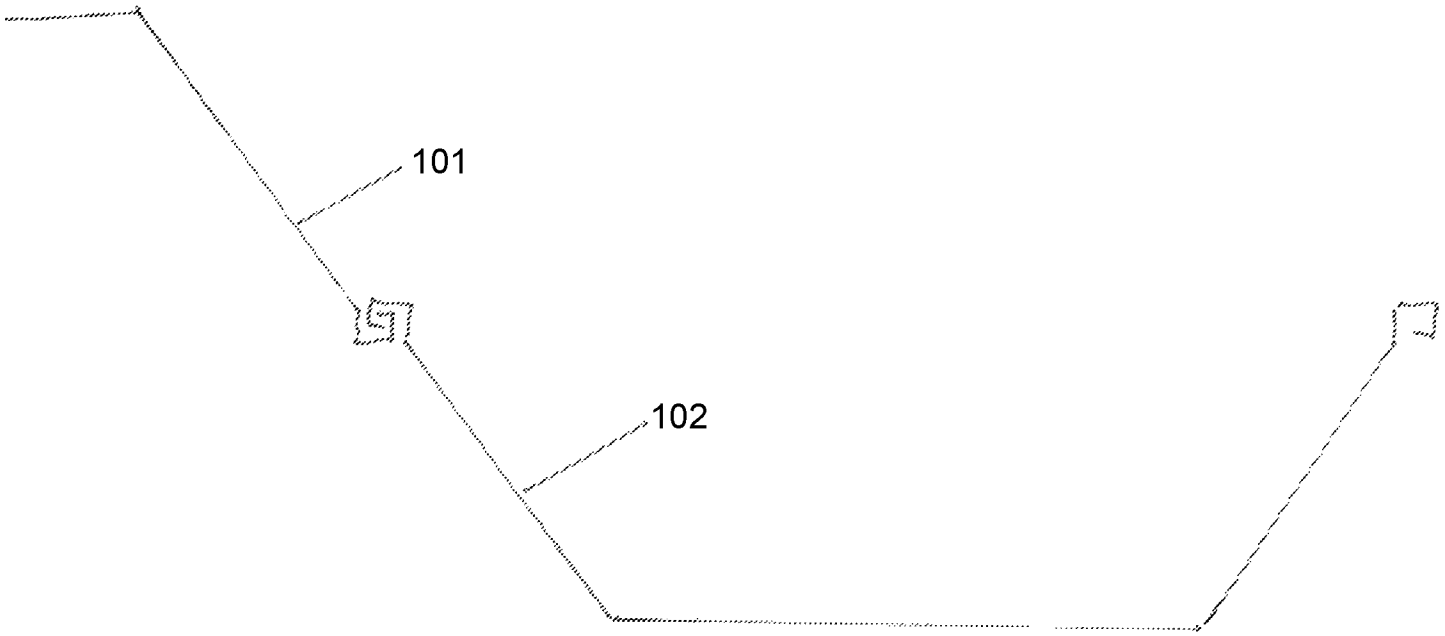
Figure 29:
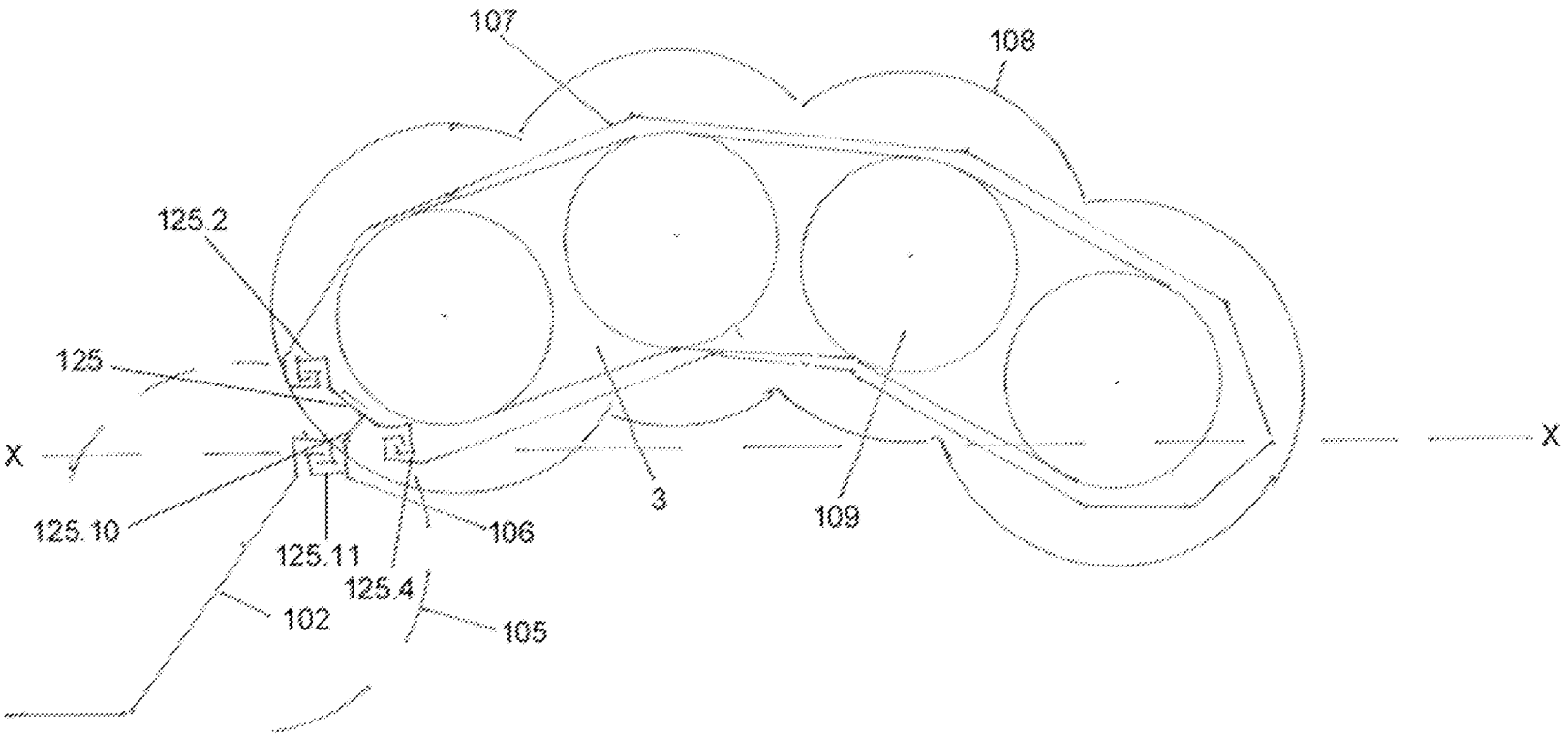
Figures 30, 30A:
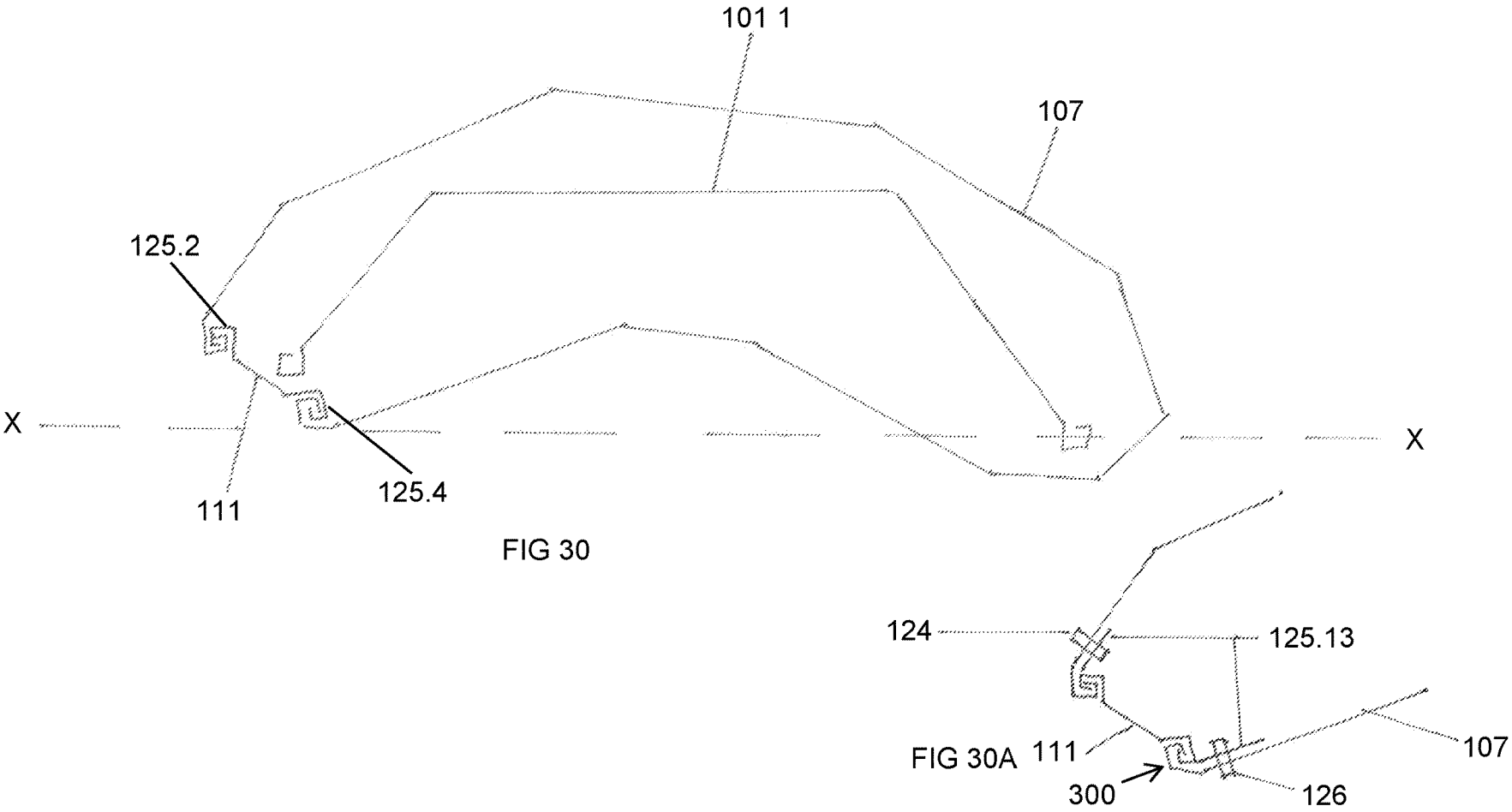
Figure 31:
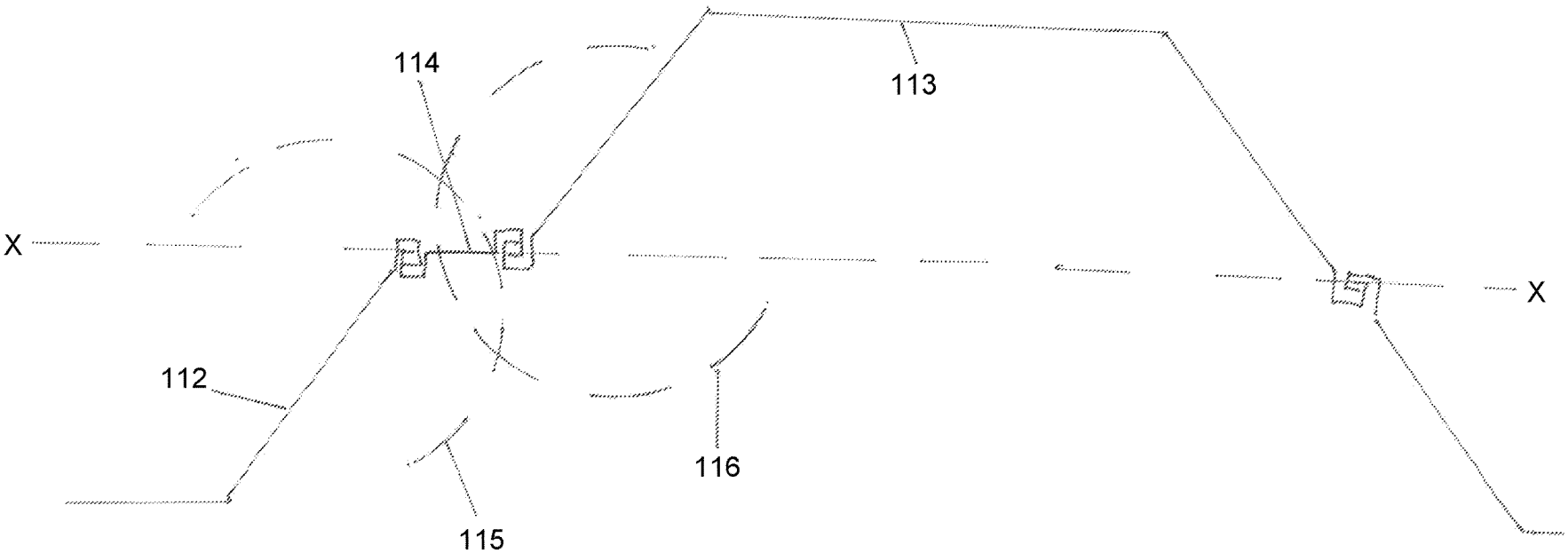
Figure 32:
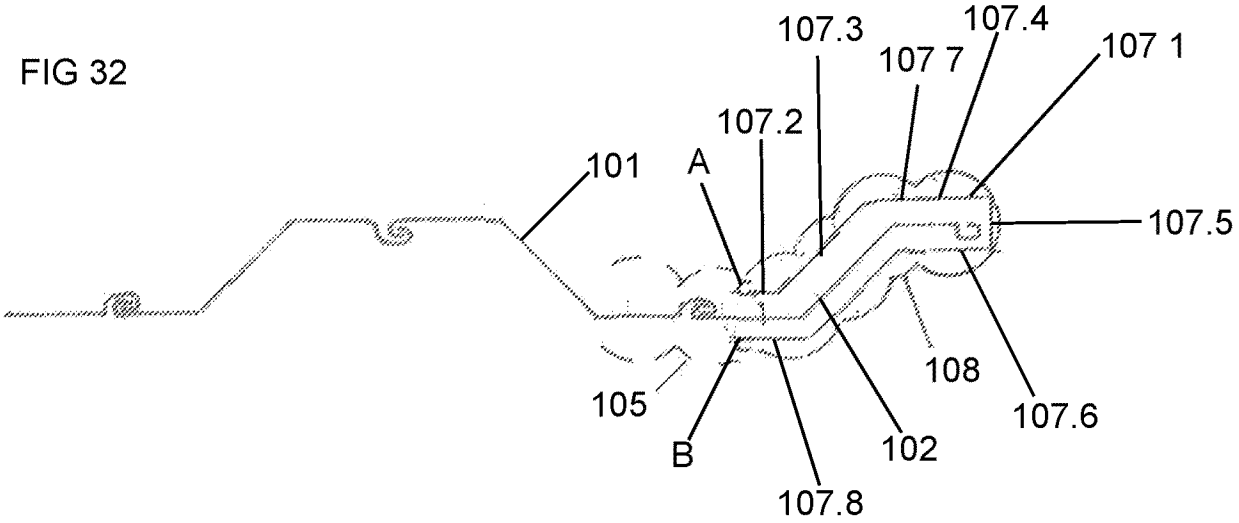
Figure 34:
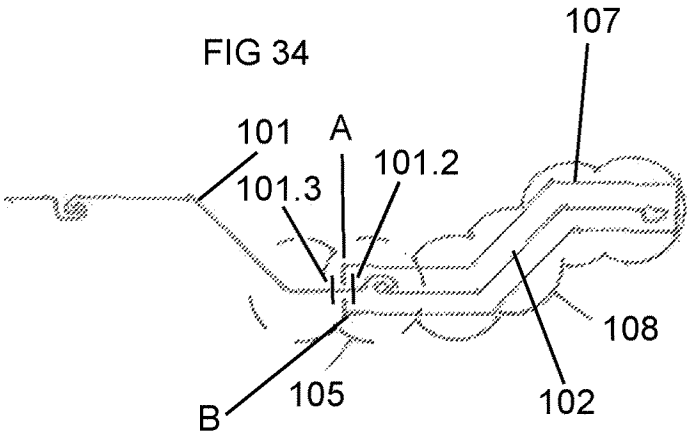
Figure 33:
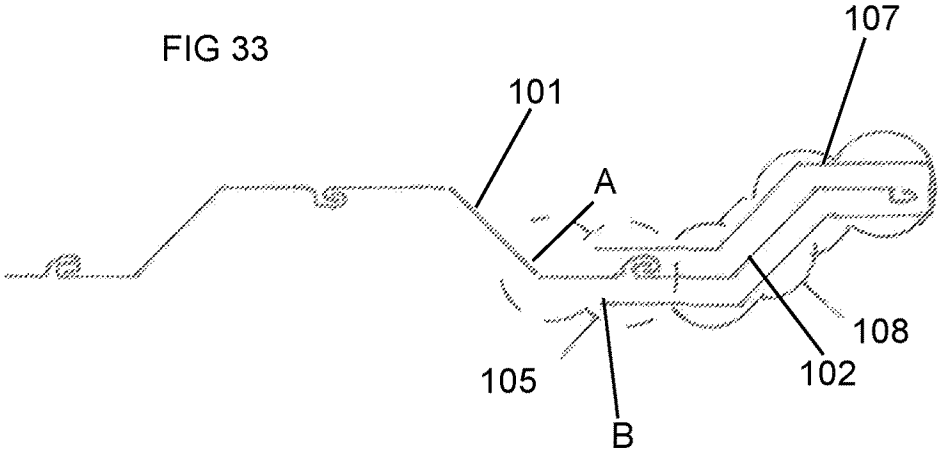
Figure 37:
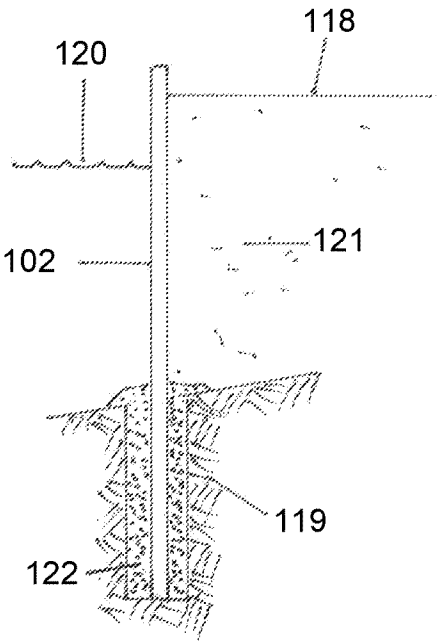
Figure 36:
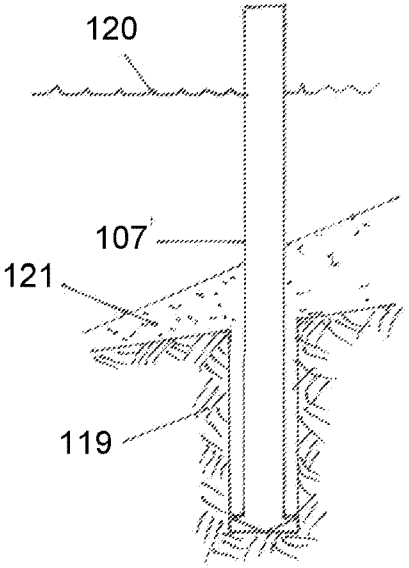
Figure 35:
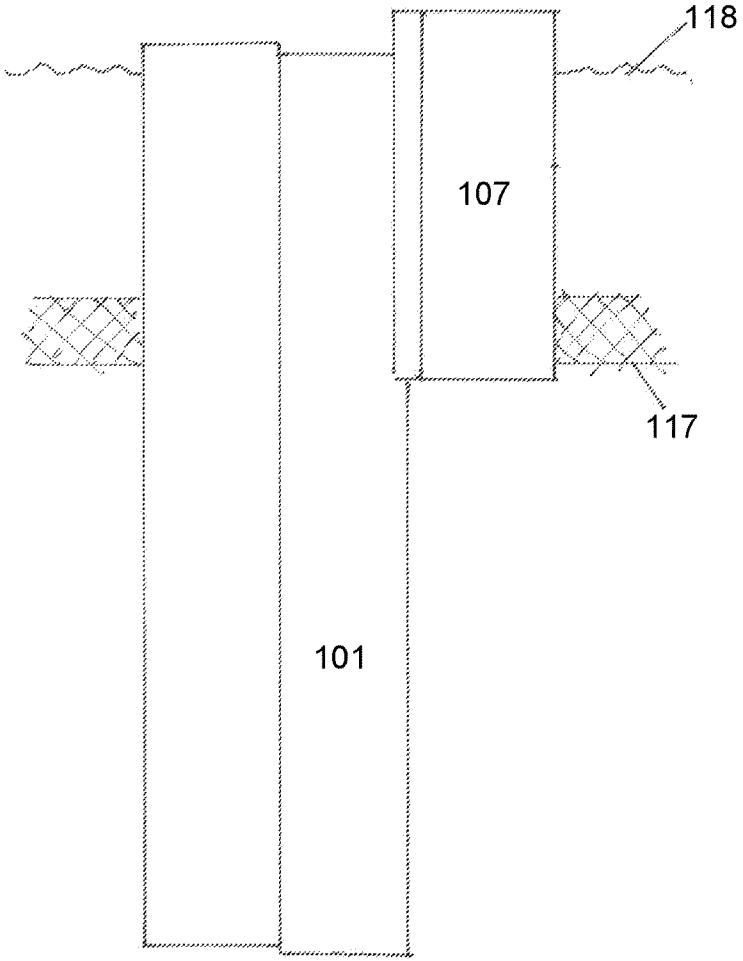

FIG. 23 is a schematic plan view of three sheets of a Larsson type 755 sheet pile wall showing the form and nature of the clutch;

FIG. 24 is a schematic plan view of a caisson and drilling tool attached to a first section of sheet pile already positioned;

FIG. 24A is a schematic plan view of a pin or linkage system to releasably connect the caisson and connections section of FIG. 24;

FIG. 25 is a schematic plan view of the caisson and tool of FIG. 24 with the connection section removed and the expandable bits contracted;

FIG. 26 is a schematic plan view of the caisson of FIG. 25 with the tool removed;

FIG. 27 is a schematic plan view of the caisson of FIG. 26 with the second sheet attached to the first;

FIG. 28 is a schematic plan view of the first and second sheets of FIG. 26 with the caisson removed;

FIG. 29 is a schematic plan view of a caisson and drilling tool attached to the second sheet of FIG. 28;

FIG. 30 is a schematic plan view of the caisson and a first sheet;

FIG. 30A is a schematic plan view of a pin or linkage system to releasably connect the caisson and connections section of FIG. 30;

FIG. 31 is a schematic plan view of two sheets connected by a cut to size bespoke joining sheet;

FIG. 32 is a schematic plan view of a first shape of caisson;

FIG. 33 is a schematic plan view of a second shape of caisson;

FIG. 34 is a schematic plan view of a third shape of caisson;

FIG. 35 is a schematic front elevation of a sheet pile wall;

FIG. 36 is an end elevation of a caisson constructing a sheet pile wall;

FIG. 37 is an end elevation of a sheet pile wall.

Figures 38, 39, 40:
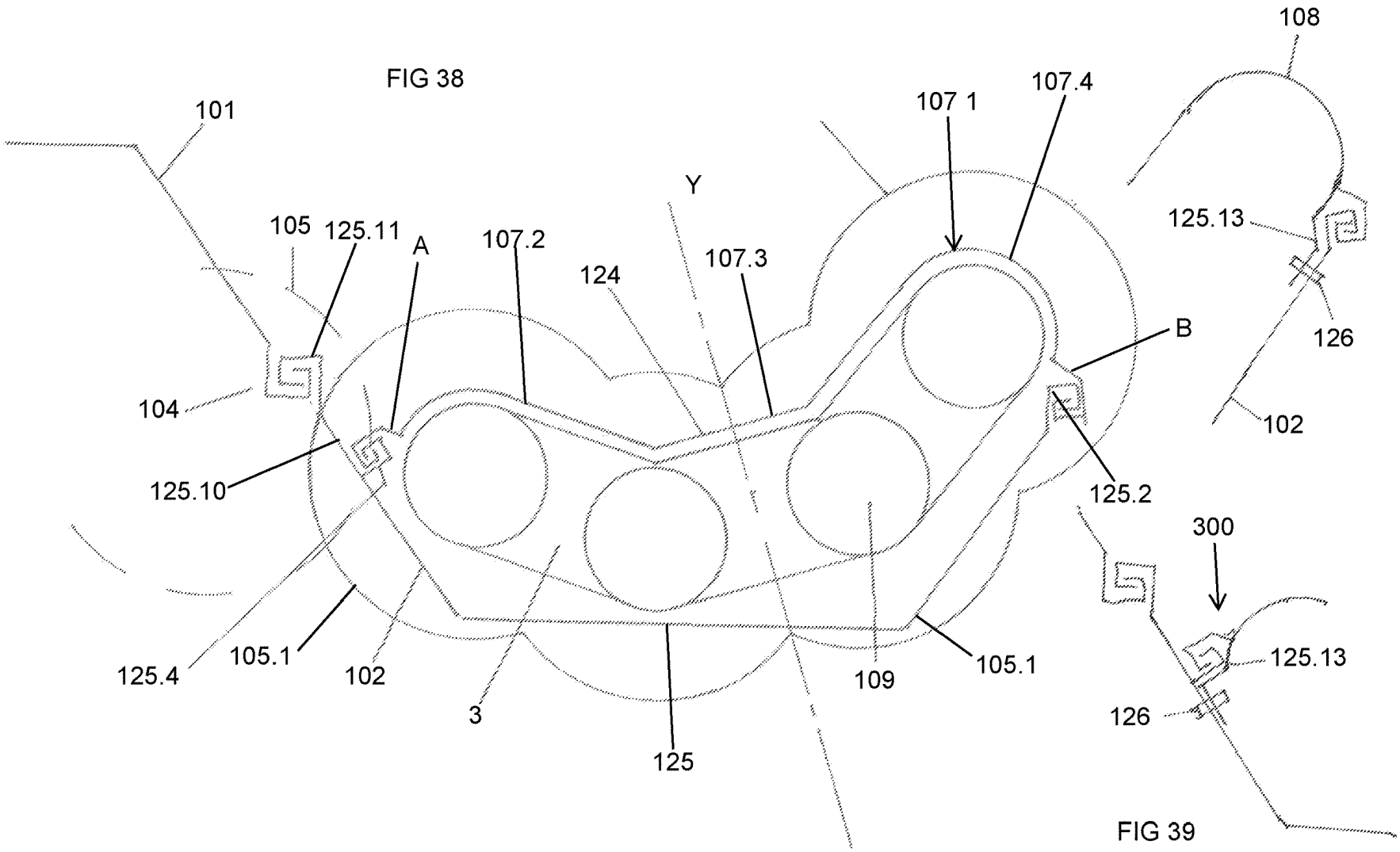
Figure 41:
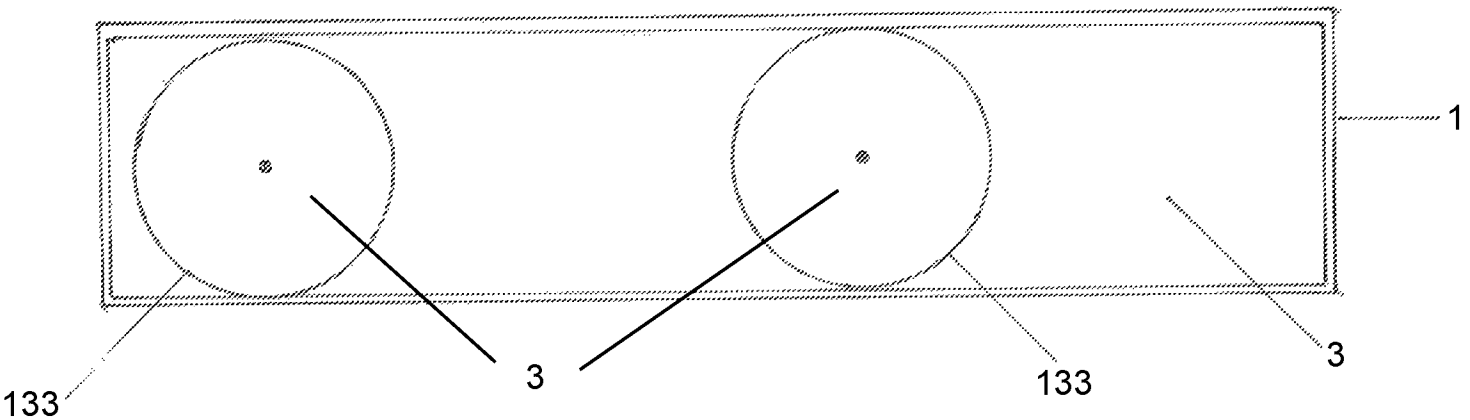
Figure 42:
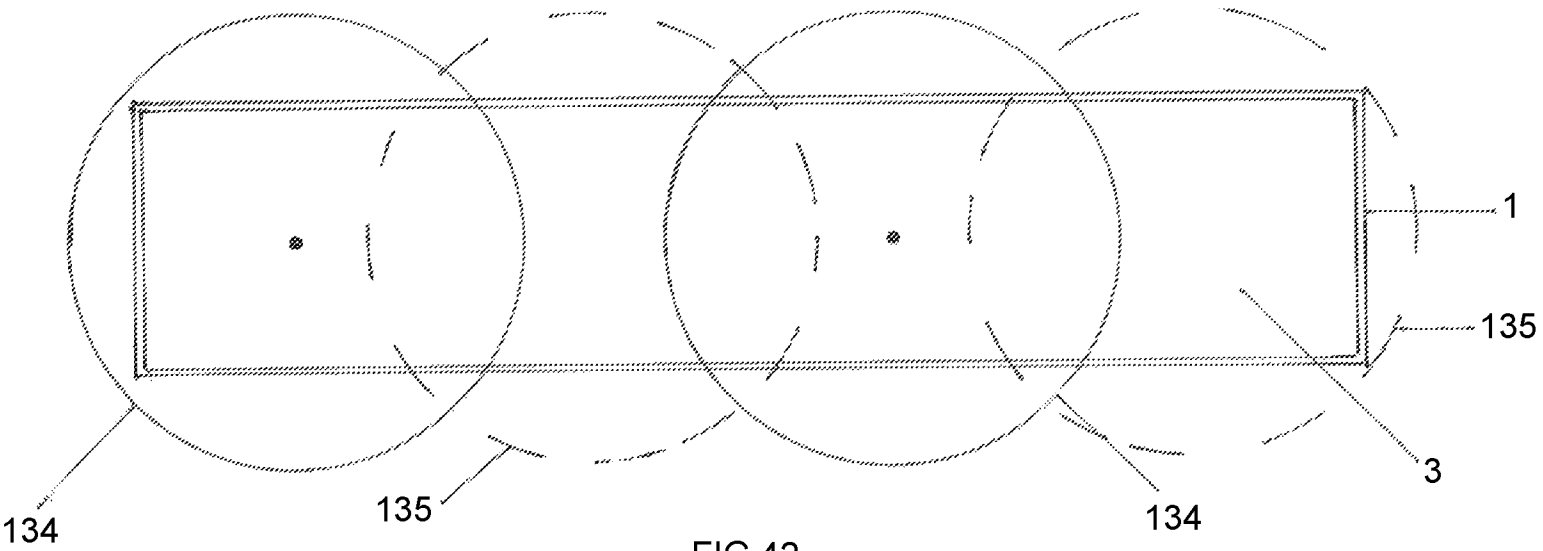
Figure 49:
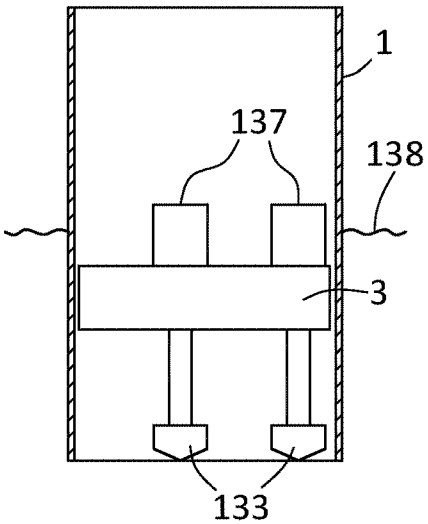
Figure 50:
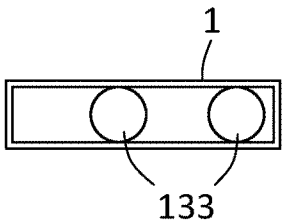
Figure 47:
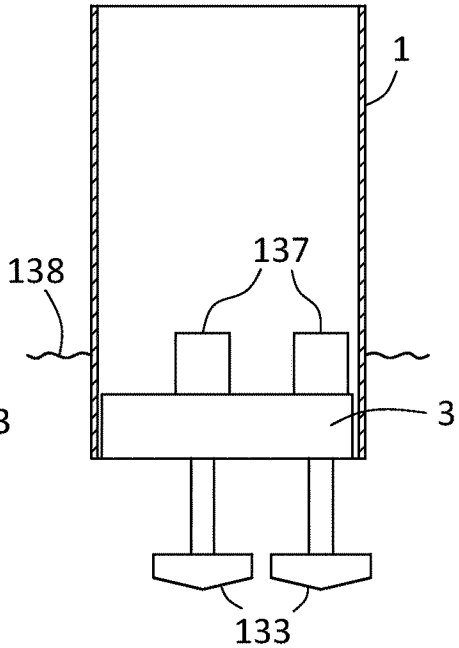
Figure 48:
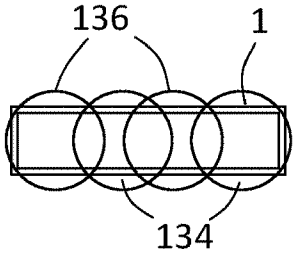
Figure 45:
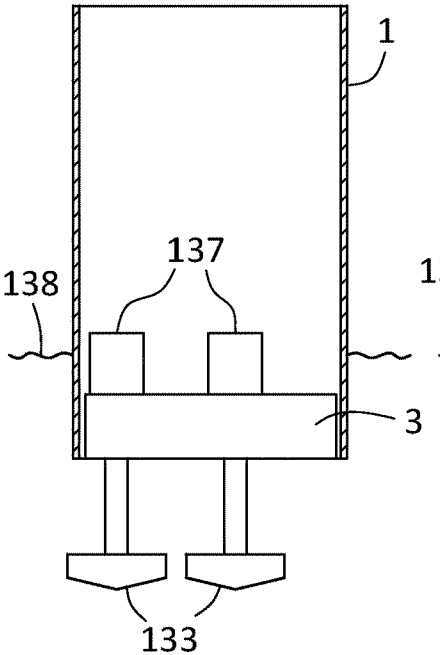
Figure 46:
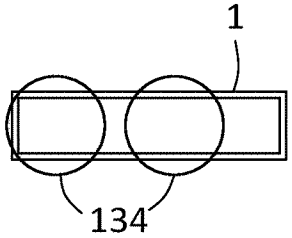
Figure 43:
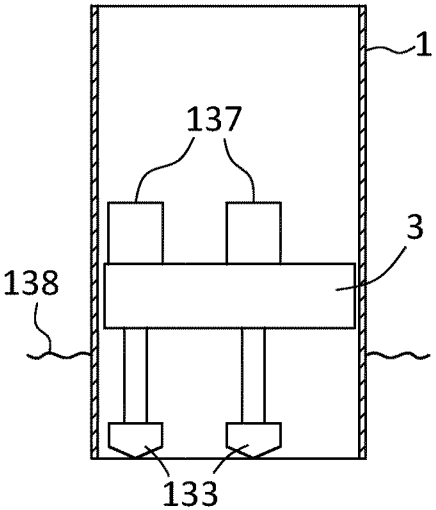
Figure 44:
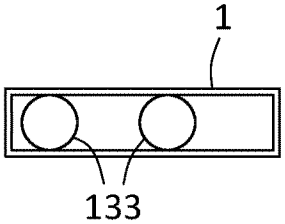
Figures 51, 52, 53, 54, 55, 56, 57:
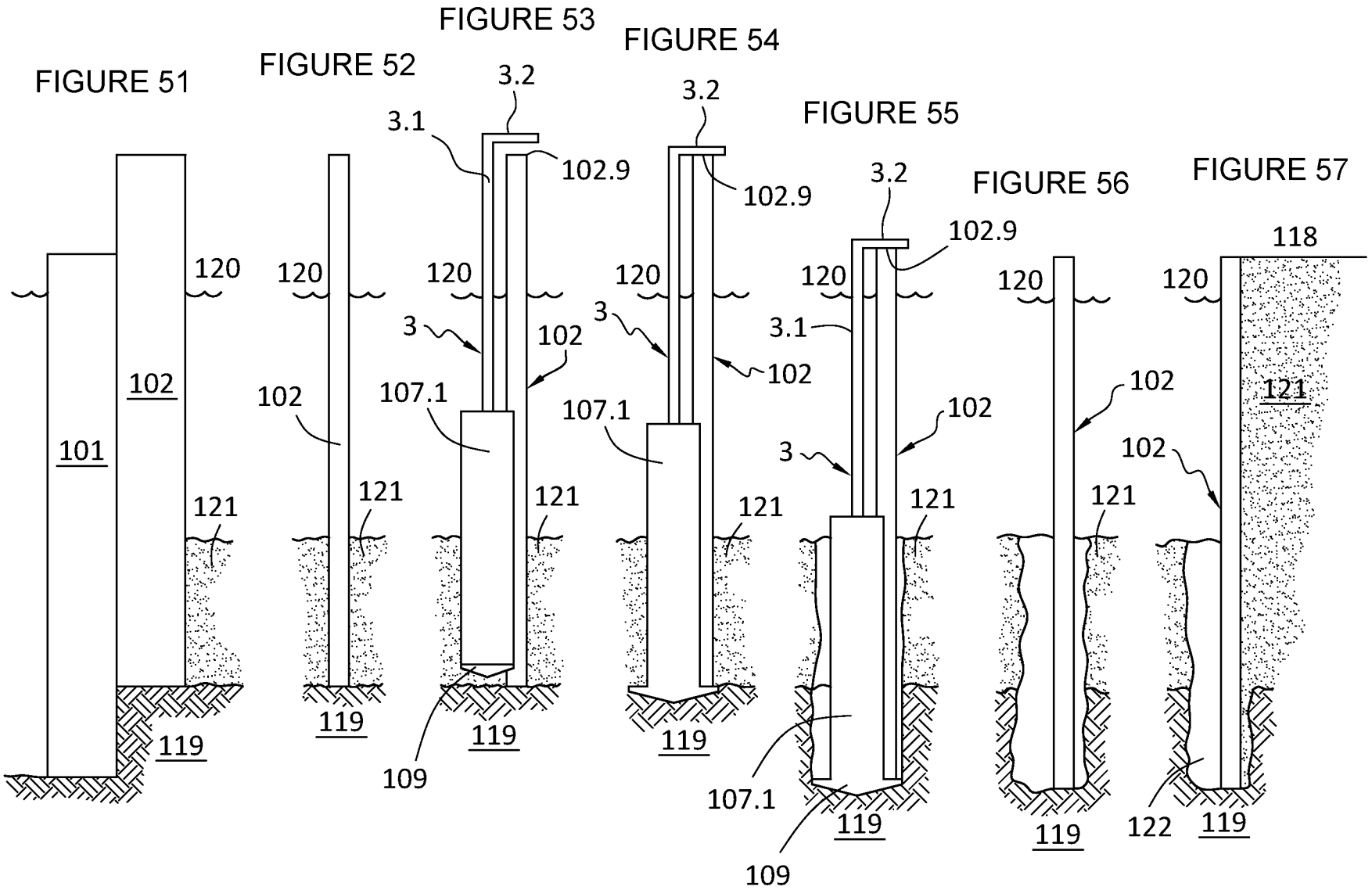

FIG. 38 is a plan view of another caisson and drilling assembly with a sheet pile releasably forming a part of the caisson;

FIG. 39 is a schematic plan view of a pin or linkage system to releasably connect the caisson and sheet pile section at the left side of the assembly of FIG. 38;

FIG. 40 is a schematic plan view of a pin or linkage system to releasably connect the caisson and sheet pile section at the right side of the assembly of FIG. 38;

FIG. 41 is caisson and drilling assembly which has two drill elements, which are able to be repositioned within the caisson or casing;

FIG. 42 is the assembly of FIG. 41, showing the drilling effect when the two drill elements are re-positioned within the caisson or casing;

FIG. 43 is the assembly of FIG. 41 in a schematic cross-sectional view with the drill assembly being moved through the caisson before reaching its drilling position, with the drill bits retracted;

FIG. 44 is a plan view of the assembly of FIG. 43;

FIG. 45 is the assembly of FIGS. 43 and 44, in a schematic cross-sectional view with the drill assembly being in its drilling position, with the drill bits extended;

FIG. 46 is a plan view of the assembly of FIG. 45 showing the diameter of the bores drilled and/or of the radial reach of the drill bits when extended;

FIG. 47 is the assembly of FIGS. 43 and 44, in a schematic cross-sectional view with the drill assembly being in its drilling position after having been re-positioned, with the drill bits extended;

FIG. 48 is a plan view of the assembly of FIG. 47 showing the perimeter of the bores drilled by assembly in FIG. 47 and previously drilled by the assembly in FIG. 45;

FIG. 49 is the assembly of FIGS. 43 and 44, in a schematic cross-sectional view with the drill assembly being retracted from its drilling position of FIG. 47, with the drill bits retracted and caisson advanced;

FIG. 50 is a plan view of the assembly of FIG. 49 showing the diameter of the drill bits within the confines of the caisson;

FIG. 50A illustrates a schematic plan view of another connection section or piece;

FIG. 51 illustrates a schematic front elevation of a first sheet pile placed to required depth and a second sheet pile attached to the first sheet pile and driven to the top of a hard seabed;

FIG. 52 illustrates a side elevation of the apparatus of FIG. 51;

FIG. 53 illustrates a side elevation of the second sheet pile with the combined excavation assembly and caisson or casing attached and with the bits collapsed drilled to the top of the hard seabed;

FIG. 54 illustrates the drill bits extended below the second sheet pile;

FIG. 55 illustrates the second sheet pile after being drilled into the seabed;

FIG. 56 illustrates the combined excavation assembly and caisson or casing removed leaving the second sheet pile in place;

FIG. 57 illustrates the second sheet pile grouted in place and the soft seabed backfilled up to ground level.

Figures 63, 64, 65, 66, 67, 68:
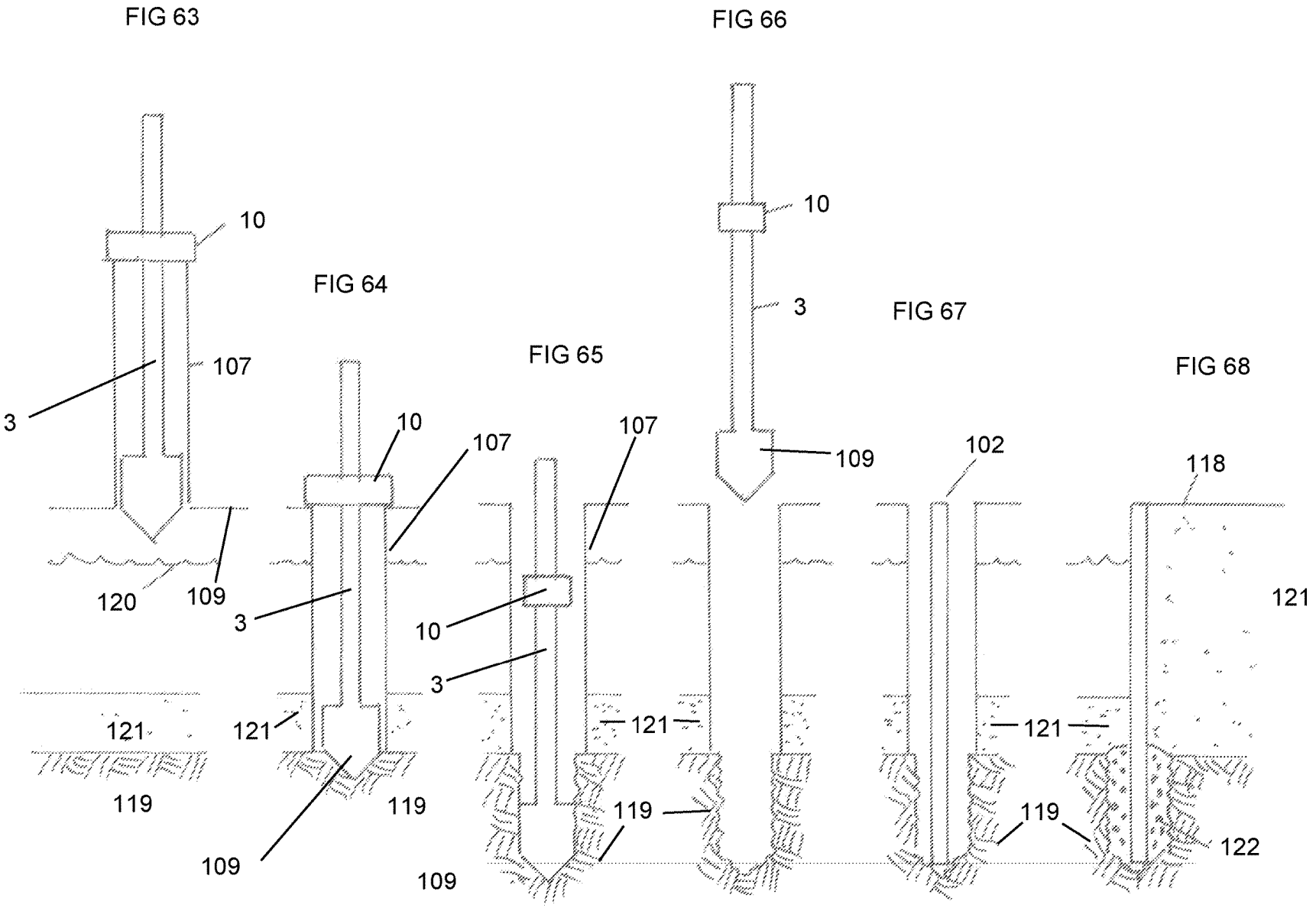
Figure 69:
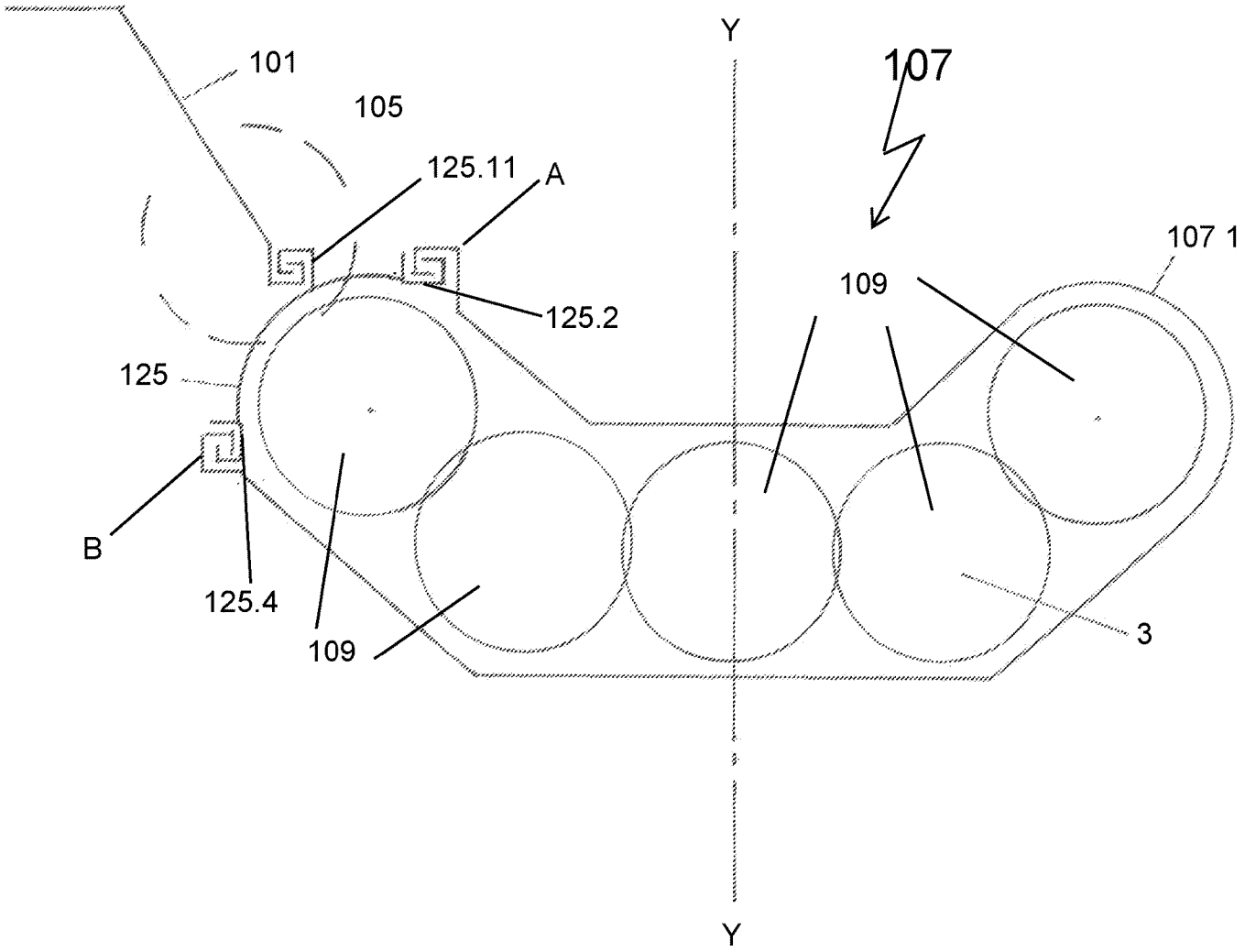
Figure 70:
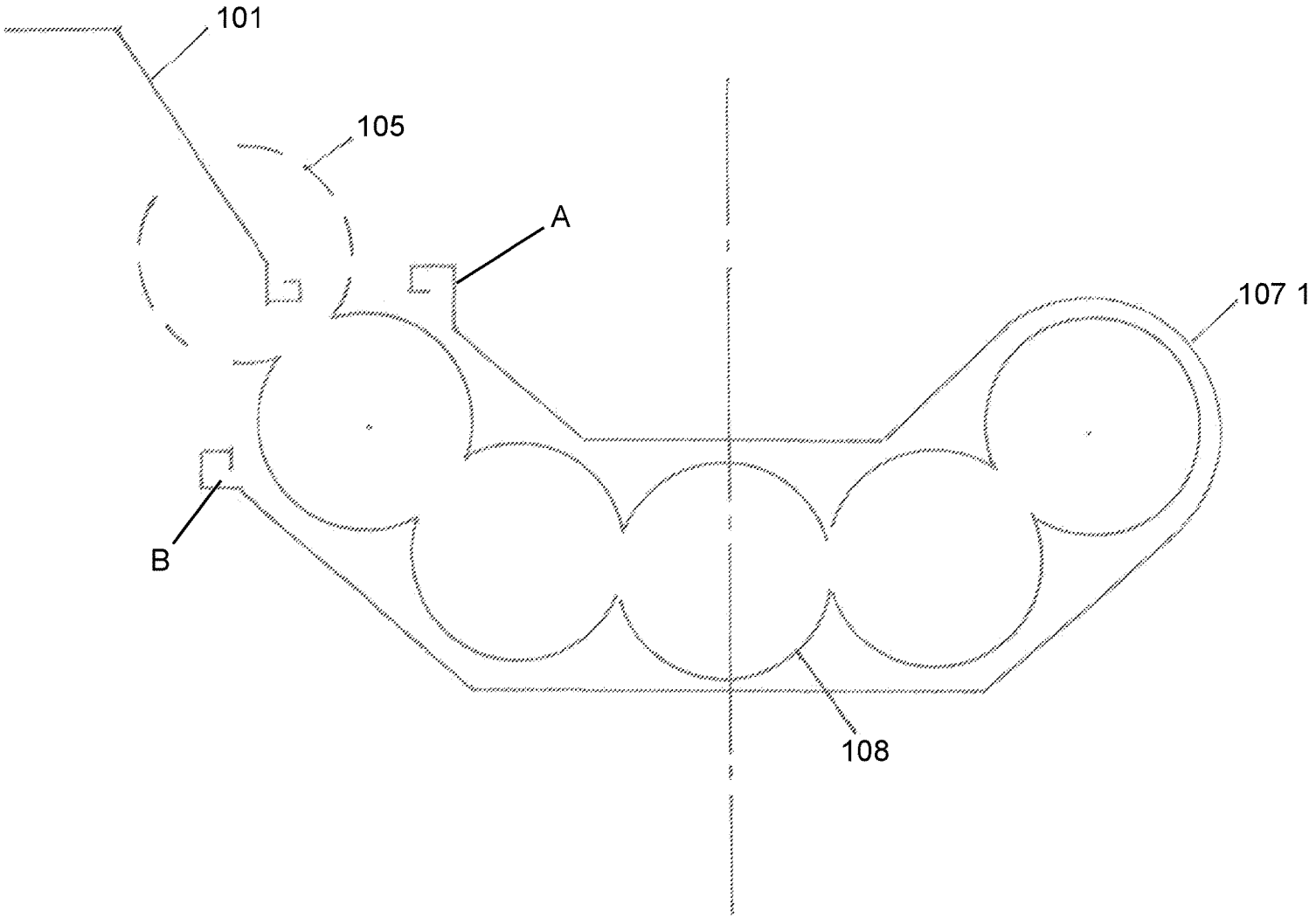
Figure 71:
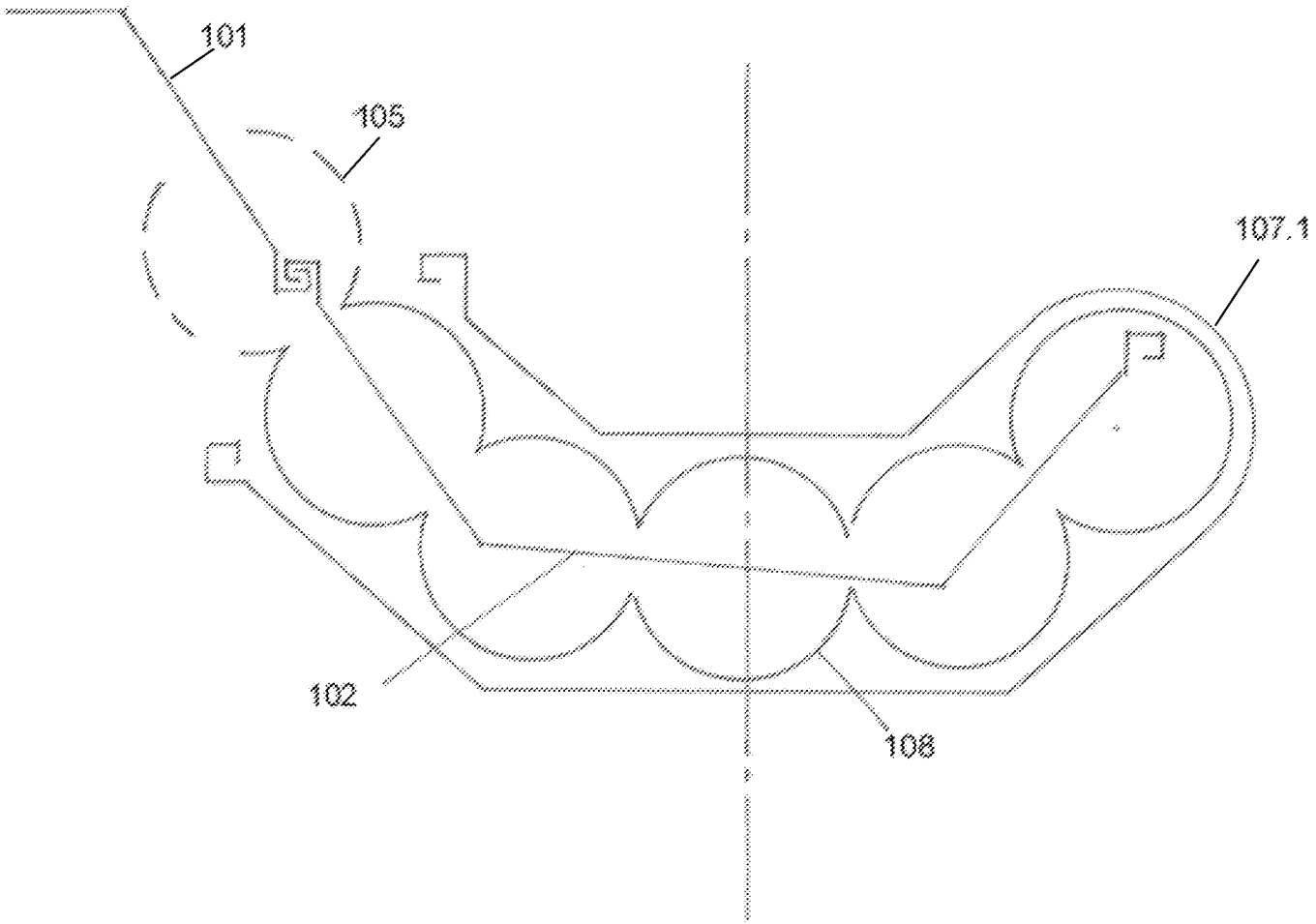
Figures 72, 93, 94, 95, 96:
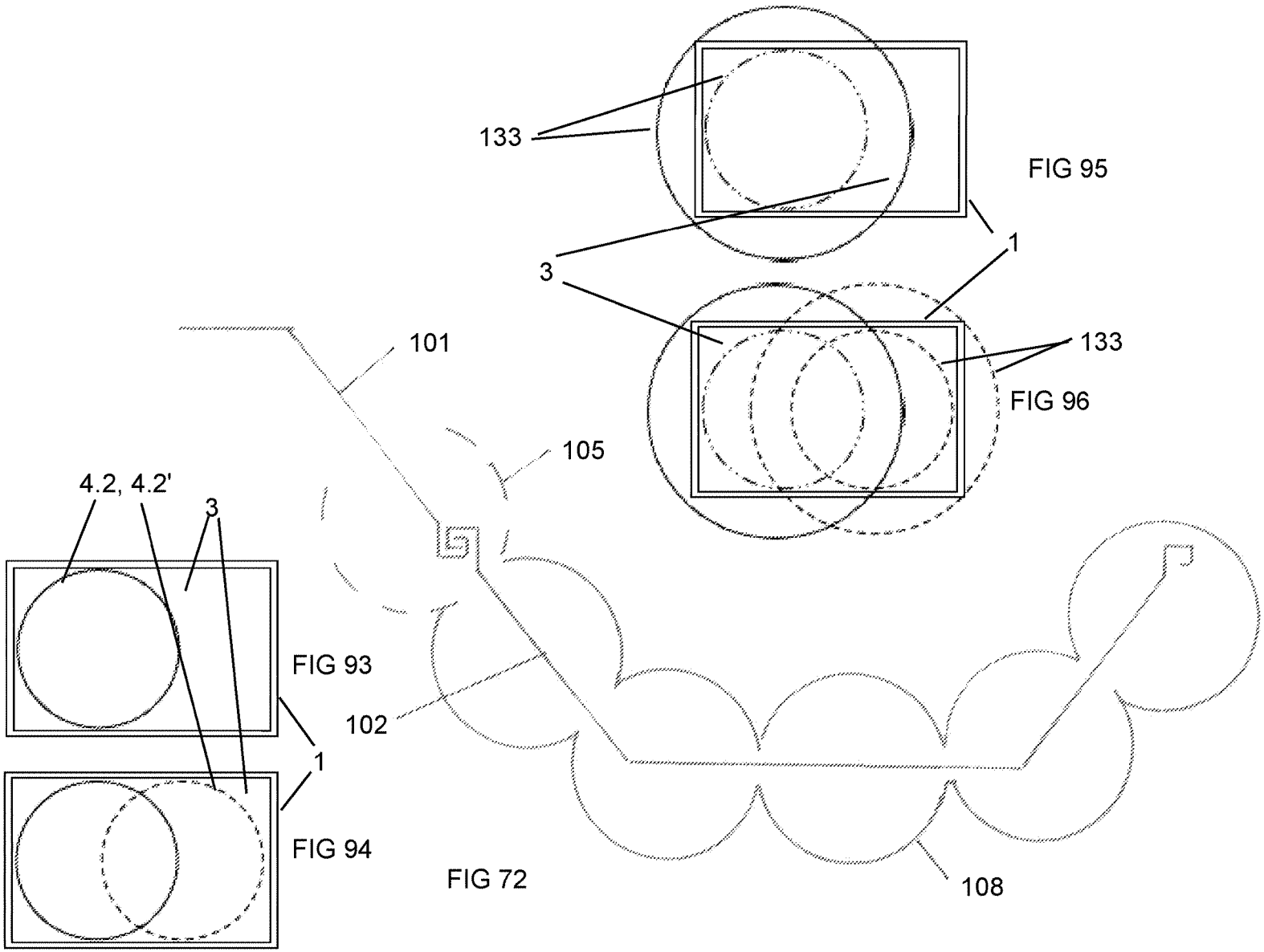
Figure 73:
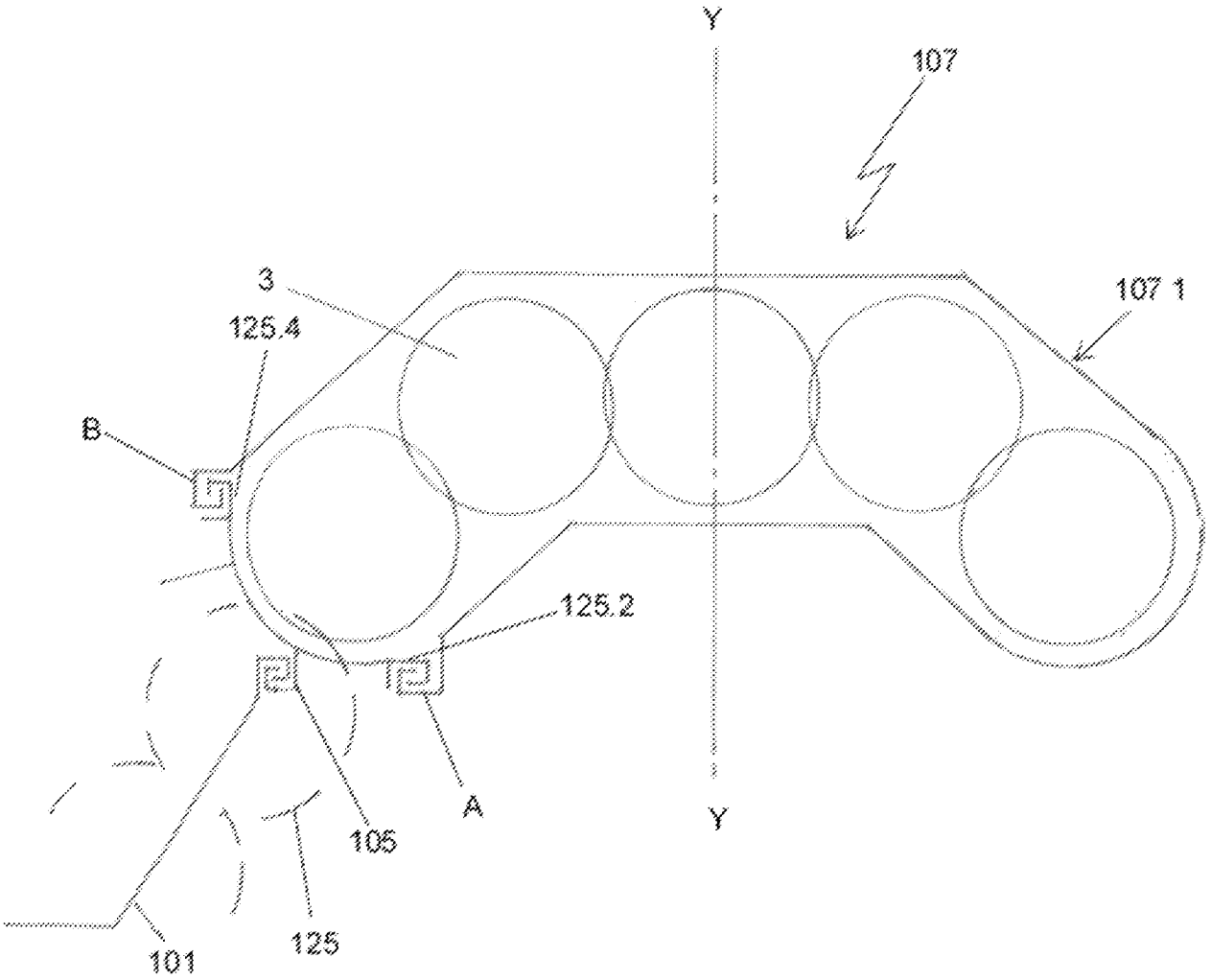
Figure 74:
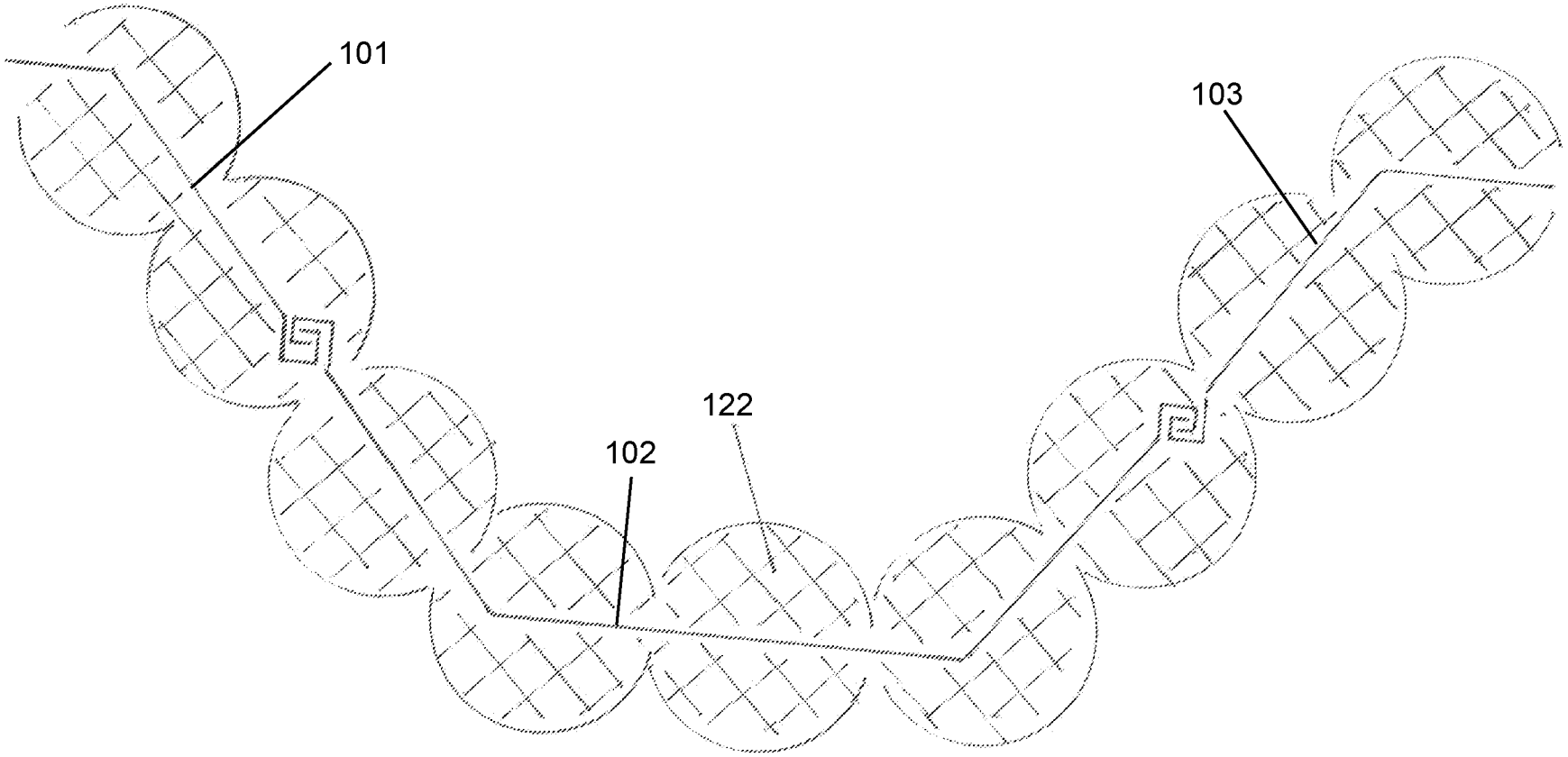
Figure 75:
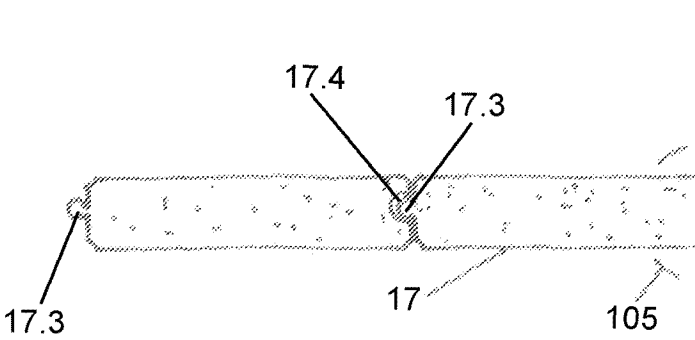
Figure 76:
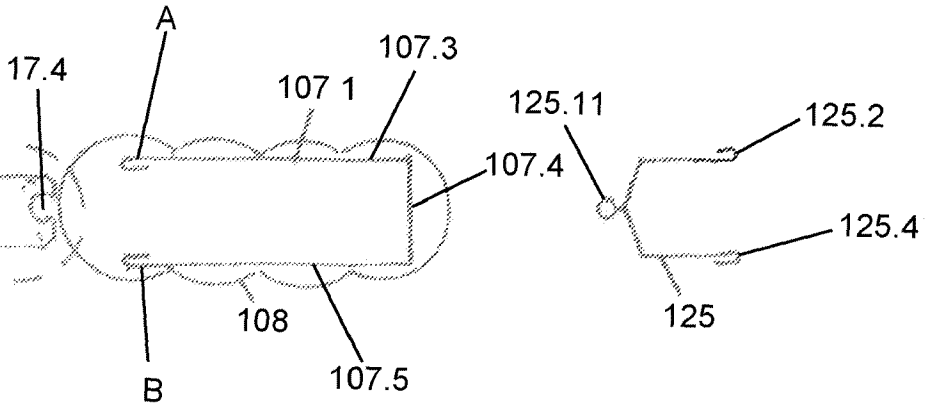
Figure 77:
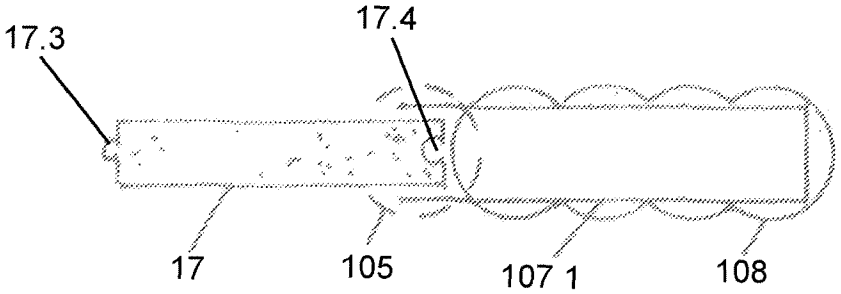
Figure 78:
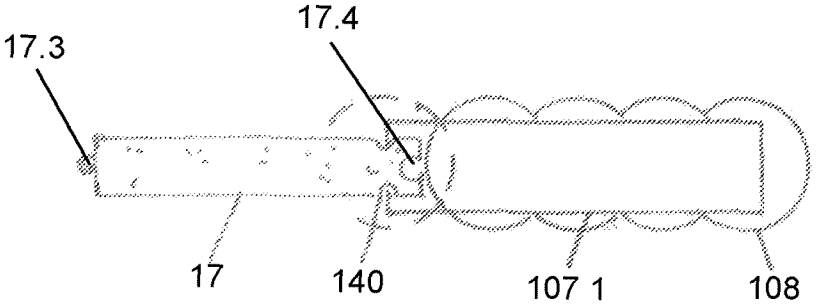
Figure 79:
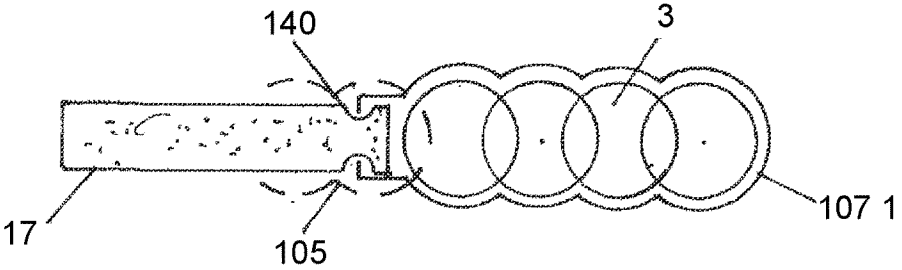
Figure 80:
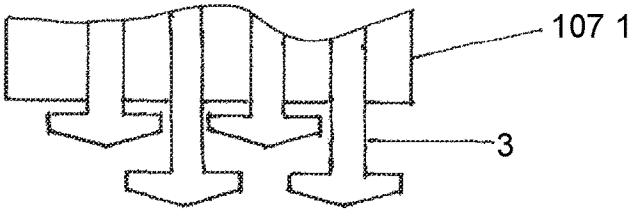
Figure 82:
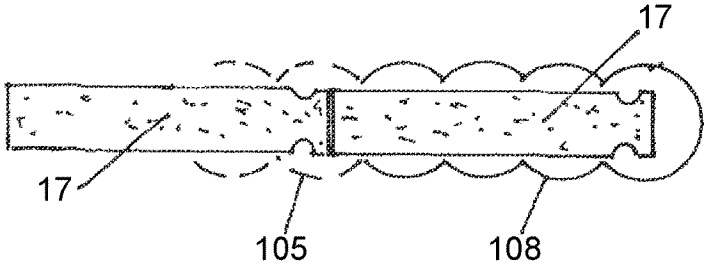
Figure 81:
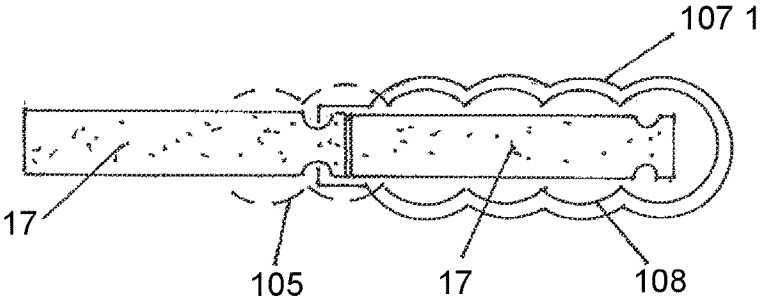
Figures 83, 84, 85, 86, 87, 88:
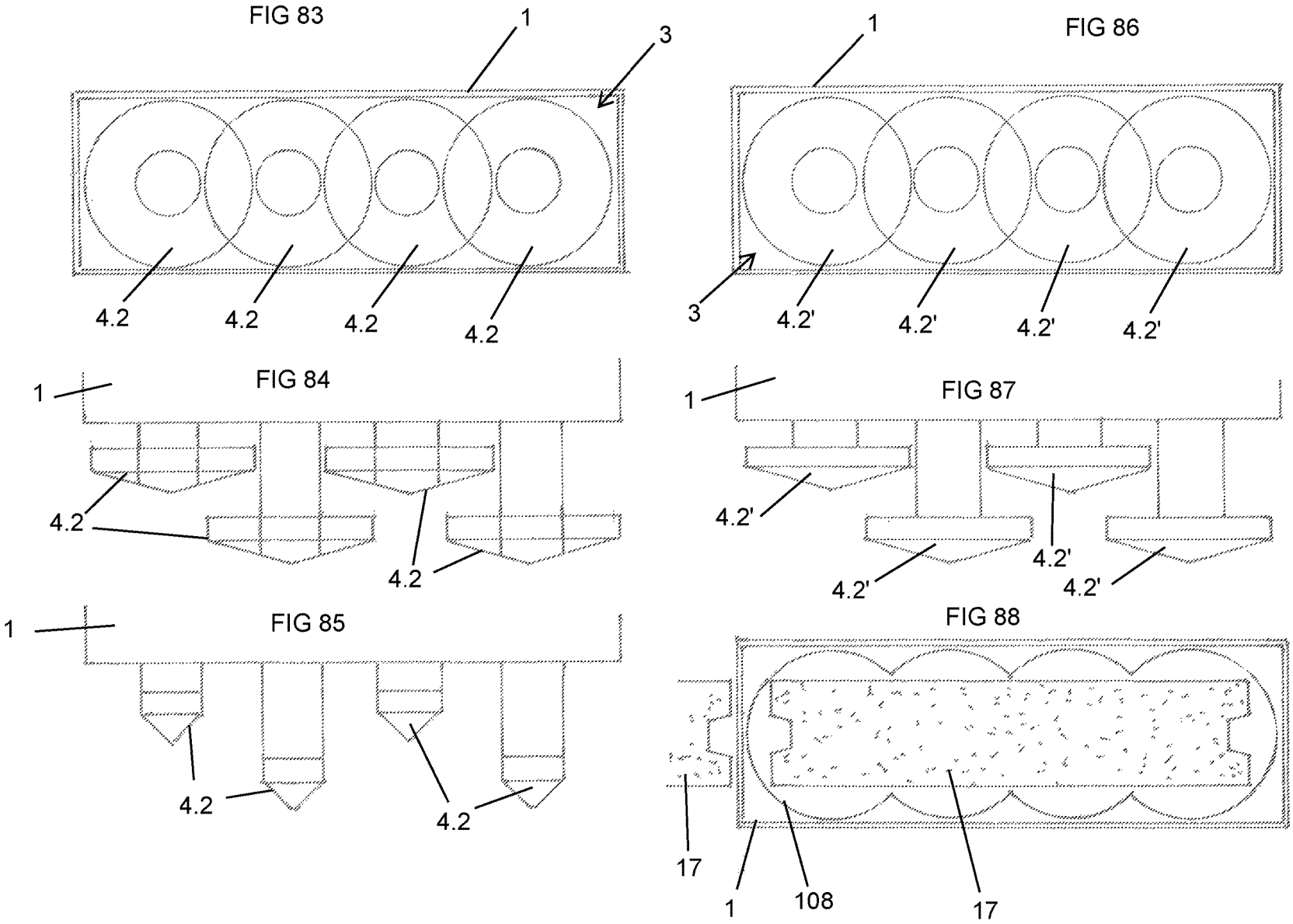

FIG. 58 illustrates a schematic front elevation of a first installed sheet pile with a second sheet pile with caisson or casing and excavation assembly, shortly after the sliding connection of the clutches between the first and second sheet;

FIG. 59 illustrates a side view of only the second sheet pile and combined caisson or casing and excavation assembly with drill bits in expanded state;

FIG. 60 illustrates the second sheet pile and combined caisson or casing and excavation assembly with drill bits in expanded state of FIG. 59, drilled into hard ground;

FIG. 61 Illustrates the unlocking of the drill assembly and shaped wall from the sheet pile and sliding same up the sheet pile;

FIG. 62 illustrates the sheet piled of FIGS. 58 to 61 grouted in place and land back filled to upper lip of the sheet pile;

FIG. 63 illustrates a caisson (which extends to above water level or soft bed level) and non-expanding drilling assembly, prior to entry into water;

FIG. 64 illustrates the assembly of FIG. 63 sunk or pushed or drilled through soft bed material to hard rock bed, and drilling within confines of caisson just beginning drilling into hard ground;

FIG. 65 illustrates the assembly of FIG. 64, with the drill assembly down to depth;

FIG. 66 illustrates the withdrawal of the drilling assembly from the caisson;

FIG. 67 illustrates the placement of the second sheet;

FIG. 68 illustrates the grouting and backfill of the second sheet of FIG. 67;

FIG. 69 illustrates the caisson or casing and non-expandable drilling assembly, with a curved connection section;

FIG. 70 illustrates the assembly of FIG. 69 with connection section and drill assembly withdrawn or removed and corresponds to FIG. 66;

FIG. 71 illustrates the placement of the second sheet inside caisson and corresponds to FIG. 67;

FIG. 72 illustrates the second sheet connected to the first sheet with the caisson removed and corresponds to FIG. 67, but is prior to grouting and back filling;

FIG. 73 illustrates the caisson and drilling assembly arrangement connected to the second sheet for guidance to drill for the third sheet pile;

FIG. 74 illustrates a schematic plan view of the first second and third sheet piles in grouted overlapping excavations;

FIG. 75 illustrates a schematic plan view of a caisson or casing and excavation footprint for use with interconnecting concrete panels;

FIG. 76 Illustrates a schematic plan view of a connection section for use with the system of FIG. 75;

FIG. 77 illustrates a schematic plan view of another caisson or casing and excavation footprint for use with interconnecting concrete panels with the caisson or casing using the earlier positioned panel for guidance;

FIG. 78 illustrates a schematic plan view of further caisson or casing and excavation footprint for use with interconnecting concrete panels with the caisson or casing interacting with the earlier positioned panel for guidance;

FIG. 79 illustrates a schematic plan view of further caisson or casing and non-expanding drill bit excavation footprint for use with non-interconnecting concrete panels with the caisson or casing interacting with the earlier positioned panel for guidance;

FIG. 80 illustrates side view of the caisson and drilling assembly of FIG. 79, showing the non-expanding drill bits;

FIG. 81 illustrates a schematic plan view of the placement of a second concrete panel into the caisson and the excavation footprint, before the caisson or casing is removed but after drill assembly has been removed;

FIG. 82 illustrates a schematic plan view showing the first and second concrete panels in place in the excavation footprint;

FIG. 83 is a schematic plan view of a caisson or casing with a drilling assembly with four expandable bits, which when expanded are overlapping and within the footprint of the opening of the caisson or casing;

FIG. 84 illustrates a schematic side view of the of the apparatus of FIG. 83, showing the bits in expanded condition;

FIG. 85 is a view similar to that of FIG. 84, except that the bits are shown in a contracted condition;

FIG. 86 is a schematic plan view of a caisson or casing with a drilling assembly with four non expandable bits which are overlapping and within the footprint of the opening of the caisson or casing;

FIG. 87 illustrates a schematic side view of the apparatus of FIG. 86, showing the bits;

FIG. 88 illustrates a plan view of the excavation foot print within the caisson or casing, with a pre-cast concrete panel therein, as will be formed by the apparatus of either FIGS. 83 to 85 and/or 86 and/or 87.

Figure 97:
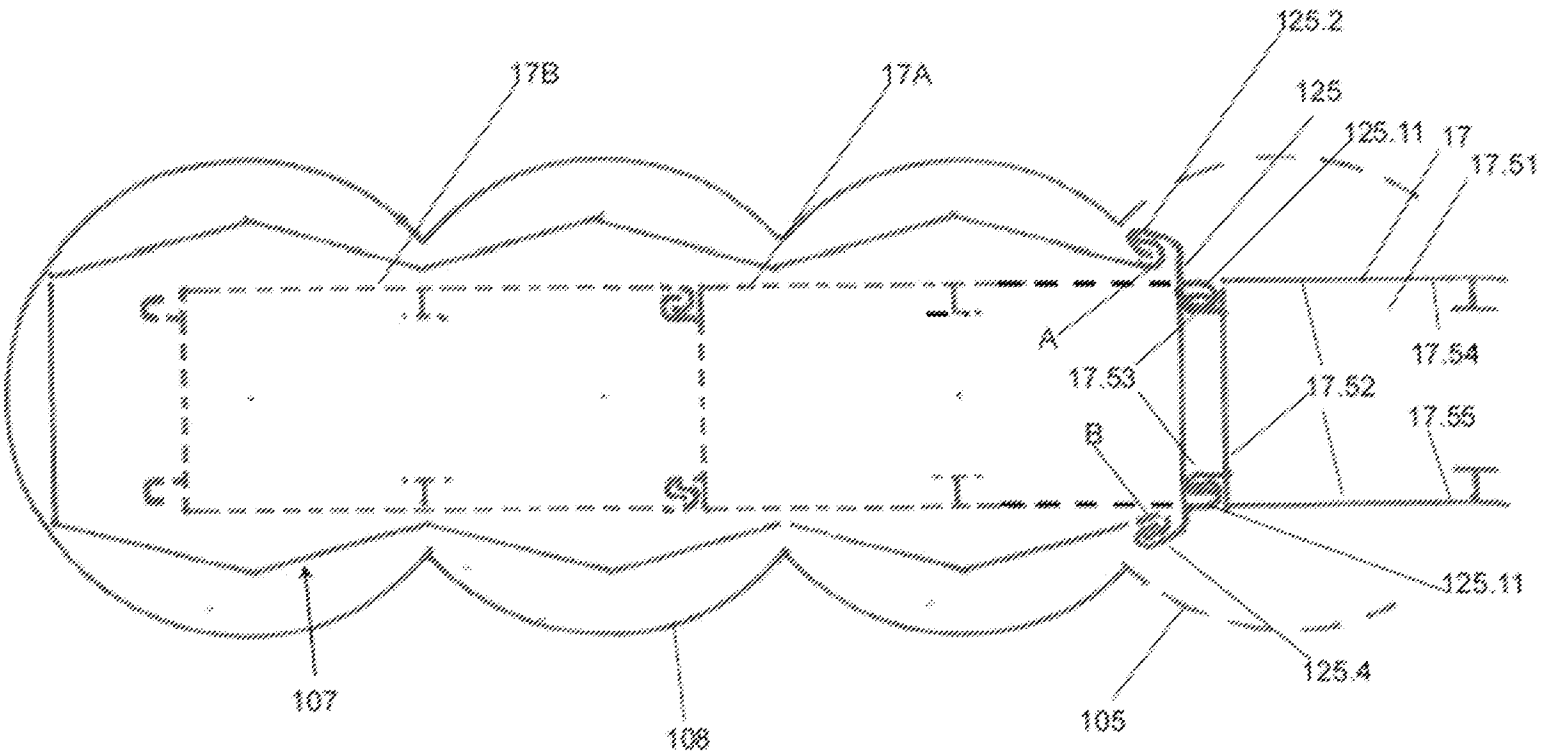

FIG. 89 illustrates a caisson or casing and excavation means or drilling assembly which has three excavation tools or drill elements, representative of an odd number excavation tools or drill elements, which excavate wholly within the caisson or casing, which are able to be repositioned to produce an overlapping excavation footprint;

FIG. 90 illustrates a caisson or casing and excavation means or drilling assembly of FIG. 89 showing the drilling effect when the three excavation tools or drill elements are re-positioned within the caisson or casing;

FIG. 91 illustrates a caisson or casing and excavation means or drilling assembly which has three excavation tools or drill elements, representative of an odd number excavation tools or drill elements, which excavate within and/or outside the caisson or casing, which are able to be repositioned to produce an overlapping excavation footprint;

FIG. 92 illustrates a caisson or casing and excavation means or drilling assembly of FIG. 91 showing the drilling effect when the three excavation tools or drill elements are re-positioned within the caisson or casing;

FIG. 93 illustrates a caisson or casing and excavation means or drilling assembly which has one excavation tool or drill element, which excavate wholly within the caisson or casing, which is able to be repositioned to produce an overlapping excavation footprint;

FIG. 94 illustrates a caisson or casing and excavation means or drilling assembly of FIG. 93 showing the drilling effect when the excavation tools or drill element is repositioned within the caisson or casing;

FIG. 95 illustrates a caisson or casing and excavation means or drilling assembly which has one excavation tool or drill element, which excavate inside and/or outside the caisson or casing, which is able to be repositioned to produce an overlapping excavation footprint;

FIG. 96 illustrates a caisson or casing and excavation means or drilling assembly of FIG. 95 showing the drilling effect when the excavation tool or drill element is repositioned within the caisson or casing;

FIG. 97 illustrates a caisson or casing and excavation means or drilling assembly of earlier figures, which is being utilised with two modular wall element or formwork such as the TRULINE® seawall modular wall system from Truline, LLC, so as to position such a modular wall element or if used as formwork ready to receive poured or pumped concrete or gravel.

Figure 98:
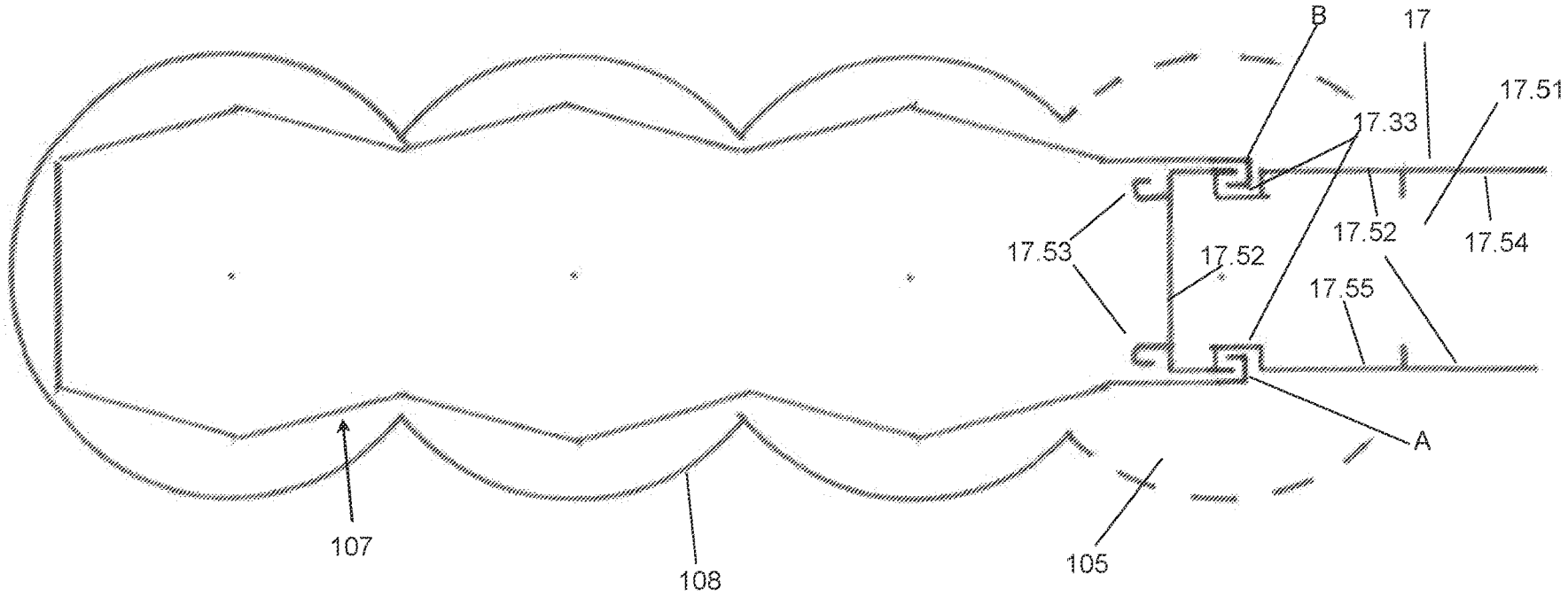
Figure 99:
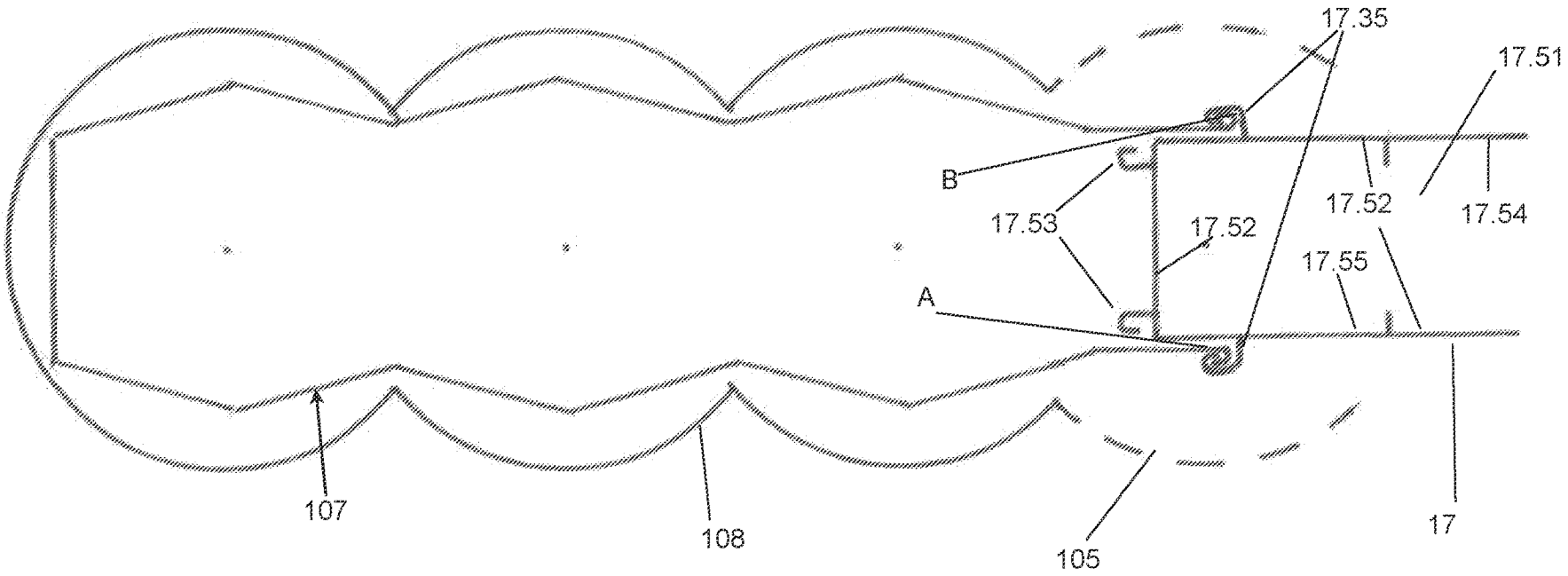
Figure 101:
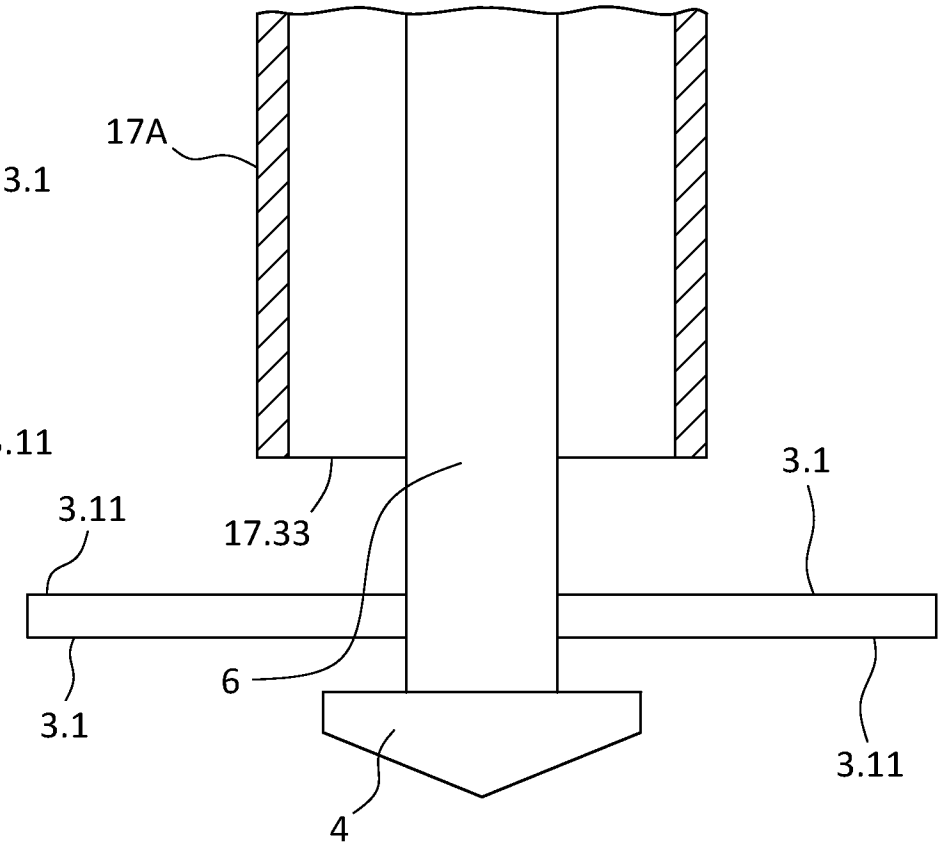
Figure 100:
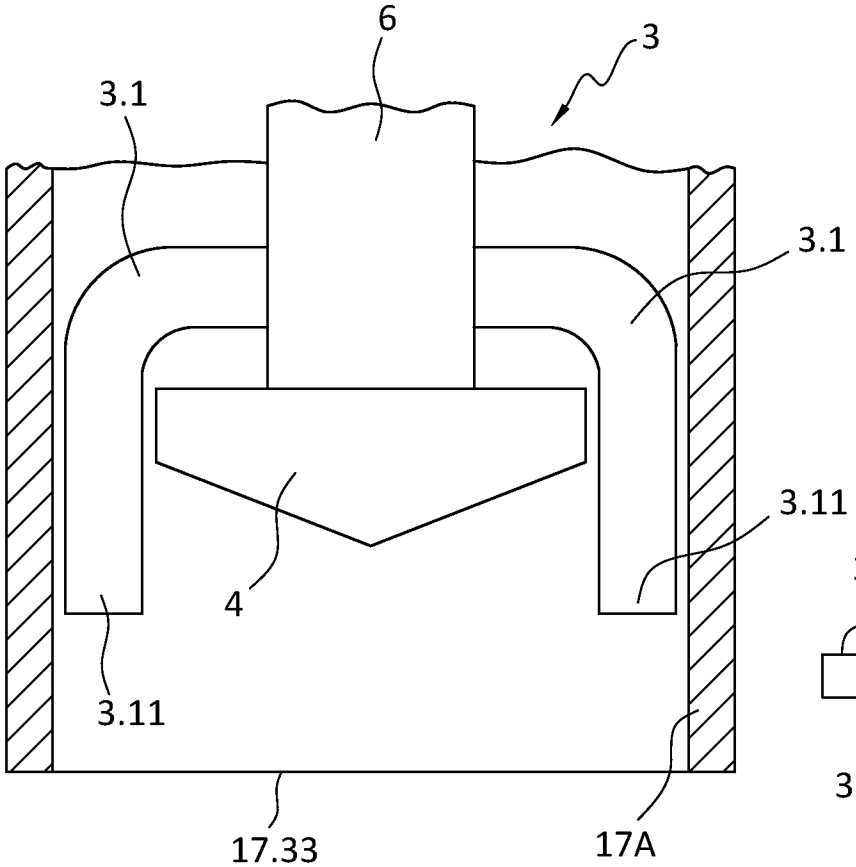
Figure 102:
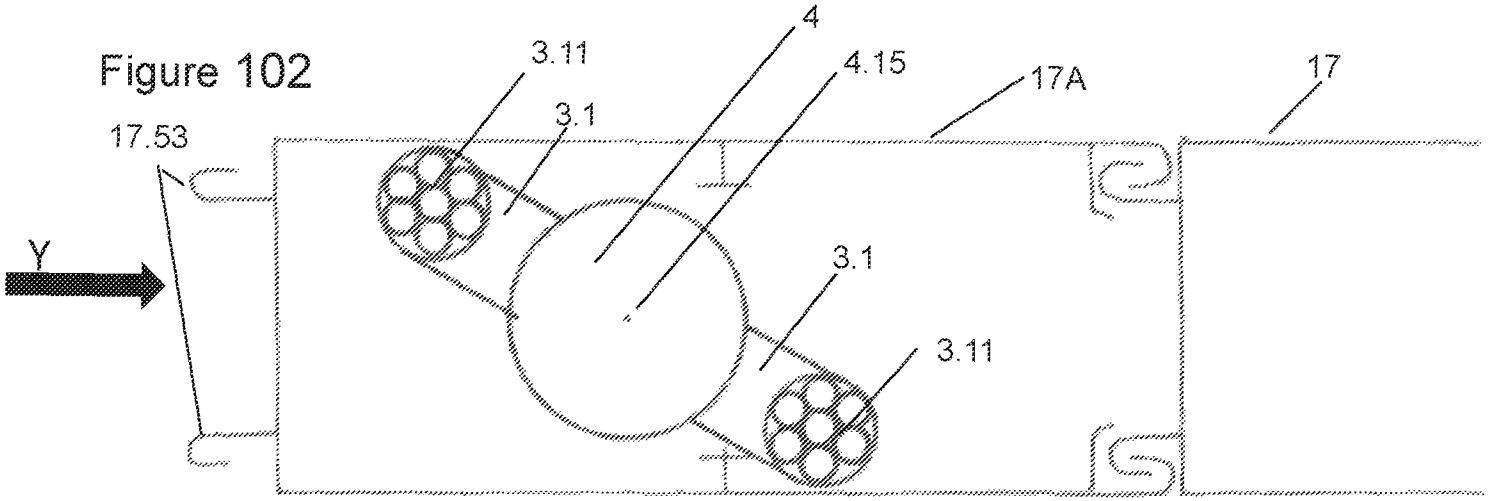
Figure 103:
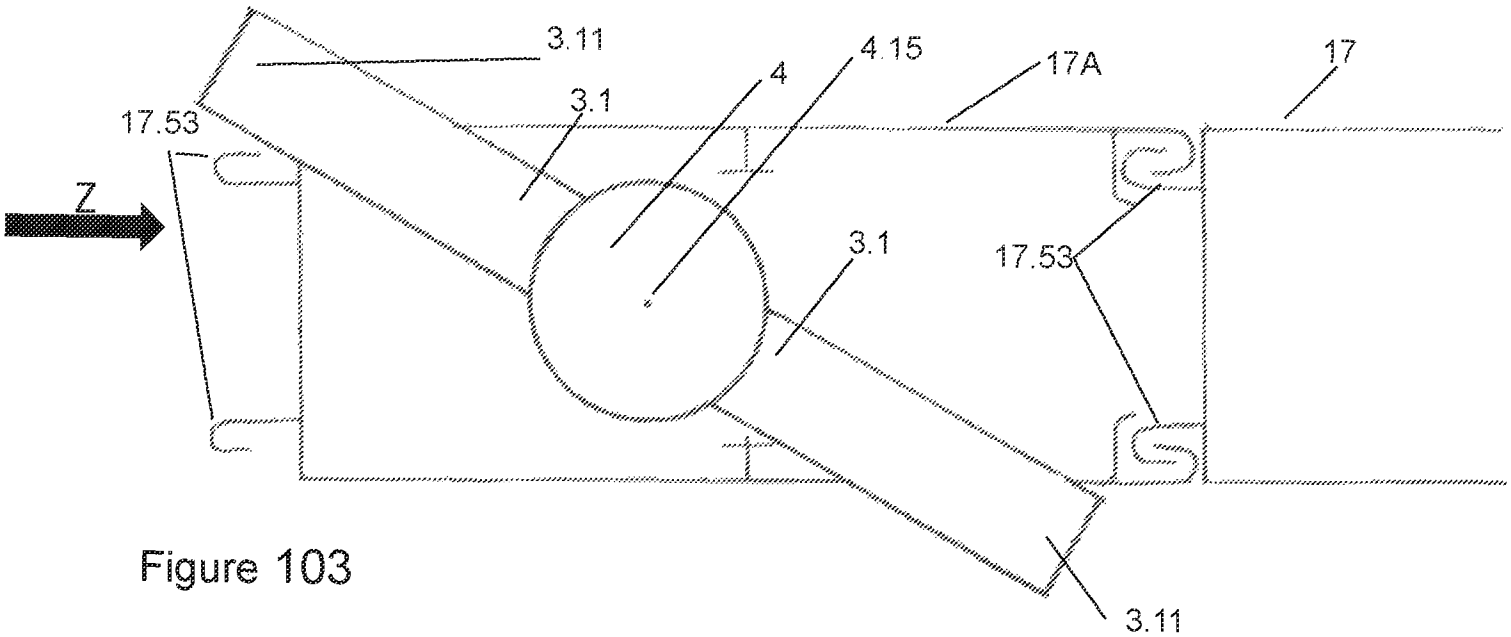
Figure 105:
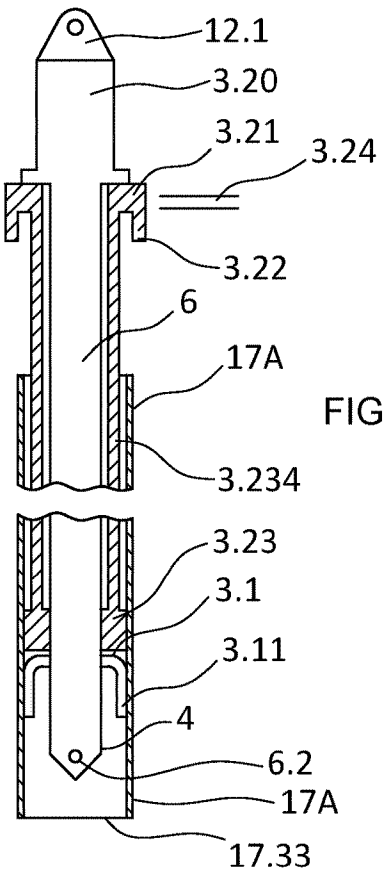
Figure 104:
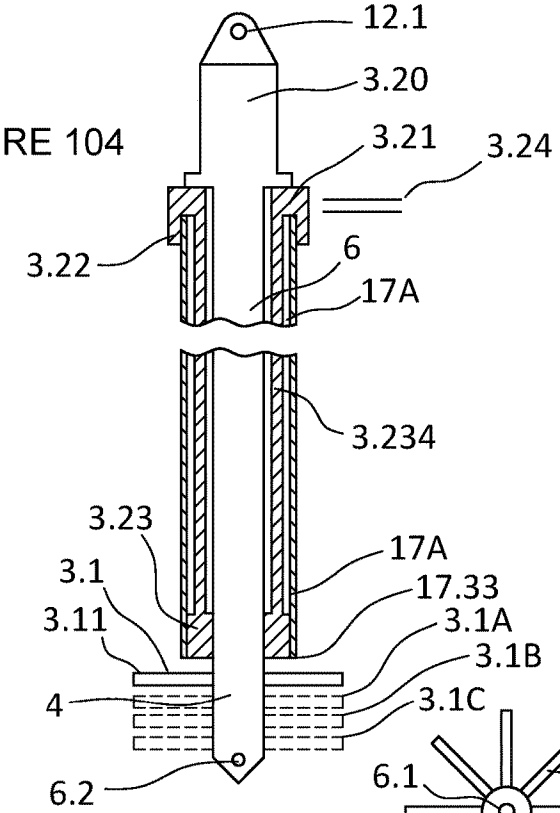
Figure 107:
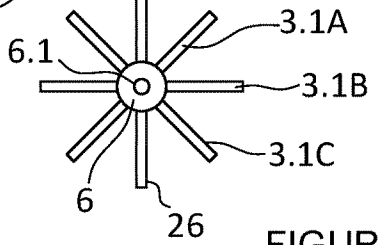
Figure 106:
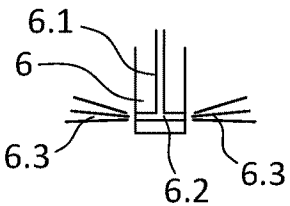
Figure 108:
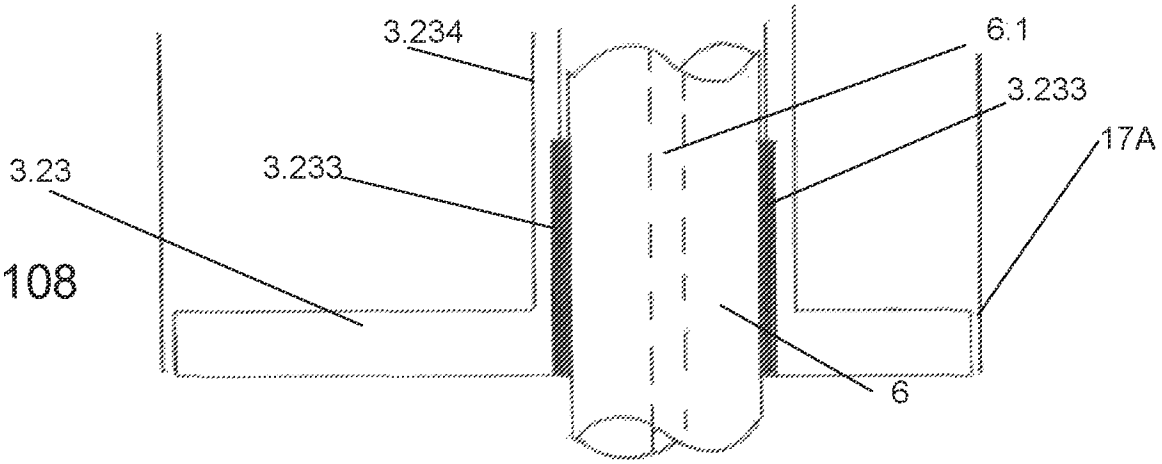
Figure 109:
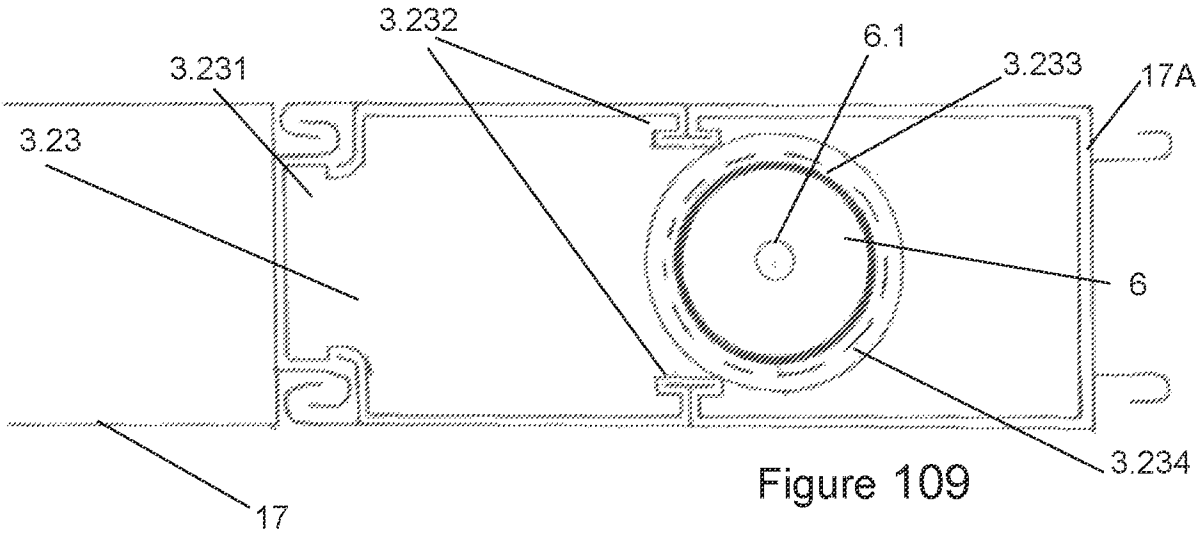
Figure 110:
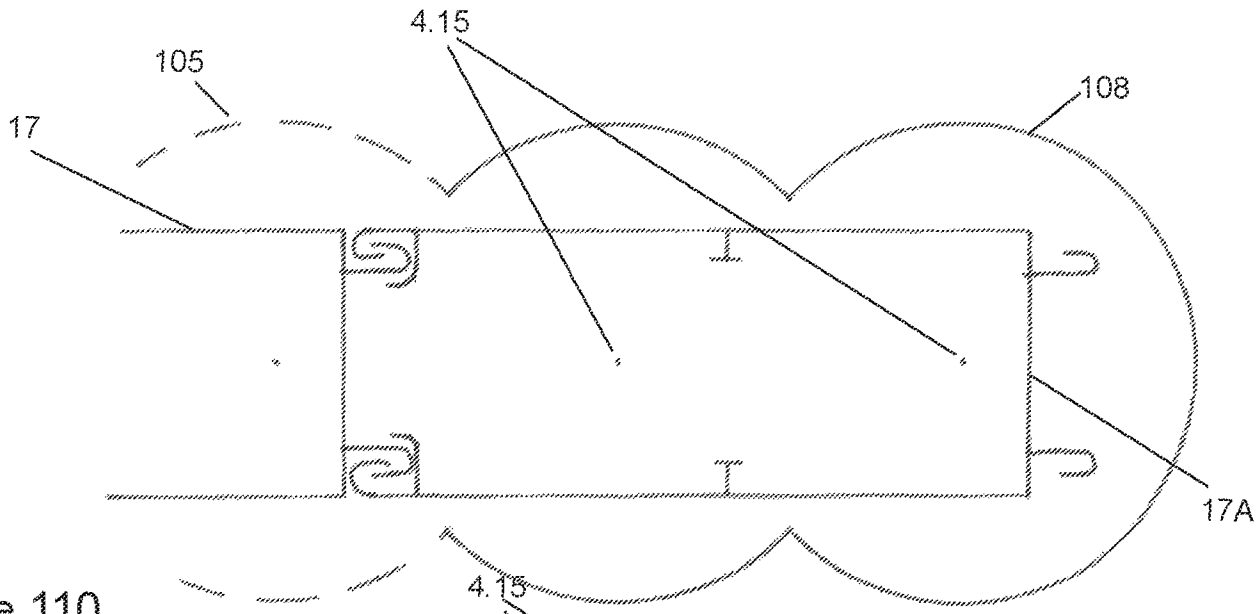
Figure 111:
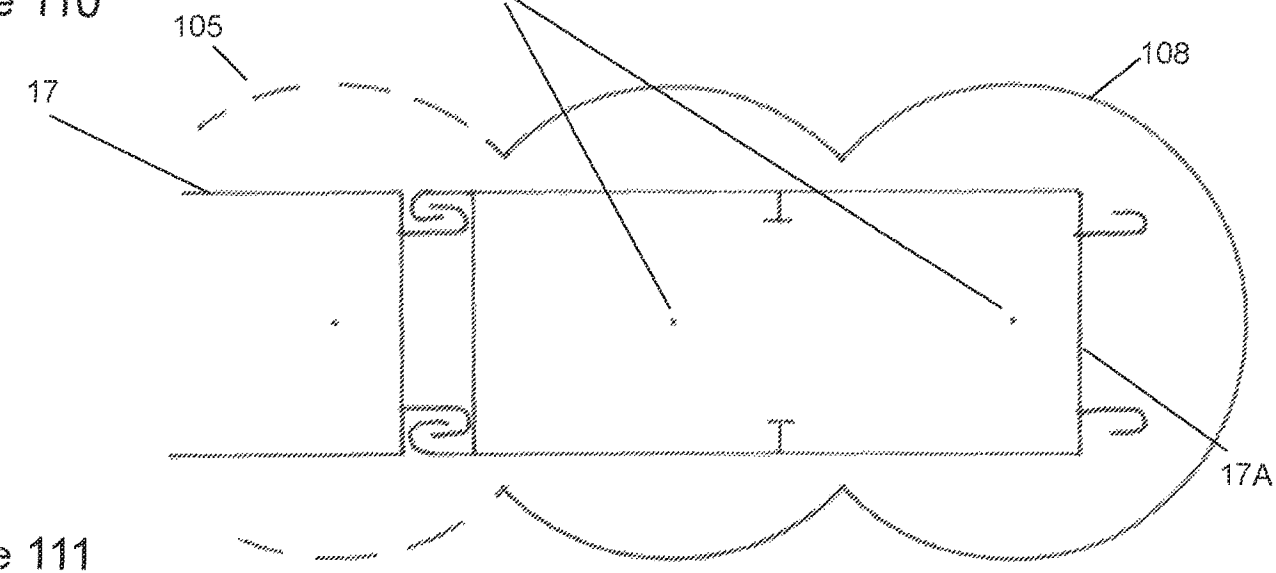
Figure 112:
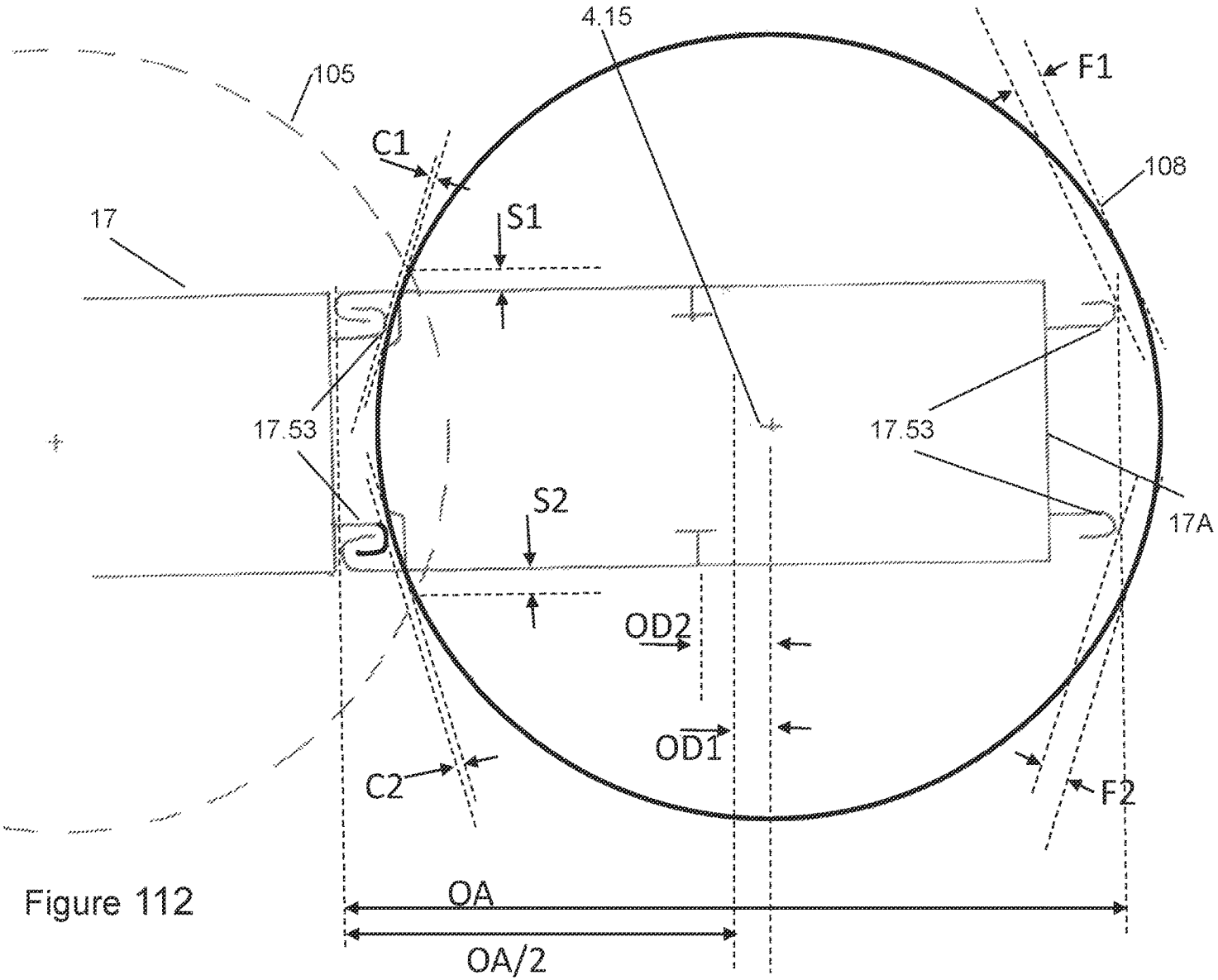
Figure 113:
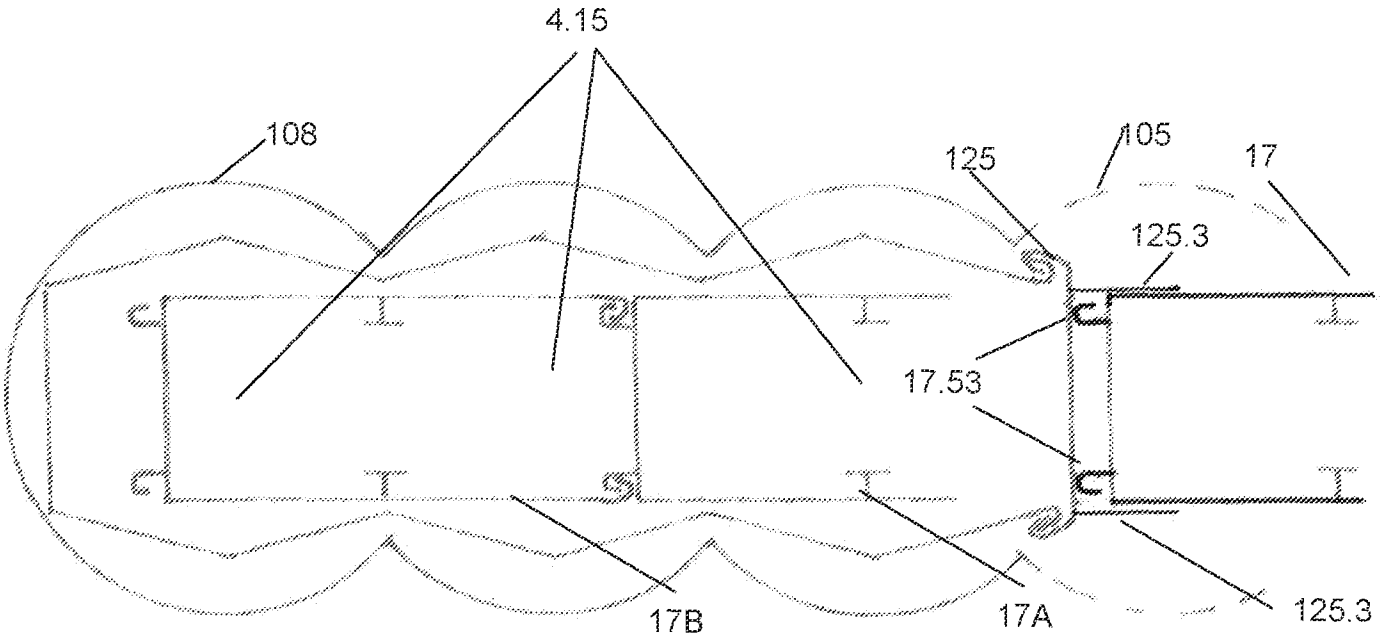
Figure 114:
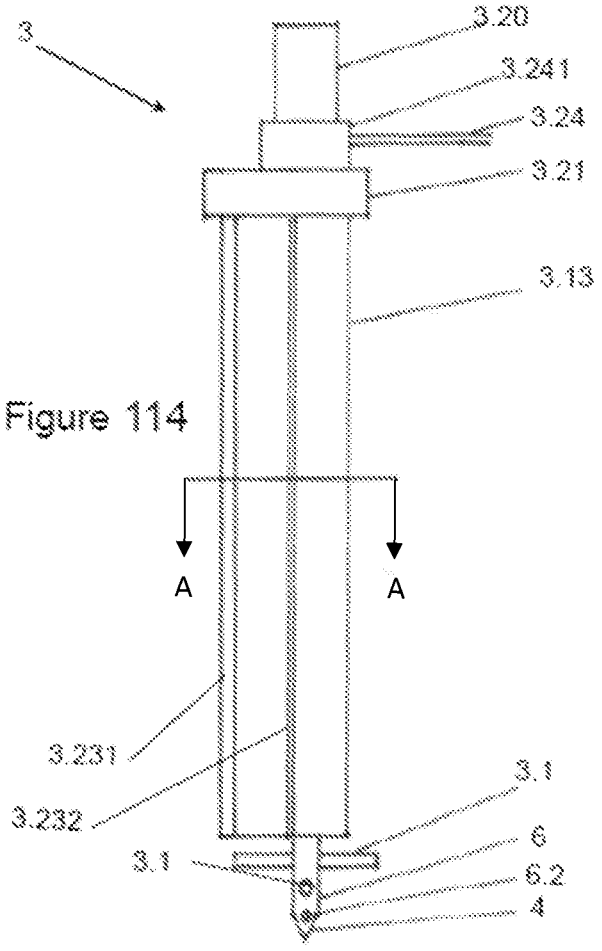
Figure 115:
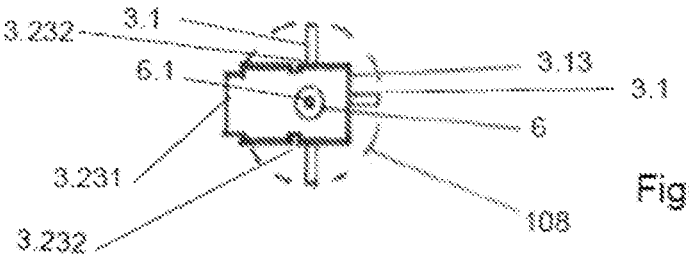

FIG. 98 illustrates a caisson or casing being utilised with a modified modular wall element or formwork;

FIG. 99 illustrates a caisson or casing being utilised with another modified modular wall element or formwork;

FIG. 100 illustrates a schematic cross section in side view (direction Y of FIG. 102) through a drilling and reaming apparatus cooperating directly to a modular wall element of FIGS. 97 to 99;

FIG. 101 is a schematic cross section in side view (direction Z of FIG. 102) of the system of FIG. 100, where the drilling and reaming apparatus has expanded;

FIG. 102 illustrates an underneath view of the arrangement of FIG. 100, with the drill bit 4 removed for illustration purposes;

FIG. 103 illustrates an underneath view of the arrangement of FIG. 101 with the drill bit 4 removed for illustration purposes;

FIG. 104 is a schematic side view cross section through a drilling and reaming apparatus as used with the drilling and reaming assembly of FIGS. 101 and 103, showing different levels of the multiple reaming elements;

FIG. 105 is a schematic side view cross section through a drilling and reaming apparatus as used with the drilling and reaming assembly of FIGS. 100 and 102, in the process of being withdrawn from a wall element;

FIG. 106 illustrates a side view cross section of the drill head;

FIG. 107 illustrates a schematic plan view of the multiple equi-spaced reaming elements of the drill assembly of FIG. 104;

FIG. 108 illustrates a side sectional view of part of the drilling and reaming assembly;

FIG. 109 illustrates a plan view of the part of the off-set drilling and reaming assembly of FIG. 108;

FIG. 110 is a schematic plan view of a three sided modular wall element installed in a cavity drilled by a twin drive shaft system based on the drilling and reaming system of FIGS. 100 to 109;

FIG. 111 is a schematic plan view of a four sided modular wall element installed in a cavity drilled by a twin drive shaft system based on the drilling and reaming system of FIGS. 100 to 109;

FIG. 112 is a schematic plan view showing the geometry of a three sided modular wall element installed in a cavity drilled by a single drill drilling system of FIGS. 100 to 109;

FIG. 113 is a schematic plan view of an alternative caisson or casing interacting with a modular wall element;

FIG. 114 is a schematic front or side view of a drilling assembly contained within a body or section, whether hollow or solid, the outside of which is shaped to match the shape of a modular wall element; and FIG. 115 is a schematic sectional view of the drilling assembly of FIG. 114 through the section plane A-A.

V. DETAILED DESCRIPTION OF THE EMBODIMENT OR EMBODIMENTS

The description and claims relate to the use of caissons or casings, and caissons and casings, to place structural elements into ground while minimizing disturbance of the surrounding environment. For the purpose of this specification and attached claims, the word "caisson" is meant to describe a hollow structure, which can be pressurized, that is, able to bear hydrostatic pressure either as water is evacuated from inside, or air is pumped in, whereas the word "casing" is meant to describe a hollow structure which is not pressurized, that is, water may be on the inside of the hollow structure. The following description applies to both types unless it is specified otherwise.

While the following description is in respect of an unpressurised caisson or casing, driven vertically in marine sediment it will be readily understood that the invention and embodiments thereof can be applied to pressurized caissons, and in directions other than vertical and other ground types.

Illustrated in FIGS. 1.1 to 1.3 is a generally rectangular caisson or casing 1, which can be of any desired height and/or wall thickness. Inside of the caisson or casing 1 is mounted an inner drilling assembly (or excavation means or drill) 3 with thee drill bits 4, being in a retracted condition. Not shown in these Figures are the attachment of the inner drilling assembly to the caisson or casing, or the bit drive, or flushing mechanism, but they are illustrated and described in respect of FIG. 9. The drill bits 4 are mounted for rotation in the drilling assembly 3, as described later in respect of FIG. 9. It will be noted from FIGS. 1.1, 1.2 and 1.3 that the retracted size or diameter of the drill bit 4 that is selected for use with the caisson/casing 1, is such as to fit within the inner wall dimension of the caisson/casing 1. The expansion and retraction of the cutting edges can be achieved by rotation, or by mechanical, hydraulic, or other means.

Illustrated in FIGS. 2.1 to 2.3 are similar figures to FIGS. 1.1 to 1.3, respectively, showing the relative positioning of the caisson/casing 1's wall with the drill bits 4.1 being the same as drill bits 4, except in an extended or expanded condition. It should be noted that the drill bits now labeled 4.1 in their extended or expanded condition do not cover the complete leading edge 2 of the caisson/casing 1, as is visible in each of FIGS. 2.1 to 2.3. However, it will be noted that a substantial portion of the periphery of the caisson/casing perimeter is overlapped by the outside diameter of the extended or expanded drill bits 4.1. In soft ground or highly friable terrain, this will not hinder the advance, downward movement or insertion of the caisson/casing 1's into such ground.

The caisson or casing 1 does not rotate whilst it is advanced or inserted into the ground. The terrains in which the embodiments are used are friable ground whereby the "cuttings" or bed are disturbed or plasticized, fluidised or worried, and are displaced by the drilling assembly and/or the caisson or casing. The embodiments do not drill or function when rock is encountered. The cuttings in these terrains are simply disturbed or moved away, and mixed with water by the rotation action of the drilling bits 4, especially in e.g. a river bed. This enables the caisson or casing to sink into the ground and reach the required or predetermined depth, under the influence of gravity, by a pushing or a pulling force, or by hammering. For instance, as shown in FIG. 22, workers can apply a tension rather than a compressive force to lower the caisson. This can be done by pulling on a rope, cable or similar 38, which is arranged around pulleys 40 to transmit the pulling force into a downward force upon the caisson or casing 1.

The drill assembly 3 effectively closes off, or substantially closes off, the opening formed by the inner periphery at the leading ledge of the caisson or casing.

It will be noted from FIGS. 2.2 and 2.3, that the outside diameter of the expanded drill bits 4.1 do not overlap, ensuring the easy operation and obviates the need to synchronize the bits 4.1 in their cutting action.

As the bits 4.1 when expanded, can be contracted to the positions shown in FIGS. 1.1 to 1.3, this means that when the caisson/casing 1 is in the desired position in the earth, river or harbour bed, or other location, once brought to the retracted condition can be withdrawn from the caisson/casing 1, with the friction with the caisson/casing 1 outer wall, ensuring that it does not move when the drilling assembly 3 is withdrawn from the caisson/casing 1.

Illustrated in FIGS. 3.1 to 3.3 are respectively similar views to that of FIGS. 2.1 to 2.3 with the drill bits 4.1 and 4.2 in their extended or expanded conditions covering the complete leading edge 2 or the whole periphery of the caisson/casing 1. Drill bit 4.2 is vertically positioned lower with respect to the bits 4.1, so that the rotation of bit 4.2 does not conflict with the rotation of other bits 4.1. Alternatively, the bit 4.2 can be positioned above other bits 4.1, in order to achieve a similar functional effect.

Illustrated in FIGS. 4.1 to 4.3 are respectively similar illustration to that of FIGS. 3.1 to 3.3, with the drill bits 4.3 in their extended or expanded position, but the outer bits 4.3 being at a 90 degrees phase difference to the inner bit 4.3. The rotation of the drill bits in this assembly would need to be synchronized to avoid conflict or inter-engagement. The synchronization could be achieved by chains, gears or any other appropriate means.

Figure 5:
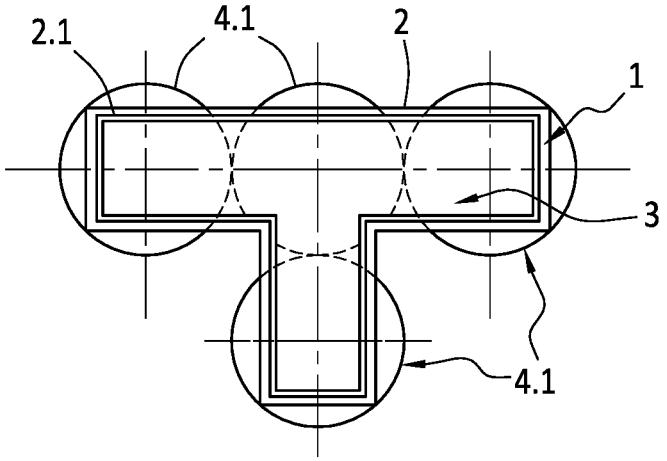
FIG. 5 illustrates a plan view of an embodiment similar to that of FIG. 2.3, where the caisson/casing has a hollow T-shape.
Figure 6:
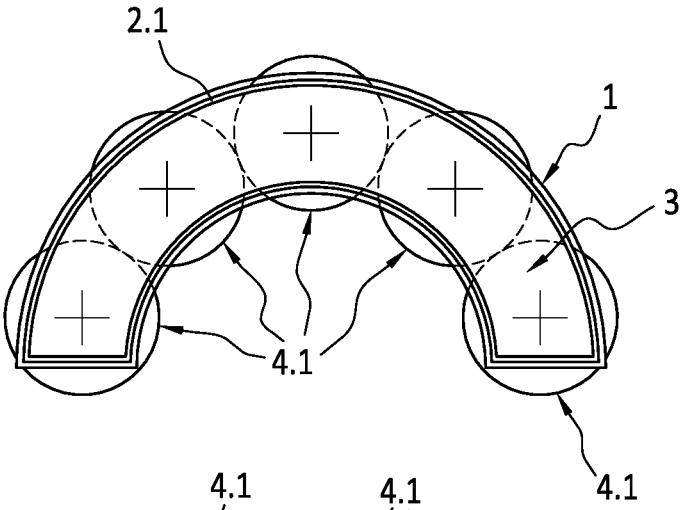
FIG. 6 illustrates a plan view of an embodiment similar to that of FIG. 2.3 or 5, where the caisson/casing has a hollow arcuate or half round shape.
Figure 7:
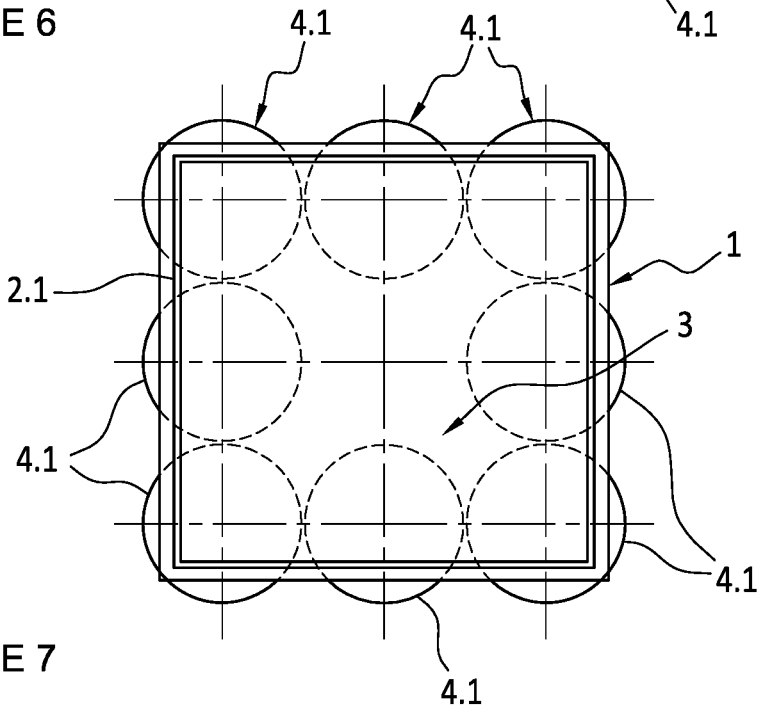
FIG. 7 illustrates a plan view of an embodiment similar to that of FIG. 2.3, 5 or 6, where the caisson/casing has is a relatively large hollow square shape, utilising some 9 expanding bits.

Illustrated in FIGS. 5, 6 and 7 are caissons 1 and inner drilling assemblies 3 of various shapes. The location of the drill bits 4.1 are as detailed in FIGS. 2.1 to 2.3. The drill bits 4.1 of FIGS. 5, 6 and 7, could also be arranged as described in FIGS. 3.1 to 3.3 or 4.1 to 4.3.

Illustrated in FIGS. 8.1 to 8.4 are a caissons/casing 1 and an inner drilling assembly 3 of the shape which generally corresponds to the number "8". Two drilling bits 4.1, 4.2 are provided in the drilling assembly 3. The drilling bits 4.1, 4.2, in their expanded condition overlap with each other. Therefore, one drill bit 4.2 is positioned lower than the other drill bit 4.1.

It will be readily understood that structural elements of other shapes than those illustrated in the FIGS. 1.3, 3.3, 4.3, 5 to 7, and 8.3 will require caissons/casings 1 of other corresponding or matching shapes.

As illustrated in FIGS. 1.1 to 8.4, there is a gap 2.1 between the body of the inner drilling assembly 3 and the interior surface of the caisson or casing 1. The body of the inner drilling assembly 3 can further generally conform to the shape of the interior of the caisson 1. This gap is usually of the order of 5 to 10 millimeters, but variations from this range are possible. When the embodiment is used in a watery environment such as the ocean, harbour, or river, water is allowed to ingress into the interior of the caisson/casing 1 through the gap 2.1. Water ingress into the caisson or casing 1 is also possible through any other apertures or holes provided on the wall of the caisson or casing 1. Thus in circumstances where the embodiment is used in a watery environment, water is allowed to enter and may fill the caisson/casing 1. The water ingress helps the caisson/casing to sink into the friable ground.

Illustrated in FIG. 9 is a caisson/casing 1 and an inner drilling assembly 3 with three expanding drill bits 4 driven by hydraulic motors 5. The motors 5 are kept in approximate synchronization by the hydraulic flow divider 7. The flow divider 7 can be located within the inner drilling assembly 3 or as shown in FIG. 9 where it is external to the caisson/casing 1. The motors 5 have drive shafts 6 that pass through bearings 8 to the bits 4.

Flushing hoses 14 supply air or liquid to the bits 4 through the bearing 8 and the shaft 6 to a location past the base 9 of the bearing 8, and out through the flushing hole 15. Hydraulic hoses 13 connect the divider 7 with the motors 5. A latch assembly 10 on the drilling assembly 3 locates the inner drilling assembly 3 with the caisson or casing 1, and engages apertures 11 in the caisson or casing 1. A lifting assembly or frame 12 is provided to remove the inner drilling assembly 3 from the caisson/casing 1 when the bits 4 are retracted. The lifting assembly 12 is connected to the latch assembly 10 so that when tension is applied to the lifting assembly the latch assembly 10 will automatically detach from the caisson 1. This attachment is not shown on the drawings.

In operation, the periphery of the body of the drilling assembly 3 conforms as close as practical to the internal rim of the leading edge of the caisson 1, which will preferably, on its inside, be of a constant cross section. This relationship of conformity precludes or reduces the entry of material into the caisson 1. The drill bits 4, by their rotation, will worry, plasticise, fluidise, or disturb the ground. The disturbance can be also helped or enhanced by the injection of fluids through the flushing hole 15. The ground, so disturbed, is forced by the combined mass of the caisson 1 and the drilling assembly 3 to move outward from underneath the drilling assembly 3 and upward as the assembly sinks.

Illustrated in FIGS. 10.1 to 10.13 are examples of two drill bits which are available and can be used with the embodiments described above. Other types of expanding drill bits, some called under the name "reamers" or "under reamers" which may or may not require rotation to cause expansion or counter-rotation to cause contraction, are also known which can also be used with the embodiments of the present invention as described above.

In respect of the above embodiments, when the caisson or casing 1 has reached the required depth, the rotation of the expanding drill bits 4, 4.1, 4.2, 4.3 (e.g., those drill bits illustrated in FIGS. 10.1 to 10.12) are reversed in the direction 16 of FIGS. 10.3, 10.6, 10.9, and 10.12 retracting the cutting edges. The inner drilling assembly 3 can then be detached from the caisson/casing 1 and then removed from the caisson/casing 1. Once the required depth of caisson/casing 1 is reached, a structural element, such as a poured concrete element (such as a wall, a block, retainer), or a preformed concrete shape, can then be formed or placed inside the caisson/casing 1 and then caisson/casing 1 removed leaving the structural element in position, and allowing the caisson/casing 1 to be re-used.

The structural elements placed inside the caisson/casing 1 can be made from concrete, steel or any other material, and may include reinforcing made from fibre glass or non-corroding reinforcing material.

The structural element can be provided with a drain hole, or drainage holes.

The drainage holes in the structural element can be provided with a strip drain. The strip drain can be protected by geo fabric.

The structural element can be provided with a lifting eye, or lifting eyes so it can be lifted and deposited into position in the caisson/casing 1.

The structural element can be provided with a grout tube, or tubes to allow grout, or other medium, to be pumped to the base. The grouting can be done before during or after the withdrawal of the caisson/casing 1.

The structural element can be provided with a void or a multiple of voids to allow a jet grouted pile, or piles to be constructed below the element.

The structural element can be provided with a void, or voids to allow the installation of a grouted rock dowel, or dowels below the element. The structural element can also be provided with reinforcement bars to allow attachment of a capping beam. The structural element can also be provided with cast in place penetrations, i.e. through apertures, to allow the reinforcement bars to be grouted in place after casting.

After the structural element is placed in the caisson/casing 1, a free flowing material either granular or liquid can be placed in the caisson as it is withdrawn to fill the void left by the caisson/casing 1. The caisson or casing could alternatively be left in situ, as a final structural element. Furthermore, the caisson or casing could also be used as formwork, to e.g. form or cast in place a concrete structural element.

What is positioned inside the caisson/casing 1, after it has achieved a desired depth, as described above, has not been described in any detail, nor illustrated, as these aspects are not part of the invention described in this specification, and further will be commonly and widely known by a person skilled in this art.

Illustrated in FIG. 11 is a manual release system to separate the drilling assembly 3 from the caisson/casing 1. In this manual release system, the lifting assembly 12 comprises a lifting cable that connects to a lifting flange 12.1. The left side of FIG. 11 shows the system when the drilling assembly 3 is locked by latches of the latch assembly 10 to latch holes 11 thus locking the two together. The lifting flange 12.1 has a lifting bolt 12.3 which passes through an upper frame member or component of the drilling assembly 3, and is secured in place with an intervening compression spring 12.2, washer 12.4 and nut 12.5. The lifting flange 12.1 has a pivot connection 10.3 to pivotally connect the latch body 10.1, and the latch body 10.1 is pivotally connected by pivot 10.2 to the mounting plate 10.4 which is secured to the drilling assembly 3. Thus, according to the right hand side of FIG. 11, when the lifting assembly 12 applies sufficient force to the lifting flange 12.1, so as to overcome the spring force of the spring 12.2, this will move the bolt 12.3 upward relative to the drilling assembly 3, which causes a rotation of the latch body 10.1 around relatively stationary pivot 10.2, thus withdrawing the latch out of latch hole 11, thus allowing the drilling assembly 3 being able to be withdrawn from and relative to the caisson/casing 1.

Illustrated in FIG. 12 is a caisson/casing 1 and drilling assembly 3, which is similar to that of FIG. 9, and like parts have been like numbered. The difference is that the drilling assembly 3 is able to be moved downward relative to the caisson/casing 1, by means of spaced hydraulic or pneumatic cylinders 100, which push or pull against the lifting assembly 12, which is held in place by the latches of the latch assembly 10 in latch holes 11 in the caisson/casing 1. The same pushing and pulling force could be provided by a similar apparatus external to the caisson or casing 1. At a desired depth, the cylinders 100 are energised to extend so as to push (or pull) the drilling assembly 3 downward. By retracting the cylinders 100, the caisson/casing 1 can be pulled downward into the drilled hole. Then the drills active again, pushed downward by the extending cylinders 100 etc.

It will be noted from FIGS. 1 to 11 that the body of the drilling assembly 3 is of a shape and size which effectively, or substantially, closes off the opening formed by the inner periphery of the caisson or casing 1. This is the case whether the caisson or casing 1 is of a rectangular or curved shape, or whether of a more complex shape such as an arc or T-shape.

It is to be noted, from the embodiments depicted, that there are two or more drilling heads used to create an area that generally overlaps with the opening or footprint of a caisson or casing having a single opening.

FIGS. 13.1 to 13.3 depict a method of grouting the vertical spaces between inserted precast panels. FIG. 13.1 shows a casing or caisson 1 which is advancing downwardly, aided by the action of the drill bits 4. As discussed previously, once the drilling bits 4 and caisson/casing 1 advance to the required depth, the drill bits 4 are retracted and removed. The caisson or casing 1 supports any pre-existing sea-walls nearby or adjacent, while a preformed structural panel 17 is inserted into the caisson/casing 1, before the caisson/casing 1 is removed. When this process is repeated and a further panel is inserted adjacent the first panel, a gap in the form of a vertical space 17.1 will be left between the panels 17.

To seal or close the gaps 17.1, the panels 17 will be grouted. To do this, a stocking 18 is placed over a grout line 19 to be inserted in a gap 17.1 between the panels 17. The stocking 18 can be chosen from materials such as canvas, plastic, any appropriate nylon, or geo-textile. The grout line 19 is then pushed to the bottom of the gap 17.1. As the grout material is being pumped into the gap 17.1, the grout line 19 is withdrawn. As shown in FIG. 13.2, the panels 17, on their vertical side edges, have grooves or formations. As the grout is pumped, the material conforms to the space formed by the grooves or formations between adjacent panels 17, and forms a key 20 between adjacent panels 17.

FIGS. 14.1 to 14.3 depict a method of grouting the toes or lower portions of the structural panels 17. The drilling assembly 3 and the caisson/casing 1 are larger than the panels 17. Therefore, after the caisson/casing 1 is withdrawn, the panel 17 is encapsulated by the disturbed ground. Grouting the toes or lower portions of the panels 17 in the ground will enhance the stability of the panels 17. A grout tube 21 is precast in each panel 17. The grout tube 21 runs the whole length of height of the panel 17. Grout 22 is pumped into the grout tube 21. The grout 22 used for toe grouting generally has a specific gravity of approximately 2, which is higher than the specific gravity of the disturbed, plasticised, worried, or fluidised portion of the friable ground. As the grout 22 is denser than the disturbed, plasticised, worried, or fluidised ground, the pumped grout will displace the disturbed ground to encapsulate the corresponding panel 17. The grout 22 is pumped after the casing is taken out to at least the desired grout height. The volume of the grout 22 to be pumped will therefore be determined by the difference between the desired grout height multiplied by the difference between the cross-sectional area of the resulting hole and the cross sectional area of the panel. Once this is done, the grouting procedure of FIGS. 13.1 to 13.3 can be employed to key in or lock adjacent panels together.

As shown in FIGS. 15.1 to 15.3, in some situations, one or more of the panels will be placed over rocks or hard-ground 24 which is not friable or not friable enough. The caisson/casing 1 will not sink into the hard ground 24. A panel 17 suitable for placement over hard ground 24 can have cast into it a penetration 23, i.e. a through aperture. The penetration 23 is usually centrally located with respect to the panel 17. The rock cutting drill bit 4 is then operated to drill a hole 25 into the hard ground 24 through the penetration 23, so that a hole 25 is drilled to coincide with the penetration 23. A reinforcement dowel 26 can be placed into the hole 25, and grouted in place through the grout line 27 which extends to the bottom of the hole 25.

Any reinforcements are preferably of a non-corrodible type material, such as glass fibre, reinforcing carbon fibre rods or stainless steel, etc.

FIGS. 16.1 to 16.6 depict securing or casting a capping beam 28 to the tops of the structural panels 17. As shown in FIGS. 16.1 to FIG. 16.3, the structural panels 17 can have blind apertures or penetrations 29 accessible from the tops of the panels 17 Separate reinforcement bars or dowels 30 adapted to be partially received by the blind apertures 29 are grouted into place in the apertures 29. Alternatively, the panels 17 can have reinforcement bars or dowels 31 cast into them. A capping beam 28 which has been pre-cast is then attached to the dowels 30, or alternatively the capping beam is cast onto the dowels 30. The capping beam 28 will have holes which correspond to the reinforcement bars 30, 31. The reinforcement bars 30, 31 are fitted into the corresponding holes in the capping beam 28 as the capping beam 28 is attached. FIG. 16.4 depicts the reverse scenario, where inserted dowels 30 or precast dowels 31 are provided in a pre-cast capping beam 28. The capping beam 28 is then attached to the panels 17 which have the required apertures to accept the dowels 30, 31.

More preferably, as shown in FIG. 16.5, the capping beam 28 can cast directly into a formwork provided around the tops of the panels 17, in which case the capping beam 28 will be cast around the inserted dowels 30 (or, in other examples, the precast dowels 31) and the panels 17. As shown in FIG. 16.6, it is alternatively possible to cast a capping beam 28 onto the panels 17 or attach a precast beam 28 to the panels 17, and then drill securing bolts to secure the beam 28 and panels 17 together.

FIGS. 17.1 and 17.2 depict concrete caissons or casings 1 that are formed with reinforcements 1.3 and that are left in situ rather than removed, after the drilling assembly 3 has been retracted. The caissons are left as structural elements. The caisson/casing 1 may or may not have a structural core. It can be left in situ as a structural element itself, or it may have a cast in place concrete structural core 1.2 that is formed inside the caisson 1.

Referring to FIGS. 18.1 to 18.2, the panels 17 or capping beams 28 further include anchoring ties 32 to stable land which is adjacent the panels 17. In FIG. 18.1, holes are drilled into the adjacent stable land to insert the ends of the ties that are distal from the panels 17. The proximal ends of the ties are bolted or otherwise secured to the capping beams 28 or panels 17. The anchoring ties 32 helps secure the panels 17 against the weight of the friable land pushing directly or indirectly against the panels 17. In FIG. 18.2, the panels 17 are installed next to wall members 17.2 which are pre-existing and deteriorating, with the panels 17 being put in place to shore up or take over from the old pre-existing retaining panels 17.2. In this case, an old anchor 32.2 is already in place and tied to adjacent land. An extension 32.1 is linked to the old anchor 32.2 to extend the tie 32 to the capping beam 28 for the new panel 17. The extension 32.1 can be precast into the beam 28, or the capping beam 28 for the new panel 17 is post tensioned to the existing capping beam 28.2.

FIGS. 19.1 to 19.4 depict the movement of the bed dirt, mud, or other matter which is displaced by the drilling assembly 3. As discussed before, as the drilling assembly 3 drills into the friable ground, the weight of the caisson/casing 1 enables the caisson 1 to sink down to the drilled level. As mentioned above, the caisson 1 is also able to sink because the cuttings tend to be displaced upwards. Together the actions and weight of the drilling assembly 3 and caisson 1 progressively cause portions of the friable ground to become plasticised, which allows the action of gravity to sink the caisson to a desired depth.

The assembly 3 and caisson 1 displace the disturbed or drilled matter 33, which tends to accumulate upwards as shown in the arrows included in FIGS. 19.2 and 19.3. The arrows of FIG. 19.3 depict the process whereby, as the caisson and drilling assembly advance deeper into the hole, more disturbed or drilled matter 33 is accumulated upwardly. The previously displaced cuttings or matter is pushed upwards by newly displaced matter. Once the drill assembly is retracted, and a structural element such as a panel 17 is inserted into the caisson 1, the caisson can be removed. Upon the removal of the caisson 1, the previously piled displaced matter 33 (if toe grouting is not done) now flows downwardly, in the direction indicated by the arrows in FIG. 19.4, to fill the space vacated by the caisson 1. Due to the friable nature of the environment, the drillings and cuttings are plasticized. Therefore, there is no requirement to actively pump the bed matter out of the drilled hole to prevent blockage.

Referring to FIGS. 20.1 to 20.8, in some circumstances, the depth of the hole to be drilled will be greater than the length or height of a caisson 1 that can be used with the drilling equipment. In this situation, additional caissons 1' can be added to follow the initial or leading caisson 1 which has been inserted or partially inserted into the hole, in an end-to-end fashion. Here, the attachment of the caissons 1, 1' is done whilst the trailing edge of the first inserted caisson 1 is still accessible. Preferably, the neighbouring caissons 1, 1' will be attached together. This way, the plurality of caissons 1, 1' is able to be removed in a single operation. The skilled person will appreciate that more caissons can be added for insertion into holes of greater depths as needed.

FIG. 21 is a schematic view of one manner of attachment between neighbouring caissons. As shown, the lower or leading caisson 1 has a rim, flange, bead, or generally a projection 34 around its trailing edge. The adjacent, subsequently inserted caisson 1' which trails the other caisson 1 includes a cooperating projection 35 at its leading edge. The cooperating projection 35 includes a groove 36-1, 36-2 which is adapted to receive the trailing projection 34 of the previous caisson 1. The upper or subsequent caisson 1' is further constructed from two halves 1'-1, 1'-2, respectively having the grooves 36-1, 36-2. The two halves 1'-1, 1'-2 are two vertical halves of the subsequent caisson 1'. The halves 1'-1, 1'-2 have a vertical parting plane S and are initially spaced apart from each other. The vertical halves 1'-1, 1'-2 are moved toward the trailing edge of the first or previously inserted caisson 1, then closed toward each other and onto the previously inserted caisson 1, so that the grooves 36-1, 36-2 together are fitted onto the projection 34, attaching the caissons 1, 1' together. The two vertical haves 1'-1, 1'-2 of the subsequent caissons 1' can further be secured together by e.g. bolts. The skilled person will appreciate that although the subsequent caissons or casings 1' are described as having two half sections, they can each be constructed of three or more vertical sections, and then assembled in the manner described above.

When the caissons 1, 1' need to be removed, the upper most caisson 1' is hooked or otherwise attached to a lifting device, and then both caissons 1, 1' will be lifted together because of the attachment between the caissons 1, 1'.

The caissons 1, 1' can have identical features—that is each caisson 1 has a leading projection 35 and a trailing projection 34 as described above, and is constructed from two vertical halves. This construction allows the subsequent caisson 1' to be added unhindered by the support or cables for the drilling assembly. Alternatively, the skilled person will appreciate that the first inserted caisson does not need to have a leading edge projection 35 or be constructed from multiple sections.

While the preceding passages describe prior art systems, these systems are particularly useful together with the following inventive aspects and embodiments, as described below with respect to FIGS. 23 to 50.

In broad terms, the embodiments illustrated in FIG. 24, FIG. 28, FIGS. 32 to 34 and FIGS. 51 to 62, all provide a caisson or casing 107 for installing a sheet or sheet pile 102 into a ground or underwater location, the caisson 107 having a shaped wall 107.1 which is open for a predetermined length, which is adapted to receive and connect to an excavation means 3 within the confines of the caisson or casing 107.

The shape of the shaped wall 107.1 will be dependent upon the sheet pile or other retaining wall element that needs to be positioned in ground or under water location. The shaped wall can be made from any number of wall segments needed to match the shape of the sheet pile being installed. So, for the shaped wall 107.1 of FIG. 24, there are segments 107.2 to 107.10, while shaped wall 107.1 of FIGS. 32 to 34 have segments 107.2 to 107.8, and the shaped wall 17.1 in FIG. 38, is made from three segments 107.2 to 107.4. In the case of the FIGS. 24 and 32 to 34 shaped walls, these almost entirely match the shape of the sheet pile 102 being installed.

The shaped wall 107.1 has its free sides A and B each having a clutch, and a connection section or piece (or connecting section or piece) 125 or 111, in the case of the systems of FIGS. 24, 30, 38, 50A and 69 is provided which closes the caisson 107 and or the shaped wall 107.1.

The connection section 125 or 111 (as seen in FIG. 30) can have a first wall portion 125.1 with a mating clutch 125.2 and 125.4 to join with the clutches at the free sides A and B of the shaped wall 107.1.

The connection section 125 of FIGS. 24 and 38 also include a second wall portion 125.10 which is at an angle to the first portion and which terminates in at least one element mating join formation or clutch, in this case a third clutch 125.11 which is adapted to engage the free clutch at a side of a sheet or sheet pile 101 previously inserted in the ground or underwater location.

The connection section 125, as in the case of FIG. 38, is a sheet pile, which is adapted, in use, to be separable from the shaped wall 107.1.

The connection section 125, in the case of FIG. 38 has a first clutch 125.2 and a second clutch 125.4, the first clutch 125.2 located at a side of the connection section 125 and the second clutch 125.4 located intermediate the free sides 125.10 and 125.1 of the connection section 125, so that the first and second clutches 125.2 and 125.4 are adapted to connect to the two clutches at the free sides A and B of the shaped wall 107.1.

The connection section 125 has the element mating join formation or clutch 125.11 located at the other side of the connection section 125 from the first clutch 125.2, with the element mating join formation or clutch 125.11 being adapted to engage a free clutch being at a side of a sheet 101 previously inserted in the ground or underwater location.

The element mating join formation or mating clutch 125.11 on the connection section 125, by being adapted to engage a free clutch on a sheet 101 previously inserted in the ground or underwater location, is adapted to act as a guide to guide the caisson or casing 107, and an excavation means 3 combined therewith, as excavation or drilling occurs.

The element mating join formation or clutch 125.11 is adapted to be located outside an excavation footprint 108 of an excavation means which is at the end of the caisson or casing 107, but remains within the excavation footprint 105 of the ground disturbed when placing sheet 101.

The caisson or casing 107, as best illustrated in FIGS. 24A, 30A and 39 have a releasable locking mechanism 300 which allows releasable interconnection between the connection section 125 and the shaped wall 107.1.

The locking mechanism 300 can include any lock mechanism, such as a pin means like shear pin 126, which sits in aligned apertures passing through mating clutches on the shaped wall 107.1 and the connection section 125, in which case it will be a clutch locking mechanism, which can be removed when needed. The apertures can be of any appropriate shape, and the pin can simply match that shape. However, this is not preferred due to the importance of the clutch allowing relative sliding motion. Alternatively, and more preferred, as illustrated in FIGS. 24A, 30A and 39 one of the connection section 125 or the shaped wall 107.1 can be provided with a flange portion 125.13 provided to receive the removable pin 126. The locking mechanism 300 is preferably at the top and/or bottom of both ends of the shaped wall 107.1 so that when it is upended, a lock between the clutch on the shaped wall 107.1 and the sheet or sheet pile 102/103 can be effected.

The caisson or casing 107 when combined with an excavation means 3 can be adapted to allow the excavation means 3 to provide an excavation footprint 108 which can overlap an excavation footprint 105 related to the sheet 101 previously inserted in the ground or underwater location.

After the caisson or casing 107 has been positioned in the ground or underwater location, the connection section 125 is separable from the shaped wall 107.1, by the mechanisms described above.

The shaped wall 107.1 is adapted so that a sheet 102 can be made to engage the clutch of a previous sheet 101, and pushed or hammered or vibrated into position.

The shaped wall 107.1 is removeable from the ground or the underwater location, after the sheet 102 is positioned.

The drilling assembly as described in relation to FIGS. 1 to 22 can be combined with the caisson or casing 107 of FIGS. 23 to 50.

The excavation means 3 substantially closes off an opening formed by an inner periphery of the caisson or casing 107, even though in the embodiment of FIGS. 32 to 34, there is an open side to the caisson or casing 107.

As best illustrated in FIGS. 24 and 38 there are multiple excavation means (or drills or drill bits) 109 used for the caisson or casing opening.

The excavation means 109 excavates hard ground or drills hard ground, allowing the caisson or casing 107 to be positioned to a predetermined or required depth.

As the connection section 125 has to be separated from the shaped wall 107.1, there needs to be provided means, such as releasable lock means, including the latch assembly 10 described above, which can disconnect them. The connection section 125 preferably does not connect to the excavation means 3 or releasably connected to the excavation means 3.

It may be preferred that the excavation means 109 to be associated with the caisson or casing 107, be connected to or supported only by the shaped wall 107.1.

When installing the "first" sheet pile 101.1, as best illustrated in FIG. 30, then either a first caisson 107 shaped and sized specifically to accept the first sheet pile 101.1 can be utilised. In a first example the sheet pile 101.1 will be a standard width sheet pile, and the caisson 107 of FIG. 30 having increased dimensions when compared to that of FIG. 24 which is being used to install a subsequent sheet pile. Alternatively, the same caisson 107 from FIG. 24 can be used, but a first sheet pile 101.1 can provided which has a reduced width, so that the sheet pile 101.1 fits within the caisson 107 and connection piece 111.

As is described above in respect of FIGS. 1 to 22, the embodiments of FIGS. 23 to 50 are constructed so as to attach an excavation tool 3 within the lower end of the caisson 107. The tool 3 is shaped to fit inside the caisson 107 being used. The tool 3 consists of two or more drill bits (which may not be expandable) or two or more expandable drill bits 109 arranged so as in their expanded state they excavate beyond the boundary of the caisson or casing 107.

The drill bits 109 are provided with a means of flushing the hole with a fluid. The fluid may be, water, polymer, mud or any other suitable fluid. When rotated in the expanded state the drill bits will allow the caisson 107 to advance to the required depth, through hard ground, without noise or vibration.

When the required depth is reached the expandable drill bits are returned to their retracted state. In this state they are contained entirely within the caisson 107. The tool 3 can then be detached and removed from the caisson 107.

When the tool 3 has been removed, in the manners described above with respect to FIGS. 1 to 22, the first sheet 101 or sheet pile 101.1 can be placed to the correct depth inside the caisson 107.

When the first sheet 101 being full sized positioned by the caisson 107 or first sheet pile 101.1 being of reduced size positioned by the first caisson 107, is in place, then caisson 107, or the first caisson 107, can be removed and a second caisson 107 will now be required, due to the change in shape of the sheet pile 102. The second caisson 107 is shaped so as to accept the second sheet 102. The second caisson 107 is also shaped to fit the tool 3. The second caisson 107 can be in two parts, a connection section 125 and a main body or shaped wall 107.1. The connection section 125 can be attached to the first sheet 101 or sheet pile 101.1 by the clutch and to the body by two clutches 125.2 and 125.4 or by other convenient means.

In the systems of FIGS. 23 to 37, the connection section 125 of the caisson 107 attached to the first sheet 101 is removed leaving the body or shaped wall 107.1 of the caisson 107 in place.

With the connection section 125 and the tool 3 removed, then a second sheet 102 can be attached to the first sheet 101 and placed to the correct depth. With the second sheet 102 in place the shaped wall 107.1 of the caisson 107 can be removed.

If in the installation of the piles a smaller first sheet pile 101.1 is used then the first caisson can now be re-used to install a third pile. Or if a first caisson and second caisson have already been used, then a third caisson 107 will now be required. It will be similar to the second caisson 107 but a mirror image. This caisson 107 is shaped to fit the third sheet 103.

The third caisson, as described above is advanced, without noise or vibration, and the tool 3 removed.

The third sheet 103 can be attached to the second sheet 102 and placed to depth. The third caisson 107 can then be removed.

By repetition of the steps described above a sheet pile wall can be constructed in hard ground without noise or vibration.

Those skilled in the art will understand that utilising several caissons 107 and possibly multiple drilling tools 3 will slow down the installation process. Whereas it can be speeded up if the process used a single tool and a single caisson assembly. The connection section 125 of the second caisson could be replaced by a blank part so that the assembly took the shape of the first caisson, or something similar.

Alternatively, the shaped wall 107.1 can be constructed so that the second caisson 107 could be turned upside down, thereby allowing it to take the shape needed for the of the third caisson assembly. Likewise if the tool 3 is constructed symmetrically about its minor axis it will fit both a right hand and a left hand caisson.

Those skilled in the art will understand that sheets can be fabricated with the clutch misaligned. This will allow the next sheet to be placed at an angle to the XX axis. By this method sheet pile walls, other than straight can be constructed.

After the sheet piles 101, 102, 103 etc. have been placed in position, the base of the sheets 101, 102, 103 etc. can be grouted into the hole that has been drilled. A polymer or bentonite drill fluid will greatly assist this process. This grouting should take place some distance behind the advancing pile wall under construction and should not be allowed to impinge on the drilling of the caisson for the next sheet.

While the following description is in respect of one section of sheet pile it will be readily understood that the present invention can be applied to other sections.

While the following description is in respect of placing one sheet at a time it will be readily understood that the present invention can be applied to install multiple sheets at one time.

FIG. 23 shows three sheets 101, 102 and 103 connected by clutches 104. The sheet pile 101, 102 and 103 in this instance is Larsson type 755 sheet pile. For the purpose of this description the sheets 101, 102 and 103 are to be installed in numerical order. The longitudinal axis XX is shown for reference FIG. 24 shows the first sheet 101 in place. The boundary of the ground disturbed or drilled during the installation of the first sheet 101 is shown by the intermittent line 105. The connection section 125 of the caisson 107 attaches to the first sheet 101 by clutch 125.11 which connects to the clutch 104 on the first sheet 101. The other end of connection piece 125 connects to the body or shaped wall 107.1 of the caisson 107 by two clutches 125.2 and 125.4 to the clutches at the ends of the free sides A and B.

In FIG. 24, a drilling tool 3 is shown attached inside the caisson 107. The attachment of the tool 3 to the caisson 107 is not shown, but is as described above in relation to FIGS. 1 to 22. Four drills 109 with expandable drill bits are located within the tool 3. The footprint 108 is the limit of the ground disturbed by the drill bits 109 in their expanded state. It should be noted that the connection section 125 has its clutch 125.11 beyond the boundary of the disturbed ground within footprint 108 but it is inside the boundary of the previously disturbed ground 105. It should also be noted that the footprint 108, that is, the limit of the expanded bits, passes close to, but does not interfere with the first sheet 101. The tool 3 is symmetrical about the minor axis YY. The inner void of the caisson 107 is shaped to match the symmetry about the axis YY, but is not actually symmetrical. This relationship and arrangement allows the caisson 107 and the tool 3 to be used when the caisson 107 is in a mirror reverse configuration. This will be necessary to place sheet 103.

For the purpose of the following description the caisson 107 will be viewed along the YY axis from the point it coincides with the XX axis. FIG. 24 is thus described as a caisson 107 with a right hand interconnection. A caisson 107 with a left hand connection will be required to place sheet 103. The caisson 107 with the tool 3 attached and the expanding bits 109 in their expanded state, extending to the footprint 108, can now be drilled to the required depth.

FIG. 25 shows the caisson 107 after it has been drilled to the required depth and the interconnecting connection section 125 removed. The tool 3 has been collapsed so that it is now contained within the caisson 107. In this state the tool 3 can be detached and removed from the caisson 107.

FIG. 26 shows the caisson 107 with both the interconnecting connection section 125 and the tool 3 removed. The caisson 107 can now accept sheet 102.

FIG. 27 shows the second sheet 102 connected to the first sheet 101 inside the empty caisson 101. The sheet 102 can then be pushed to the correct depth. The caisson 107 can then be removed.

FIG. 28 shows the second sheet 102 connected to the first sheet 101 and the caisson 107 removed.

FIG. 29 is similar to FIG. 24 but the assembly is now a caisson 107 with a left hand interconnection shaped to accept sheet 103. The change in handedness can be provided either by turning both the caisson 107 and the connection piece 125 upside down or it could be a purpose built caisson. Note that because the void in the caisson 107 is symmetrical about the YY axis, the tool being also symmetrical about the YY axis will fit inside the caisson 107 as before, once it has been rotated through 180 degrees.

The process of drilling the caisson 107 to the correct depth, removing the connection piece 125, detaching and removing the tool 3, placing the next sheet 103 and removing the caisson 107 can now be repeated.

FIG. 30 shows the caisson 107 with a blank connection piece 111 in place drilled to depth and the tool 3 removed. This caisson 107 can be manufactured in one piece but in this configuration it could be used to place the first sheet 101. The purpose of the blank connection piece 111 is so the caisson 107, in conjunction with the tool 3, can be used to place sheets 101 and subsequently with connection piece 125 of earlier figures, used to place the second sheet 102 and third sheet 103. The fabricated first sheet 101 is shown inside the caisson 107. The caisson 107 and the connection piece 111 can be withdrawn leaving the sheet 101 in place to the correct depth.

FIG. 31 shows the closure of a sheet pile wall. A fabricated connecting piece 114, which may be a fabricated sheet pile piece, is used to connect sheet 112 to the last full sheet 113 both positioned in the ground. The fabricated connecting piece 114 is able to be placed because the disturbed ground shown by the intermittent lines 115 and 116 overlap. To arrive at this position sheet 113 may have to be fabricated with a reduced width as sheet 101 or sheet pile 101.1 in FIG. 30.

FIG. 32 is similar to FIG. 27 except it shows a caisson 107 shaped to accept a different sheet pile section, in this instance Larsson type ZK 675 sheet pile. The caisson 107 is shown with the connecting piece 125 removed. The sheet 102 is shown connected to the previously placed sheet 101.

FIG. 33 shows a caisson 107 shaped to accept Larsson type ZK 675 sheet pile. This caisson 101 is open sided, with no connecting piece being used. In certain types of ground this may be possible.

FIG. 34 shows a caisson 107 shaped to accept Larsson ZK 755 sheet pile.

This caisson 107 is open sided, in that between the ends A and B it is open, but are shaped to be directed inwardly to the sheet pile 101, to more closely fit to the previously placed sheet 101. If desired, the sheet pile 101 can have welded or attached locating blocks or locating flanges 101.2 and 101.3, so as to provide a guide for the inward ends A and B to travel between. In certain types of ground this may be possible, and is expected to work effectively, when the sheet pile is installed shortly after the drilling has been completed.

As can be seen from the above description, in broad terms there is described a method of inserting a sheet or sheet pile 102, 103, the method including: providing a caisson or casing 107 as described above; providing an excavation means 3 which is expandable to excavate and retractable to within the confines of the caisson or casing 107; utilizing an earlier installed sheet pile 101, 101.1 a drilling guide or if the caisson or casing is open, overlapping the excavation area of the new sheet pile 102 with that of the earlier installed sheet pile 101; installing a sheet pile 102 or 103 by means of the caisson or casing.

The method described above includes the use of a connection section 125 or 111 to close the caisson or casing or shaped wall 107.1.

The connection section 125 enables the caisson or casing 107 to be guided by the earlier installed sheet pile 101. As illustrated in FIG. 50A it can be seen that the connection section 125 could also be constructed from a V-shaped type of construction where the free legs include the clutches 125.2 and 125.4, and the vertex of the V has the clutch 125.11 extending from it.

The connection section 125 as in the case of the embodiment of FIG. 38 also acts as a sheet pile 102 and remains in the ground or underwater location.

FIG. 35 shows previously placed sheet 101 which has penetrated a hard layer of ground 117. The caisson 107 attached to sheet 101 has drilled through the hard ground 117 and with the tool 3 (not shown) removed, and can now accept the next sheet 102 (not shown on the drawing). Once placed through the hard ground inside the caisson 107, the sheet 102 can be placed to depth by conventional means—that is, this apparatus is such that it does not require the caisson 107 to move down further. Ground level 118 is shown.

FIG. 36 shows a caisson 107 which has drilled through a layer of soft ground 121 and then into a hard sea bed 119. Water level 120 is shown.

FIG. 37 shows the sheet pile 102 which has been place through the caisson 107. After the caisson 107 has been removed grout 122 can be pumped to the bottom of the drilled hole in the seabed 119. The sheet 102 is now grouted into the drilled hole in the seabed 119. The pile 102 is now able to support the ground 121. Up to ground level 118. Water level 120 is shown.

Illustrated in FIG. 38 is another sheet pile installation system and method.

The caisson 107 is effectively constructed in two halves. The first half being a shaped wall 107.1 to accept the drilling tool 3. The second half being a connection section 125, which will also be the sheet 102 to be installed. A clutch 125.4, or other means of attachment, must be adhered or riveted in the case of some sheet pile material, or welded if steel or aluminium, or by sheet bolts in the case of GFRP, to one side of the connection piece 125 or sheet to be installed. The first half of the caisson 107, comprising the shaped wall 107.1, will attach to the second half, comprising the connection piece 125, by this clutch and the existing clutch on the other side. The two halves now forming one caisson can be attached to the clutch 104 of the previously placed adjacent sheet 101, by means of the clutch 125.11 located on the end of the sheet pile 125/102. As before the drilling tool 3 is shaped to fit inside this caisson 107.

FIG. 38 shows a section of clutch 125.4 welded to one side of the sheet to be placed 102. This clutch 125.4 can be continuous or it can be intermittently present and engaging depending upon the application. The sheet to be placed 102 is attached to the previously placed adjacent sheet 101. The shaped wall 107.1 or caisson half is attached to the sheet 102 to be placed by both the welded clutch section 125.4 and the existing clutch on the other side. The two halves now form one caisson. Inside this caisson 107 is the drilling tool 3 with four expandable drills 109, with the drilling tool 3 being attached to the lower end of the caisson 107. When the drilling tool 3 is in the expanded state the boundary of the ground disturbed within footprint 108 is beyond the caisson 107. The caisson 107 can now be drilled to depth. When the caisson 107 has been drilled to the correct depth the expandable drill bits 109 can be collapsed. When the bits 109 have been collapsed both the drilling tool 3 and the caisson half or shaped wall 107.1 can be withdrawn separately or in unison. The result being that the sheet 102 has been positioned in the required place.

The caisson half or shaped wall 107.1 is then upended and combined or attached to the next sheet 103 not shown on the drawing. As the drilling tool 3 is symmetrical about the YY axis, after it is rotated through 180 degrees, it can again be attached to the lower end of the caisson and the drilling process repeated.

As described earlier, the excavation means 3 is detachably attached to the caisson 107 or the shaped wall 107.1, and is preferably a drilling tool 3 comprised of two or more drill bits 109, such as expandable drill bits. In the expanded state the drilling tool 3 excavates beyond all, or substantially all, of the boundary of the lower end of the caisson 107. In the collapsed state the drilling tool 3 is contained wholly within the foot print of the hole or aperture through the lower end of the caisson 107. The excavation means 3 is positioned so as to close off all, or substantially all, of the lower end of the caisson 107. The excavation means 3 being detachably connected to the caisson 107 ensures that when attached to the caisson 107, the caisson 107 will advance as the tool 3 drills. When the drilling tool 3 is detached it can be removed from the caisson 107. The excavation means 3 will generally be provided with or connected to a source of flushing air, water, polymer, mud or a combination of any 2 or more of these.

Illustrated in FIGS. 41 to 50 is an excavation means 3 for use with a caisson or casing 1 so as to drill in front of the leading edge of the caisson or casing 1, particularly in hard ground. The excavation means has a body to mount at least two excavation tools 133 so that the two excavation tools 133 are distanced or spaced from each other so that the outside diameter 134 of excavation of the tools 133 are spaced from each other so that when the body 3 is rotated through 180 degrees, a series of overlapping excavations will result. The excavation means includes a detachable connection, as described above, to a caisson or casing with which it will be used. The advantage of the excavation means 3 is the ability to drill a shaped hole with less drill bits.

The excavation means 3 is a drilling tool or drilling tool assembly, and can include expandable drilling bits, and there can be an even or an odd number of bits or excavation tools 133, as is illustrated in FIGS. 91 and 92, or a single excavation tool 133 as illustrated in FIGS. 95 and 96. It will be noted in the case of the excavation or drilling assemblies 3 of FIGS. 41, 42, 91, 92, 95 and 96, that there is located one excavation tool 133 close to a side wall of the drilling assembly so as to be close to the side wall of the caisson or casing 1, but there is a larger spacing to the opposite side wall, from the only or last excavation tool 133.

In summary, FIGS. 43 to 50 show a method of drilling a caisson or casing 1, the method including the steps of: providing a caisson or casing 1; attaching to the caisson or casing an excavation means 3; advancing the excavation means 3 to excavate ground beneath the excavation means 3; withdrawing the excavation means 3 from the caisson or casing; rotating the excavation means through 180 degrees; reattaching the excavation means 3 to the caisson or casing 1; advancing the excavation means 3 to excavate ground beneath the excavation means 3 to produce a series of overlapped excavations into which the caisson or casing 1 can positioned.

The following will describe FIGS. 41 to 50 in more detail.

FIG. 41 illustrates a plan view of an alternative caisson 1 with a main body of a drilling assembly 3 located inside. The assembly 3 has two expanding drills 133, in their collapsed state, attached. The attachment of the drills 133 is asymmetrical. It will be noted that the caisson 1, is similar to that of FIGS. 1 and 2 above, except that in FIGS. 1 and 2 above show three drills 4, whereas the caisson 1 of FIGS. 41 to 50 has only two expandable drills 133 which are spaced apart, so that when rotated by 180 degrees, a series of four bores with outer diameters 134 and 135, as depicted in FIG. 42, will be drilled.

FIG. 42 shows the same plan view as that of FIG. 41, when the expanding drills 133 are expanded to their outer diameter 134 in their expanded state. The broken circles 135 illustrate the holes to be drilled next, once the drill tool 3 has been removed from the caisson, then rotated through 180 degrees, and drilling begins again.

Illustrated in FIGS. 43 to 50 is a schematic representation of the drilling process. FIGS. 43 and 44 is a schematic side elevation and a plan view respectively of a caisson 1 containing a drill assembly 3 with the expanding drills 133 in their collapsed state, which have not yet been locked to the caisson 1, and have not yet arrived into the position for the drill 3 and caisson to be detachably secured together. In the position of FIG. 43, the assembly 3 is ready to advance to the drilling location.

FIGS. 45 and 46 are similar to FIGS. 43 and 44, and show the drill assembly 3 after it has advanced, and with the drills in the expanded state. Once drilling occurs, two holes will be drilled which coincide with the drilling diameter circles of FIG. 46, and the holes will be spaced apart, whereby only part of the periphery of the caisson 1 will have a drilled holed underneath its leading edge.

Once the two holes have been drilled, the caisson and drill assembly of FIGS. 45 and 46 will then have the drill bits collapsed and the drill tool 3 removed from the caisson 1. The drill tool 3 once out of the caisson is then rotated through 180 deg. When viewed in plan view and placed back into the caisson 1, ready to be advanced.

FIGS. 47 and 48 shows the caisson and drill assembly 1 and 3 after the drill tool 3 has been advanced the second time. The drills 3 are then returned to their collapsed state and the caisson 1 advanced.

FIGS. 49 and 50 shows the caisson 1 advanced and the drill tool or assembly 3 collapsed ready to repeat the steps of FIGS. 43 to 50, but starting on the right side of the caisson.

Illustrated in FIGS. 51 to 57 is a sheet pile placement method and apparatus, similar to that described above. In this method the first sheet pile 101 is in position to a required depth in hard ground 119 having also passed through soft bed 121. It is called "first" only for the sake of ease of description, as it will be seen in FIG. 51 that the first sheet pile 101 connects to an even earlier unnumbered sheet pile. It will also be noted in FIG. 51, that the hard ground to the right of the base of the sheet pile 101 has been excavated by the earlier used excavation tool.

The second sheet pile 102 is connected to sheet pile 101 by their respective clutches, and the sheet pile 102 is pushed down through the soft layer 121 until its base reaches the start of the hard ground layer 119, as in FIGS. 51 and 52.

In FIG. 53 a shaped wall 107.1 and drill assembly 3, are assembled together with a trailing leg (or reaming leg) 3.1 which is preferably connected to the drilling assembly 3, but may be extending from the shaped wall 107.1. The shaped wall 107.1 has clutches 125.2 and 125.4 to engage clutches provided on the sheet pile 102 (such as described above in relation to FIG. 38), with the drilling bits 109, which are schematically represented by a single bit, being operated without expanding, and "drilling" through the soft bed 121, until it reaches the hard ground 119.

As seen in FIG. 54, once the hard ground 119 is engaged, the expanding bits continue to drill, until they pass sufficiently the lower end of the sheet 102, and then they are reversed and they slowly expand outwardly as they drill and undercut the leading edge of the sheet 102. The point at which the expanding bits 109 can be reversed and expanded is when an engagement end 3.2 on the trailing leg 3.1, engages the top edge 102.9 because the distance between the end 3.2 and the drill bit 109 has been set for the height of the sheet 102.

The end 3.2 also has the advantage that as the drill assembly 3 moves down the sheet pile 102, all the while being guided by the sheet 101, the sheet 102 follows the drill assembly 3 downward until, drilling is finished as in FIG. 55. Whereupon the drill assembly and shaped wall 107.1 and leg 3.1 and end 3.2 are withdrawn as in FIG. 56, and the sheet pile 102 grouted in place (once a further sheet along the wall has been installed), and then eventually, as in FIG. 57, the side where the ground level 118 is can be back filled to complete the wall construction.

This arrangement of FIGS. 51 to 57 has the advantage that the shaped wall 107.1 does not need to be locked to the sheet 102 by means of the clutches that are engaged, making the process quicker. Additionally the caisson or casing 107 formed by the shaped wall 107.1 and sheet 102, at the base of the sheet 102, assists to ensure that soft bed 121 does not rush to fill in the excavation foot print. It will be noted that the Shaped wall 107.1 is of a height greater than the depth of soft bed 121 and the depth of drilling into hard ground, thus keeping out soft bed material while drilling is occurring Illustrated in FIGS. 58 to 62 is a sheet pile placement method and apparatus, similar to that described above. In this method the first sheet pile 101 is in position to a required depth in hard ground 119 having also passed through soft bed 121. It is called "first" only for the sake of ease of description, as it will be seen in FIG. 58 that the first sheet pile 101 connects to an even earlier unnumbered sheet pile. It will also be noted in FIG. 58, that the hard ground to the right of the base of the sheet pile 101 has been excavated by an earlier used excavation tool.

In the method of FIGS. 58 to 62, as in FIGS. 58 and 59, a drilling assembly 3 and shaped wall 107.1 are operatively connected to a sheet pile 102, so that the drilling bits 109 when expanded are below the leading edge of the caisson 107 formed at the lower section of the sheet 102 by the joining of the shaped wall 107.1 to the sheet pile 102, by one of the means described above. The height of the shaped wall is provided so that it is higher than the depth to be drilled in hard ground 119 plus the depth of the soft bed 121.

In FIGS. 58 to 62, the drill bits 109 are schematically represented by a single drill bit 109. At the top 102.9 of the sheet 102 is a conventional sheet pile installation tool or piling equipment 139, which will drive the sheet pile 102 and drill assembly and shaped wall 107.1 through the soft bed 121, until hard ground 119 is encountered. The shaped wall 107.1 and drill assembly 3 are joined together, and the assembly of them is connected to the sheet 102 by a releasable latch mechanism 10 (such as that described above), which is shown I the locked condition in FIG. 59.

Thus, as the piling equipment 139 pushes the sheet 102 into the soft bed 121, so too does the shaped wall and drilling assembly follow. If needed depending upon the "viscosity" of the soft bed 121, the unexpanded bits in the drill assembly can be rotated in an unexpanded condition to help clear the path for the shaped wall 107.1 and the drilling assembly 3.

Once hard rock is reached the bits 109 are rotated so as to expand under the leading edge of the shaped wall 107.1 and the sheet pile 102, and continues to drill until the required depth is reached, as illustrated in FIG. 60. At this point, as illustrated in FIG. 61, the sheet 102 is at its required depth, and the piling equipment 139, by means of lifting assembly 12, and the disengagement of latch 10, lifts the drilling assembly 3 with the drill bits unexpanded and shaped wall 107.1, up along the sheet 102 and out ready for the next sheet. Then as in FIG. 62, grout 122 can be installed in both the soft bed 121 and hard ground layers 119, and the ground level 118 back filled to the wall so produced, but usually a few sheet back if back filling is progressing at the same time as pile placement is occurring.

Illustrated in FIGS. 63 to 74, is a sheet pile installation method and apparatus similar to that of FIGS. 24 and 29, except that the caisson or casing 107 and its shaped wall 107.1 has a modified shape, and the connection section 125 too is modified in shape. Additionally the drilling assembly 3 has some 5 drills to insert a sheet pile 102.

Illustrated in FIG. 63, the caisson 107 of FIG. 69 is combined by a latch 10 to the drilling assembly 3, preferably before insertion into the water 120. The caisson 107 and drill assembly 3 are then sunk to the hard ground layer 119 through soft bed 121. This can be done by pushing through the soft bed 121 or simply rotating the non-expanding drill bits 109 until hard bed 119 is reached, as illustrated in FIG. 64.

As illustrated in FIG. 65, the latch 10 is released allowing the drilling assembly to continue drilling through the caisson 107, until the desired depth of placement has been reached. It will be noted from FIGS. 64 and 65 that the height of the caisson 107 is greater than the depth below water level 120 of the hard rock layer 119. By this means water and softer bed 121 do not go back into the caisson protected area.

Once drilling to the required depth is completed, the drilling assembly 3 and latch 10 can be removed from the caisson 107, as is illustrated in FIG. 66, and then as in FIG. 67, the next sheet pile 102 joined to the earlier pile 101, and slid into position inside the caisson 107. The caisson 107 can then be withdrawn. Then as in FIG. 68, after the installation of sheets has progressed, the base hole can be grouted and the ground level back filled at appropriate time in the installation process.

As best illustrated in FIG. 69 the caisson 107 used in FIGS. 63 to 68 has a shape to receive 5 drills 109 which are non-expanding drill bit, and will have an excavation p footprint that will allow a sheet pile 102 to be installed before the caisson is removed, and after the drill assembly is disconnected and removed from the shaped wall 107.1. It will be noted that the connection section 125 has a curved wall shape at the ends of which are clutches 125.2 and 125.4, and at an intermediate location is attached clutch 125.11. It will be noted that the left hand most drill 109, has its left most excavation footprint overlapping the earlier drill footprint 105 associated with installed first sheet pile 101.

The connection section 125 is removed immediately before the sheet pile 102 is to be inserted as in FIG. 67, in which case the arrangement of FIG. 70 is adopted where the drilling assembly 3 has been removed and overleaping footprints 105 and 108 are present, leaving a generally open space for insertion of the second sheet pile 102 to be inserted in the caisson 107 by joining respective clutches to sheet 101, as illustrated in FIG. 71.

Then, as in FIG. 72, the caisson 107 is removed, being a step between FIGS. 67 and 68, the sheet piles 101 and 102 are sitting in their respective excavation foot prints. This will allow the sheet pile 101 to be grouted into position, while the caisson 107 (or the shaped wall 107.1 and the connection section 125) on the surface has been up-ended (that is rotated around a horizontal axis) and the drill assembly 3 has been rotated through 180 degrees around a vertical axis and re-assembled to begin to repeat the steps of FIGS. 63 to 68, this time appropriately oriented for the placement of sheet pile 103, as is illustrated in FIG. 73. The repeating of steps 63 to 68 will produce a wall segment as illustrated in FIG. 74, whereby the excavation foot print will have been grouted with grout 122 to secure the respective piles 101,102 and 103 into their holes.

Illustrated in FIGS. 75 and 76 is a method and apparatus for installing slidingly interlocking concrete panels 17, which have a male key 17.3 and female key or recess 17.4 at opposite ends. The method and apparatus is similar to that described previously in relation to sheet piles, and employs a generally rectangular open shaped wall 107.1, which can be closed off by a connection section 125 as illustrated in FIG. 76. The connection section 125 has a male key portion 125.11, which will engage recess 17.4 on an earlier positioned panel 17 to guide the drilling process. The drill assembly 3, will include expanding drill bits to drill ahead of the leading edge of the caisson 107, forming excavation footprint 108 which will overlap with the previously drilled footprint 105. Then like the method of FIGS. 63 to 68, the connection section 125 is removed, and the next panel 17 can be lowered into positon to join up with the earlier installed panel 17.

Illustrated in FIG. 77 is another method and apparatus for installing a concrete panel 17, similar to that of FIG. 75, except that no connection section 125 is used. Instead, the shaped wall 107.1 simply has an open end in which the right hand side of panel 17 can be located to assist with the guidance of the drilling process. As the shaped wall 107.1 is longer than in FIG. 75, the footprint 108 will readily overlap with footprint 105, allowing another panel 17 to be installed.

Illustrated in FIG. 78 is a method and apparatus similar to that of FIG. 77, except that the concrete panel 17 includes a vertical channel or recess 140 on each side of the panel 17 near to the end of the panel 17 which has the recess 17.4. The recess 140 is a guide recess to receive the turned in ends of the shaped wall 107.1, and in this way to act to assist in the guiding of the drilling process.

Illustrated in FIGS. 79 to 82 is method and apparatus for installing concrete panels 17, which are similar to that of FIG. 78, in that at one end they have vertical guide recesses 140 near one end, but are not interlocking. Additionally, the drilling assembly 3, does not utilise expandable bits, that is drilling occurs only within the confines of the shaped wall 107.1. The drill bits 109 are located at different heights as shown in FIG. 80, and as in FIG. 81, once the drilling assembly 3 has been removed, allowing a seme shaped panel 17 to be dropped into place in the shaped wall 107.1, abutting the previously inserted concrete panel 17. While no joining of adjacent panel 17 may be done under water, a capping beam 28 as described above, and other joining can be done above water level once the shaped wall 107.1 has also been removed as in the case of FIG. 82, where the panels 17 are ready to be capped.

In the case of each of the methods and apparatus of FIGS. 75 to 82, it is preferred to disconnect the drilling assembly 3 from the shaped wall 107.1, and to take out the drilling assembly 3 before dropping in the next panel 17. This allows the shaped wall 107.1 to keep out soft bed 121 from lowing into the drilled hole. However, if the apparatus of FIGS. 75 to 78 were used to drill into hard ground 119 only, that is there was not present a soft bed 121, the shaped wall 107.1 and the drill assembly 3 can be removed together, thereby saving time by saving process steps.

In broad terms, as illustrated in FIGS. 83 to 88 is an excavation means 3 and a caisson or casing 1 for insertion into soft bed or friable ground, with the excavation means 3 being able to excavate inside the opening or opening footprint of said caisson or casing 1. The excavation means 3 having a body to mount at least two excavation tools 4.2 or 4.2' so that a series of overlapping excavations with footprints 108 will result. The excavation means 3 includes a detachable connection to said caisson or casing 1.

There are one or a multiple number of excavation tools 4.2 or 4.2' illustrated in FIGS. 83 to 88, in this case two, which are distanced from each other so that the outside diameter of excavation of the tools are spaced from each other so that when the body of the drilling assembly 3 is rotated through 180 degrees, the excavation that occurs producing an overlapped excavation footprint 108. However, as illustrated in FIGS. 89 and 90, there can be an odd number of tools 4.2 or 4.2', or as is shown in FIGS. 93 and 94, a single excavation tool. It will be noted in the case of the excavation or drilling assemblies 3 of FIGS. 83 to 88, 90, 91, 93 and 94, that there is located one excavation tool 4.2, 4.2' close to a side wall of the drilling assembly 3 so as to be close to the side wall of the caisson or casing 1, but there is a larger spacing to the opposite side wall, from the only or last excavation tool 4.2, 4.2'.

The excavation means can be a drilling tool or drilling tool assembly 3.

The excavation means 3 can includes: only expandable drilling bits 4.2; or only non-expanding drill bits 4.2'; or a combination of expanding drilling bits 4.2 and non-expanding drill bits 4.2' where the expanding drill bits 4.2 when expanded have the same outside diameter of the non-expanding drill bits 4.2'.

There is also described a method of drilling a caisson or casing 1 in a soft bed or friable ground, whereby the method includes the steps of: providing a caisson or casing 1 and an excavation means or assembly 3 as described in the preceding four paragraphs. The method then allows for activating the excavation means 3 to excavate ground beneath said excavation means 3 so as to produce a series of overlapped excavations with footprints 108 within the opening or opening footprint of the caisson or casing 1, whereby the soft bed or friable ground allows the caisson or casing and the excavation means or drill assembly to move through it.

Describing now in more detail, illustrated in FIGS. 83 to 85 is another caisson or casing 1 and drilling assembly 3, which is similar to that of FIGS. 1 and 2 described above, except that there are four drill bits 4.2 which are expandable, but when expanded, are fully within the internal periphery of opening footprint of the caisson or casing 1. The bits 4.2 are arranged or spaced so that when expanded as in FIG. 84, they overlap, and occupy different height positions as depicted in FIG. 85. It will be noted from FIG. 84 that the overlapping of the drilling bits 4.2 occupies a substantial surface area of the footprint of the opening of the caisson or casing 1. Whereas when the drill bits 4.2 are contracted or retracted, they occupy the smaller diameter circles in FIG. 83, and this is reflected illustrated in the side view of FIG. 85. This caisson 1 and drilling assembly 3, is meant to perform its drilling operation wholly within the confines of the caisson's opening or opening footprint, and is particularly suitable where soft bed material is encountered or needs to have a for example a pre-case concrete panel 17, as depicted in FIG. 88.

Illustrated in FIGS. 86 and 87 is a caisson or casing 1 and drilling assembly 3, which is similar to that of FIGS. 83 to 85, except that the drill bits 4.2' are not expandable. In that respect it is also similar to the caisson and drilling assembly of FIG. 79, except that the caisson 1 of FIG. 86 has a fully bounded rectangular caisson or casing and thus does not directly act or be guided by the previous panel 17 whereas caisson or casing 107 of FIG. 79 has a shaped wall with an open section to interact with the previous panel 17. The drill bits 4.2' overlap each so that they are fully within the internal periphery of opening footprint of the caisson or casing 1. The bits 4.2' are arranged or spaced so they overlap, and occupy different height positions as depicted in FIG. 85. It will be noted from FIG. 86 that the overlapping of the drilling bits 4.2' occupies a substantial surface area of the footprint of the opening of the caisson or casing 1.

While not illustrated, if desired, the caisson 1 can have on its outer wall a shaped formation to engage the keyway formed at the end of the previously installed panel 17, so that the previous panel can guide the caisson or assist in locating it. Even without such a shaped guide formation, the abutting of the outside of the caisson 1 with the end of the previously installed panel 17, helps to space and/or locate the caisson 1 while drilling occurs.

While the embodiments of FIGS. 83 and 86 show expandable bits 4.2 and non-expandable bits 4.2', it will be understood that a combination of expandable and non-expandable can be utilised, providing the outer diameter of the expandable bit is equal to or approximately equal to that of the non-expandable bit's diameter.

The caisson or casings 1 and drilling assemblies 3 of FIGS. 83 and 86 will both produce an excavation footprint 108 as illustrated in FIG. 88, which is sized so as to receive a pre-cast concrete panel 17 therein, which is spaced from the earlier panel 17 on the left of FIG. 88. Once the caisson 1 is removed the space between adjacent panels 17 can be grouted or interlocking join piece inserted into the gap between the panels 17 to complete the shoring wall, as described above with respect to FIG. 13 to FIG. 16.

In respect of the embodiments of FIGS. 83 and 86, a typical outer diameter of the drill bits 4.2 when expanded or the bits 4.2' is 290 mm, with the first centre of rotation being spaced about 15 mm from the inside end wall of the caisson or side wall of its opening. Whereas the spacing between centres of rotation of the drill bits are about 208 mm apart, with the caisson 1 having an opening, or opening footprint, of about 940 mm by 315 mm, so as to provide an excavation footprint 108 which will receive a panel 17 of 175 mm×850 mm.

It will be noted that the improvement described above with respect to FIGS. 41 and 42 can be applied to the embodiments of FIGS. 83 and 86, in that a drilling assembly having two appropriately spaced drill bits 4.2 or 4.2', for locating at the first and third positions from the left of FIGS. 83 and 86 can be provided, and so that once drilling of two holes has occurred the drilling assembly can be removed and rotated around a vertical axis through 180 degrees, and then the holes at the second and fourth positions from the left drilled.

The above described embodiments relate to installing pile elements such as a sheet, or panel or a pile wall element. The same method and/or equipment as described above can be used, as illustrated in FIG. 97, with a pile element such as a pile modular wall elements 17, 17A and 17B, and their related sliding engagement system. These can be used as a modular wall elements per se, or if desired can be used to form an in-situ concrete formwork and panel, and utilises a similar method to that described above in respect of FIG. 75 to FIG. 78, in relation to the embedment of the pile element. Once all the pile modular walls elements 17 have been positioned then these form a pile wall or they can have appropriate reinforcing added and then filled by means of pumped grout, concrete or fibre reinforced concrete, or poured gravel to create the wall, with the formwork remaining in situ. Such modular wall elements and pile elements 17 are described in U.S. Pat. Nos. 7,628,570 and 8,033,759 which are incorporated herein by reference.

Thus the method of drilling and placement in respect of the embodiment illustrated in FIG. 97 comprises a first pile modular wall element 17 (or a series of 2 or more such elements joined together) is positioned within the boundary 105 of the ground disturbed or drilled by the drilling or excavation assembly 3 (not illustrated) which also positions a caisson 107, allowing the first pile modular wall element 17 to then be located into place in the boundary of the series of overlapping holes 105. Then, a connection section or piece 125, having two rear clutches 125.11 to engage the respective forward clutches of the first pile modular wall element 17, and forward clutches 125.2 and 125.4 to engage the clutches A and B respectively on the caisson 107, are assembled to the clutches A & B on the caisson 107 to which has been pre-assembled the drilling or excavation assembly 3 (not illustrated). The connection section or piece 125 by means of rear clutches 125.11 is fed into the forward clutches of the end of first pile modular wall element(s) 17 and the forward-most first pile modular wall element 17 will be clear of the arc of the cutter which is digging the rear section of footprint 108, with the assembly of drilling assembly 3, caisson 107 being guided in its ground engagement by the forward-most first pile modular wall element 17. When desired depth is achieved the drilling or excavation assembly 3 (not illustrated) is removed from the caisson 107, and so too is the connecting piece 125, allowing the rear clutches of pile modular wall element 17A to first be engaged with the forward most clutches of element 17 allowing the element 17A to be driven into place by either a bucket of an excavator or hammered into place. Once the element 17A is in place, then element 17B can be likewise installed. Alternatively elements 17A and 17B (or more) can be pre joined, and then driven into place as a sub-assembly. This system is then repeated until an assembly of pile modular wall elements 17 of desired length is formed. The pile modular wall elements 17A and 17B are represented in broken line-work as they are not positioned until the connecting piece 125 has been removed from engagement with the forward most end of the element 17.

During this assembly process, the lowermost end of the pile modular wall elements 17 are held in place by means of mud or other introduced sediment, while the upper ends are held in place by a locating falsework or temporary support or formwork which braces and secures the upper ends to their desired location. In such location if desired concrete can also be poured. This locating false work or formwork can also be used to tie in and/or form the capping beam 28, and to tie in the interconnecting anchors 32, 32.1 and 32.2 as seen in FIG. 18.2.

While the above description of FIG. 97 indicates the use of the connection section 125 having two rearwardly directed clutches 125.11, if desired, a modified arrangement can be utilized, such as that illustrated in FIG. 98, where an improved TRULINE modular wall element is extruded or formed with side located internal grooves or clutches 17.33. By having a purpose built caisson or casing 107 for the first wall element 17 (or assembly of elements 17) to be inserted, and having a second purpose built caisson or casing 107 as illustrated in FIG. 98, the wall of which terminates at each end with a respective inwardly directed clutch A and B, so as to be located outside the diameter of the cutters, will engage the clutches 17.33 on the, or the forward-most, wall element 17. By this means, the caisson 107 and drilling assembly 3 (not illustrated) can be guided in its drill process by the first wall element 17 or assembly of wall elements 17, and once the drilling assembly is retracted from the caisson 107, the space within the caisson 107 is able to received elements 17A and 17B either sequentially as single units, or as an assembly of wall elements. The element 17A connecting to element 17 in FIG. 98, can be like one used in FIG. 97, providing the front most element used is has side clutches 17.33 as is the case with element 17 of FIG. 98. An additional advantage of the grooves or internal clutches 17.33 is that the overall appearance of the wall element 17 is substantially unchanged.

As illustrated in FIG. 99, a wall element 17, similar in profile to the TRULINE modular wall element, can be made having external clutches 17.35 formed on the outside walls of the wall element, near to one end. The embodiment of FIG. 99 will operate in the same manner as that described with respect to FIG. 98, and like it, the external grooves or clutches 17.35. By also having a purpose built caisson or casing 107 for the first wall element 17 (or assembly of elements 17) to be inserted, and having a second purpose built caisson or casing 107 as illustrated in FIG. 99, the wall of which terminates at each end with a respective clutch A and B, so as to be located outside the diameter of the cutters, will engage the respective clutches 17.35 on the, or the forward-most, wall element 17. By this means, the caisson 107 and drilling assembly 3 (not illustrated) can be guided in its drill process by the first wall element 17 or assembly of wall elements 17, and once the drilling assembly is retracted from the caisson 107, the space within the caisson 107 is able to received elements 17A and 17B, either sequentially as single units, or simultaneously as an assembly of wall elements. The subsequent element 17A connecting to element 17 in FIG. 99, can be like one used in FIG. 97, providing the front most element used has side clutches 17.35 as is the case with element 17 of FIG. 99.

The wall elements 17 of FIGS. 97, 98 and 99 provide a retaining wall element for use in controlling land erosion in contact with water which has self-supporting polymeric construction, each element having a vertical longitudinal interior channel 17.51 disposed therein enclosed by at least three sides (or faces) 17.52 with one side being front wall 17.54 and another side being rear wall 17.55. If desired a fourth side can be provided and also if desired an intermediate wall can be provided, or a fastening means to allow an intermediate wall to be assembled thereto.

Each of the modular wall elements 17 have a pair of opposed ends which terminate with one or more fastening means 17.53, in this case 2 per end. Each of the modular wall elements 17 connect to a like or similar modular wall element 17 by mating engagement of the at least one fastening means 17.53 on one first wall element 17 with at least one fastening means 17.53 on the at least one second wall element 17A, the fastening means 17.53 being an engageable clutch or J-shaped hook.

The embodiments of FIGS. 98 and 99 differ from that of FIG. 97 in that at least one of the wall elements includes in or on at least one of a front wall 17.54 and/or rear wall 17.55, an elongated fastening means 17.33, 17.35, respectively, allowing the at least one wall element to connect to the ends A and B of a wall or walls of a casing or caisson 107 and/or a drilling element 3, which will be used to drill and/or keep clear a volume in which the element 17 or 17A or elements 17 and 17A will be installed in an underwater location.

The fastening means 17.35 on the front wall 17.54 and/or the rear wall 17.55 are illustrated in FIG. 99 as being an externally arranged engageable clutch or J-shaped hook; whereas in FIG. 98 the fastening means 17.33 are illustrated as being an internally arranged engageable clutch or groove able to receive a J-shaped hook.

The wall elements 17, 17A 17B of Figure's 97, 98 or 99 are formed or constructed, by virtue of its wall formation, features, shape and/or thickness, to function as a structural wall when it is in a hollow condition.

Additionally, wall elements 17, 17A 17B of Figure's 97, 98 or 99 are initially hollow and when joined and assembled with like or similar elements, are then used as an in-situ formwork and subsequently filled with concrete, cement or grout to form a finished structural wall construction.

If three walls 17.52 are present on each element 17, 17A or 17B, then at least one end cap having a fastening means to attach to the element can be used so as to close off the otherwise open volume of the end section of the element.

Illustrated in FIGS. 100 to 109 is a combination drilling and reaming tool 3 for direct use with the wall elements 17, 17A and 17B of FIGS. 97 to 99, that is where a caisson or casing 107 is not utilised.

Illustrated in FIG. 100 is a modular wall element 17A engaging a like modular wall element 17, each being such as a TRULINE modular wall element, into which is positioned a drilling and/or reaming assembly 3 which has a rotating non-expandable drill bit 4 which is at the base of a drive shaft 6. At a location above the drill bit 4 is a pair of reaming elements 3.1 (on opposite ends of a cable or such like) which is shown as being bent in FIG. 100, so that its ends 3.11 are downwardly directed while the assembly 3 is exiting the wall element 17A as the drill assembly 3 is pulled through after drilling and reaming has been completed. The pairs of reaming elements 3.1, (or multiple pairs of elements as there can be a multiple pairs of the reaming elements 3.1 at different heights on the shaft 6 as described in more detail below) can also have their ends 3.11 upwardly directed as the drilling assembly 3 is pushed through the wall element 17A. Before being inserted into the water, on a land location near to the installation site, whilst still laid flat onto ground, a drilling assembly 3 and a modular wall element are assembled together so that the one or more pairs of reaming elements 3.1 and drill bit 4 are situated proud of the lower rim 17.33. It is in this state that they are locked together by a pin or other mechanical releasable interconnecting means. When so locked together, they can be hoisted together, with the lowest point of the clutches 17.53 being engaged with the clutches of the earlier installed wall element 17, and then pushed down until the drill bit engages ground to be drilled and/or reamed. When drilling and/or reaming is complete, and the wall element 17A is at a desired depth, the releasable mechanical interconnection is released, and the clutches of the interconnected elements 17 and 17A can then be locked together preventing their separation, and at this point, the drilling and reaming assembly 3 can be withdrawn from the wall element 17A.

The respective pairs of reaming elements 3.1 will have their maximum length or diameter when rotating, determined by the geometry as depicted in FIG. 112, and this will be described in detail below. The reaming elements 3.1 or pairs of reaming elements 3.1 are preferably made from helically wound stranded cables of mild steel of approximately 10 mm to 50 mm in outside cable diameter, with the preferred being of the order of 20 mm. It will be understood that this dimension will need to be a compromise between the amount of flexibility required of the reaming elements 3.1 as it is pulled through the wall element 17A after completion of the drilling and reaming process, as well as other factors such as the size of the wall element 17A, compared to the power available to rotate the drilling and/or reaming assembly 3, and even the pressure of pumping of the drilling fluid.

The helically wound spiral strands at the respective ends 3.11 are welded together to prevent the individual strands from unravelling from the cable during reaming operations. The outside shape of the cable, being "shaped" or "profiled" due to the helically wound nature of the cable, acts like a series of radially located teeth, which will engage the ground surface to be reamed, when the drilling assembly is rotated at the order of 50 to 70 RPM, or a higher or lower speeds depending upon the hardness of the ground which the reaming tool 3.1 is to engage. The drilling bit 4 can be an expanding bit but its size is determined solely on its ability to move into and out through the modular wall element 17. When the drill bit 4 is engaging the ground to be drilled and reamed, its main role is to guide the reaming elements 3.1 in their downward journey. As will be described later, the drill and reaming assembly 3, is guided in its motion downward, by the modular wall element 17A, which will downwardly slide along the clutch of an earlier positioned like modular wall element 17.

As illustrated in FIGS. 102 and 103, which are underneath views of the arrangements of FIGS. 100 and 101 respectively, the reaming tool 3.1 shows the ends 3.11 as being multi-stranded, and each strand is in itself a multi-stranded cable element. When the ends 3.11 are free of the confines of the modular wall element 17A, they expand to their full length, or at least will do so, when rotated by the drive shaft 6 at 50 RPM to 70 RPM.

The reaming elements 3.1 can be considered to make up a single tool called a reaming bit having four or six expanding parts, depending on how many cable or spring steel sections are utilised.

From FIGS. 102, 103 and 112, it will be noted that the drill bit 4 and pairs of reaming elements 3.1 have their centre of rotation 4.15, being also the centre of rotation of the drive shaft 6, is located off-centre relative to the length of the modular wall element 17A, as best exemplified by the dimension OD1 in FIG. 112, which shows the offset from the physical centre of the overall length of the element 17A, or the dimension OD2 which shows the offset from the structural centre of the wall element 17A. From FIG. 103 it will be noted that the extremities of ends 3.11 when rotated around the axis 4.15 extend past the free clutches 17.53 at the forward-most end of the modular wall element 17A being illustrated by distances F1 and F2, but also will not intersect or collide with the clutches 17.53 on the modular wall element 17 already or earlier positioned into the ground, by distances C1 and C2 and which clutches 17.53 act as a guide for the modular wall element 17A being inserted and thus the drilling and reaming assembly 3. It is possible that the off-set distances OD1 and OD2 are in fact the same dimension, as a scale representation of the modular wall element 17A is not provided in this document.

To achieve this off-centre arrangement, the dimensions F1, F2, C1, C2 and S1 and S2 will be of the order of 5 mm to 20 mm and will be dependent upon several factors including the tolerances in the drill string, the type of ground being drilled, which may cause the bit to wander off line. Once the drill centre is identified, then one or more guide plates 3.23 are utilised along the length of the modular wall element 17A, so as to locate and keep the centre of rotation 4.15 of the drill bit 4, reaming tool 3.1 and the drive shaft 6 at the correct positional arrangement to prevent the collision of the reaming tool 3.1 with the clutches of the earlier positioned modular wall element 17, and yet to excavate ahead of the clutches 17.53 at the forward-most end of the modular wall element 17A being positioned or inserted. This is best illustrated in FIG. 112, where a single drilling and reaming tool assembly 3, having one centre of rotation 4.15, will excavate a cylindrical excavation with footprint 108, which will overlap with the previously formed excavation 105, but which will not overlap with the forward-most point of the forward clutches 17.53 of the earlier positioned modular wall element 17. As the reaming tool is below the lower rim 17.33 of modular wall element 17A, there will be no interference from the rear end clutches of modular wall element 17A which engage clutches 17.53 of modular wall element 17 positioned earlier.

The guide plates 3.23 are shaped so as to provide a good sliding fit with the internal shape of the modular wall element 17A, and there is preferably approximately 2 mm to 5 mm of clearance between the outside surface of the guide plate 3.23 and the internal surfaces of the modular wall element 17A. Thus as illustrated in FIG. 109, the end 3.231 is shaped so that the clutches and formations provided will not interfere with the sliding movement (or vica-versa), and at an intermediate location grooves 3.232 are provided to accommodate the T-shaped joining formations on at the centre of the modular wall element 17A. As illustrated in FIG. 108, the guide plate 3.23 includes a cylindrical journal bearing 3.233 to assist the drive shaft 6 in its rotation. The lower guide plate 3.23 has an upwardly extending portion 3.234 which extends upwardly for optional connection to a similarly constructed intermediate guide plate, and so on up through the modular wall element 17A, until the upper end is reached at which upper end the drill motor 3.20 is mounted. The number of guide plates 3.23 will be dependent upon the length of the modular wall element 17A.

As an alternative to the provision of guide plates 3.23, the drilling and reaming assembly 3 can be preassembled, as illustrated in FIGS. 114 and 115 into a housing arrangement which sits within and slides within the wall element 17A. The housing arrangement or mandrel as illustrated can be either of a solid construction or of a hollow construction. The mandrel has a shaped body 3.13, which has a similar outer peripheral shape, as best illustrated in FIG. 115, to that of the guide plates 3.23, whereby a sliding fit into the modular wall element 17A will result. The drilling and reaming assembly 3 of FIGS. 114 and 115 has a motor 3.20 below which is mounted a drilling fluid or water swivel 3.241 to which connects the flushing line 3.24. Below the swivel 3.241 is the drive holder 3.21 which will fit over the upper rim of the modular wall element 17A, and which can be releasably locked together by a pin or a bolt or any appropriate means, once the mandrel body 3.13 is inserted within a wall element 17A.

Like drilling and reaming assembly 3 of FIGS. 100 to 109, the drilling and reaming assembly 3 as best illustrated in FIG. 115, the assembly 3 has a drive shaft 6 which extends from the motor 3.20 to the drilling bit 4 and reaming bits 3.1, as well as a horizontal flushing fluid outlet port 6.2 when the assembly 3 is vertical, or which can be described as ejecting flushing fluid at an angle of approximately 90 degrees to the longitudinal axis of the drive shaft 6.

Additionally, as shown in cross section in FIG. 115, the shaped body 3.13 like the guide 3.23, have their respective ends 3.231 being similarly shaped, so as to be slidably received by the wall element 17A, when inserted into the element 17 and be clear of the wall formations and clutches. The difference between guide 3.23 and body 3.13 is that the end 3.231 of the body 3.13 extends the full length of the body as best illustrated in FIG. 114. Similarly, the location groove 3.232 on the opposed sides of the body 3.13 extend the full length of the body 3.13 and are shaped similarly to the grooves 3.232 of the guides 3.23, so as to be slidably received by the intermediate T-shaped joining formations of the wall elements 17A. Also like the guide 3.23, the body 3.13 is sized so that there exists approximately 2 mm to 5 mm of clearance between the outside surface of the body 3.13 and the internal surfaces of the modular wall element 17A or 17.

As illustrated in FIGS. 114 and 115 the drilling and reaming assembly 3 has two pairs of reaming elements 3.1 which can be held in "bits" in the drive shaft 6, or as part of separate bits which are added to the base of the drive shaft and to which the drill bit 4 is also attached. The respective two pairs of reaming elements 3.1 are formed from a spiral wound cable as described above or they can be made of spring steel bar or formed with parts constructed of cable or spring steel, to clear an excavation with footprint 108, as in the earlier embodiment. Like the earlier embodiments, there can be only a single pair of reaming elements 3.1, which will provide the most dynamically stable arrangement, or if desired there could be only a single reaming element (not a pair of) being only a single arm extending in one direction only from the drive shaft 6. Alternatively there can be more than two opposed pairs, or more than one single arm reaming element, located at different heights on the drive shaft 6, and also being angularly spaced from the adjacent single arm reaming elements.

The drilling and reaming assembly 3 of FIGS. 114 and 115, is preferably of a length to suit the length of the wall element 17A. However, if desired the body 3.13 can be made in multiple joinable segments or parts so that segments of the body 3.13 can be removable or receive more like segments to increase or decrease the length of the body 3.13 and the dive shaft 6.

As is illustrated in FIGS. 104 and 105, the drilling and reaming assembly 3 has a motor 3.20 such a hydraulic motor or the like. A flushing line 3.24 connects via a rotating joint (not illustrated—see item 3.241 in FIG. 114 for a similar rotating joint) with the drive shaft 6 longitudinally extending flushing hole 6.1, which as is visible in FIG. 106, descends down to the base of the shaft 6 and through the drill bit 4, so as to provide horizontally directed flushing streams 6.3, from horizontal passages 6.2 at the base of the drive shaft 6 or in the drill head 4. The preference is that the drilling fluid or flushing medium utilised exits the drill assembly 3 at the lowermost point, and as such this will be horizontally through the drilling head 4. This will ensure delivery of the fluid material direct to the undisturbed portion of the area being excavated. The flushing system formed with drill fluid delivery line 3.24—not shown connected) can be used to pump water, mud, air, polymer compositions, bentonite or any other appropriate flushing or drilling compound, as will be known to those skilled in the art. Preferably the flushing system will be pressurised to of the order of 50 to 500 PSI.

Preferably the section of the drilling and reaming assembly 3, between the drive holder 3.21 and the lower guide plate 3.23, is of a modular construction, so that "modules" of drilling and reaming sections can be added/assembled or removed/disassembled from the assembly 3, so that different lengths of modular wall elements 17A can be positioned. This modular nature of the drilling and reaming assembly 3 can be achieved by screw thread connections between the modular components.

The upper end of the assembly 3, below the motor 3.20 includes a drive holder 3.21 which has an undercut channel portion 3.22 into which can be receive the upper rim of the modular wall element 17A to be inserted. The combined action of gravity active upon the upper rim of modular wall element 17A, and the drilling and reaming action of the drilling and reaming assembly 3, ensures that the modular wall element 17A will descend to the desired depth into the ground being drilled and reamed. It is not expected that the drive holder 3.21 will have to transmit percussion and/or vibratory force to the wall element 17A, but it can be configured so as to be readily adapted to do so.

The above description has the reaming elements 3.1 being made exclusively from sections of cable. However if desired, the reaming elements 3.1 need only have a cable section at the location where bending is to be present. Thus the reaming tool 4.1 need only need be partially made from a cable. Additionally, the reaming element 3.1 could be made as a spring steel reaming element or have a spring steel portion, to provide the flexibility and resilience needed to draw the reaming elements 3.1 out through the wall element 17A once reaming and drilling is completed.

Another alternative is that the reaming elements 3.1 can be made as an expanding and contracting reaming bit, whereby through an arrangement of levers and mechanisms, the reaming bit can be contracted for withdrawal purposes. Additionally or alternatively, the reaming elements 3.1 can be of the sort that expand by rotation or otherwise can be hydraulically activated.

As best illustrated in FIG. 104, the reaming elements 3.1 can be made up of a multiple of reaming elements 3.1, 3.1A, 3.1B and 3.1C, so that they are radially spaced on the drive shaft 6, as best illustrated in FIG. 107, at approximately 45 degrees apart in plan view. Preferably the helically wound cable elements which form the reaming elements 3.1, are held immoveable and centred relative to the drive shaft 6 by means of a grub screw or bolt which engages the cable at 90 degrees, and secures it into place. This allows ready replacement of worn cable elements 3.1. If ready replacement is not required, then the elements 3.1 can be welded or crimped into place on the drill shaft.

The cable length which forms the elements 3.1 ensures that there is sufficient flexibility and resilience, so that the ends 3.11 will bend and fit into the cavity of the modular wall element 17A, when the drill and/or reaming assembly 3 is being inserted into and/or withdrawn from the modular wall element 17A. In the region of the section of drive shaft 6 where the reaming elements 3.1 to 3.1C are located, the internal passages which will carry the drilling fluid have a greater cross sectional area than the reaming tool diameter so that when they intersect and the cable installed, there is a path for drilling fluid under pressure to pass around the cable and continue on to the horizontal outlets.

The length of the cable section selected for the pairs of reaming elements 3.1 is based on the location of the centre or axis of rotation of the drilling and reaming bits being at an off-centre location, as best illustrated in FIG. 112, where the extremities of the drilling and/or reaming bits have a locus or rotation envelope or excavation which clears the clutches 17.53 of a previously installed modular wall element 17, and which locus or rotation envelope or excavation extends past the forward or opposite side clutches 17.53 of the wall element 17A being installed.

It will be understood that the very first wall element, for example modular wall element 17, will be installed by the same drill assembly as used by the second wall element 17A, except that the reaming bit will have longer cable sections for the pairs of reaming elements 3.1, so that from the centre of rotation or rotation axis, the extremities of the ends 3.11, when fully extended will have a locus, or rotation envelope, or excavation footprint, which clears the forward and rearward clutches 17.53 of the modular wall element 17 being first installed. It is for this reason that having the cable or tool holder being for example a grub screw can be highly advantageous as multiple drilling and reaming assemblies 3 is not required.

FIGS. 100 to 109 and 112, illustrate a wall element system and drilling and/or reaming assembly 3 which has a single drilling and reaming drive shaft 6 and rotation axis 4.15. Illustrated in FIGS. 110 and 111, are the geometries to achieve a similar result as that illustrated in FIGS. 100 to 109 and 112, but with two rotation centres, where the drilling and reaming assembly 3 has two drive shafts 6, with bit 4 and reaming tools 3.1 on one shaft and located at a different height to the other shaft.

While the drilling and/or reaming assemblies 3 of FIGS. 100 to 115 have a motor 3.20 located outside of the wall element 17A, it will be readily understood that the motor 3.20 can be located inside the wall element 17A, but must be of a size that allows for the extraction of the motor and drilling and/or reaming bits through the wall element 17A. Additionally the motor can be at an upper location within the wall element 17A, or at an intermediate location or at a lower location within the wall element 17A. Further the motor 3.20 could be located below the wall element 17A, but this is expected to require the drilling and/or reaming of deeper excavations, than that expected with the other locations described above.

Illustrated in FIG. 113 is a caisson or casing system, similar to that of FIG. 97, which utilises a connection piece 125 which does not engage the clutches 17.53 on the first positioned wall element 17. Instead the connection piece 125, which is removeable from the caisson or casing 107, due to rearward extensions 125.3 will prevent the caisson or casing 107 from moving in a direction up or down the page as illustrated in FIG. 113, and by the exertion of a relatively small force in the direction from the caisson or casing 107 towards the wall element 17, the caisson or casing, by means of the outside face of the connection piece 125 sliding over the outer points of the clutches 17.53, will be able to achieve a sufficient guiding action of the drilling or drilling and reaming assembly 3 to sink the caisson or casing 107 into and overlapping excavation with footprint 108 into the ground.

VI. LEGENDS

FIGS. 1.1,1.2,1.3, 2.1, 2.2, 2.3, 3.1, 3.2, 3.3, 4.1, 4.2, 4.3, 5 to 10, and 13 to 22 have the following feature legend (not all are listed):

1—caisson;
1.2—structural core cast inside a caisson to be left in situ;
2—caisson leading edge;
2.1—gap between caisson/casing and the body of the drilling assembly;
3—excavation drilling assembly;
4—drill bit retracted;
4.1—drill bit extended or expanded;
4.2—drill bit extended or expanded;
4.3—drill bit extended or expanded;
5—rotation motor;
6—drive shaft;
7—hydraulic flow divider;
8—bearing housing with flushing hole;
9—base of bearing with flushing hole;
10—latch assembly;
10.1—latch body;
10.2—latch pivot stationary relative to drill assembly 3;
10.3—latch pivot moveably pivoted and mounted to lift flange 12.1;
10.4—mounting plate attached to drill assembly 3;
11—recess in caisson to accept latch;
12—lifting assembly or chain;
12.1—lifting flange or eye;
12.2—compression spring;
12.3—mounting bolt;
12.4—mounting washer;
12.5—mounting nut;
13—hydraulic hoses;
14—flushing hoses;
15—flushing hole in drill bit;
16—normal direction of rotation to keep retracted;
17—structural panels;
17.1—vertical gap between adjacent panels;
17.2—pre-existing structural panel in the ground;
18—stocking;
19—grout line;
20—grout key;
21—grout tube for toe grouting;
22—toe grout;
23—penetration for dowel;
24—hard ground or rock;
25—hole drilled into hard ground or rock;
26—dowel;
27—grout line for down penetration hole;
28—capping beam;
28.2—existing capping beam;
29—apertures for capping beam reinforcement bars;
30—reinforcement bars inserted into apertures in the panel;
31—reinforcement bars cast into the panel;
32—anchoring ties;
32.1—extended portion of an anchoring tie linking new and existing capping beams;
32.2—anchoring tie to an existing capping beam;
1'—trailing caisson;
33—displaced plasticized ground matter;
34—trailing edge projection for end-to-end attachment between caissons;
35—leading edge projection for end-to-end attachment between caissons;
36—groove in the leading edge projection to accommodate the trailing edge projection of an adjacent caisson;
38—rope used in a pulling operation to lower the caisson;
40—pulley used in a pulling operation to lower the caisson;
S—parting plane between sections of a caisson;
100—hydraulic or pneumatic cylinder.

FIGS. 23 to 50 include features from following legend (not all are listed):

101—first sheet to be placed;
102—second sheet to be placed;
103—third sheet to be placed;
104—clutch;
105—boundary of the ground disturbed while placing the first sheet;

106—connection section of the caisson;
107—caisson;
108—footprint or boundary of the ground disturbed by the tool or excavation footprint;
109—expandable drills;
110—tool holding the expandable drills;
111—blank connecting piece;
112—sheet to be connected too;
113—last full sheet placed;
114—fabricated connecting piece;
115—boundary of the ground disturbed placing sheet 112;
116—boundary of the ground disturbed placing sheet 113;
117—layer of hard ground the sheet pile must pass through;
118—ground level;
119—hard seabed;
120—water level;
121—soft seabed;
122—grout filling the drilled hole;
124—caisson half;
125—connection section or piece;
126—connecting pin/bolt;
133—expanding drill in retracted condition;
134—expanded diameter being drilled;
135—adjacent diameter to be drilled next;
136—holes previously drilled;
137—hydraulic motor for powering drill;
138—ground level;
139—conventional sheet pile driving implement or equipment;
140—cast locating groove;
XX—axis in plan through the clutches of the sheets to be installed;
YY—minor axis in plan through the caisson 107 and the tool 3.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A method of constructing a retaining wall utilizing a caisson or casing for a ground or underwater location, the method comprising:

installing a first retaining wall element into said ground or underwater location, said first retaining wall element including a join formation or clutch on a side thereof;

providing the caisson or casing having a shaped wall which is open for a predetermined length which provides free sides, with at least one of said free sides having a join formation or clutch;

closing off the shaped wall of said caisson or casing with a connection section having at least one wall-mating join formation or clutch adapted to connect to an open side of said shaped wall, and at least one element-mating join formation or clutch adapted to connect to said join formation or clutch on said side of said first retaining wall element;

attaching said at least one element-mating join formation or clutch of said connection section to the at least one join formation or clutch of said first retaining wall element, inserting an excavation means within an area defined by said caisson or casing and connecting the excavation means to the caisson or casing, said excavation means being adapted to excavate ahead of a leading edge of said caisson or casing;

activating said excavation means so said caisson or casing and said connection section enters the excavated ground or underwater location to a predetermined depth;

once said predetermined depth is achieved, withdrawing the excavation means from said caisson or casing;

withdrawing said connection section from said first retaining wall element and said caisson or casing;

attaching a second retaining wall element to the first retaining wall element, and sliding said second retaining wall element to the predetermined depth inside said caisson or casing, said second retaining wall element including a join formation or clutch adapted to join to said first retaining wall element; and withdrawing said caisson or casing from said second retaining wall element.

2. The method as claimed in claim 1, wherein activating said excavation means includes flushing a fluid through said excavation means to assist entry of said caisson or casing and said connection section into said ground or underwater location.

3. The method as claimed in claim 1, wherein the connection section further comprises a wall portion with an element-mating join formation or clutch adapted to join with the join formation or clutch at the side of said first retaining wall element.

4. The method as claimed in claim 1, wherein the connection section is one of: a sheet pile; a panel; an open section retaining wall element; or an open section formwork element.

5. The method as claimed in claim 1, wherein the connection section is a formed and/or shaped structure adapted to function as one of a sheet pile, panel, open section retaining wall element, or formwork element.

6. The method as claimed in claim 1, wherein the connection section has at least two wall-mating join formations or clutches.

7. The method as claimed in claim 1, wherein said connection section has a first wall portion and a second wall portion which is at an angle to the first wall portion, and wherein said second wall portion terminates in said at least one element-mating join formation or clutch.

8. The method as claimed in claim 1, wherein the at least one element-mating join formation or clutch is located partly outside an excavation footprint of said excavation means.

9. The method as claimed in claim 1, further comprising repeating the method to insert further retaining wall elements.

10. The method as claimed in claim 1, wherein said first retaining wall element is installed using a caisson or casing.

11. The method as claimed in claim 1, wherein said first retaining wall element is installed without using a caisson or casing.

12. The method as claimed in claim 1, wherein said caisson or casing is comprised of sections.

13. The method of claim 1, wherein said second retaining wall element further includes a further join formation or clutch, the further join formation or clutch being adapted to join to a third retaining wall element.

14. The method of claim 1, wherein said excavation means includes a drilling assembly.

15. The method of claim 14, wherein the drilling assembly includes one or more drill bits, each drill bit being configurable between a retracted state, in which a diameter of the drill bit is less than a dimension of the area defined by said caisson or casing, and an expanded state, in which the diameter of the drill bit is greater than the dimension of the area defined by said caisson or casing.

16. The method of claim 15, wherein the one or more drill bits are in the contracted state when the excavation means is inserted within the area defined by said caisson or casing, the method further comprising setting the one or more drill bits to the expanded state prior to activating the excavation means, and setting the one or more drill bits to the contracted state prior to withdrawing the excavation means.

17. The method of claim 15, wherein each drill bit in the expanded state extends beyond at least part of the leading edge of the caisson or casing.

* * * * *